United States Patent [19]

Whynacht

[11] Patent Number: 4,568,909

[45] Date of Patent: Feb. 4, 1986

[54] REMOTE ELEVATOR MONITORING SYSTEM

[75] Inventor: Charles Whynacht, Glastonbury, Conn.

[73] Assignee: Otis Elevator Company, Farmington, Conn.

[21] Appl. No.: 562,624

[22] Filed: Dec. 19, 1983

[51] Int. Cl.[4] ..... B66B 3/02

[52] U.S. Cl. ..... 340/21; 340/19 R; 187/29 R

[58] Field of Search ..... 340/21, 19 R; 187/29 R

[56] References Cited

U.S. PATENT DOCUMENTS

| | | | |
|---|---|---|---|
| 3,851,735 | 12/1974 | Winkler et al. | 187/29 R |
| 3,973,648 | 8/1976 | Hummert et al. | 187/29 R |
| 4,023,139 | 5/1977 | Samburg | 340/506 |
| 4,330,838 | 5/1982 | Yoneda et al. | 187/29 R |
| 4,370,717 | 1/1983 | Hummert et al. | 187/29 R X |
| 4,387,368 | 6/1983 | Day, III et al. | 340/539 |
| 4,418,795 | 12/1983 | Trosky et al. | 187/29 R |
| 4,512,442 | 4/1985 | Moore et al. | 340/19 R |
| 4,517,468 | 5/1985 | Kemper et al. | 290/52 |

FOREIGN PATENT DOCUMENTS 2025663 1/1980 United Kingdom .

*Primary Examiner*—James L. Rowland
*Assistant Examiner*—Jeffery A. Hofsass
*Attorney, Agent, or Firm*—Francis J. Maguire, Jr.

[57] ABSTRACT

A plurality of operating systems in buildings organized in geographical groups, each group having a local service office, are monitored at both the local offices and a central office for the presence of various combinations of performance criteria defining alarm conditions.

9 Claims, 25 Drawing Figures

Txd
DTR
RTS
Rcd
CTS
DCD
RI
+12V
-12V
DVR
RS232V-24
RCVR
RS232V-24
Va
Z8601
SINGLE CHIP MASTER/SLAVE COMMUNICATION INTERFACE AND UART
Vcc
8-BIT LATCH (LS374)
BUS ACK
BUS REQ
MEM REQ
VECTOR
CLOCK
LS04
Vdd
2N2907A
339
TERM NETWORK
COMMUNICATION LINES
IN4371
2N2907A

Vcc
.01μF
CRYSTAL AND CKTRY
MXD-55-4
MASTER CLOCK
EXT
706
708
710
714
716
718
720
2.4K
10K
PROCESSOR
Z80
60 HZ INTERRUPT
312
302
120 VAC 60HZ
FULL WAVE RECTIFIER
XFMR
POWER SUPPLY
310
318
726
728
730
732
734
712
CL PRQ
D CLR
Q
5.1K
240K
62K
100
51K
.033μF
1μF
13K
9.1K
10K
A0 A1 A2 A3 A4 A5 A6 A7 A8 A9 A10 A11 A12 A13 A14 A15

306
ROM
TMM2764D
304
702
RAM
TMM2016P-2
MEMORY DECODER /SELECTER /MULTIPLEXER
700
704
Vcc
316
D0
D1
D2
D3
D4
D5
D6
D7
BUS REQ
BUS ACK
WR
MEM REQ
CLOCK
604
602
606
608
610
612
VECTOR
10K
IN4001
IN4001
750
1Ma

DATAIO

INOP

INOLOG

ALARM

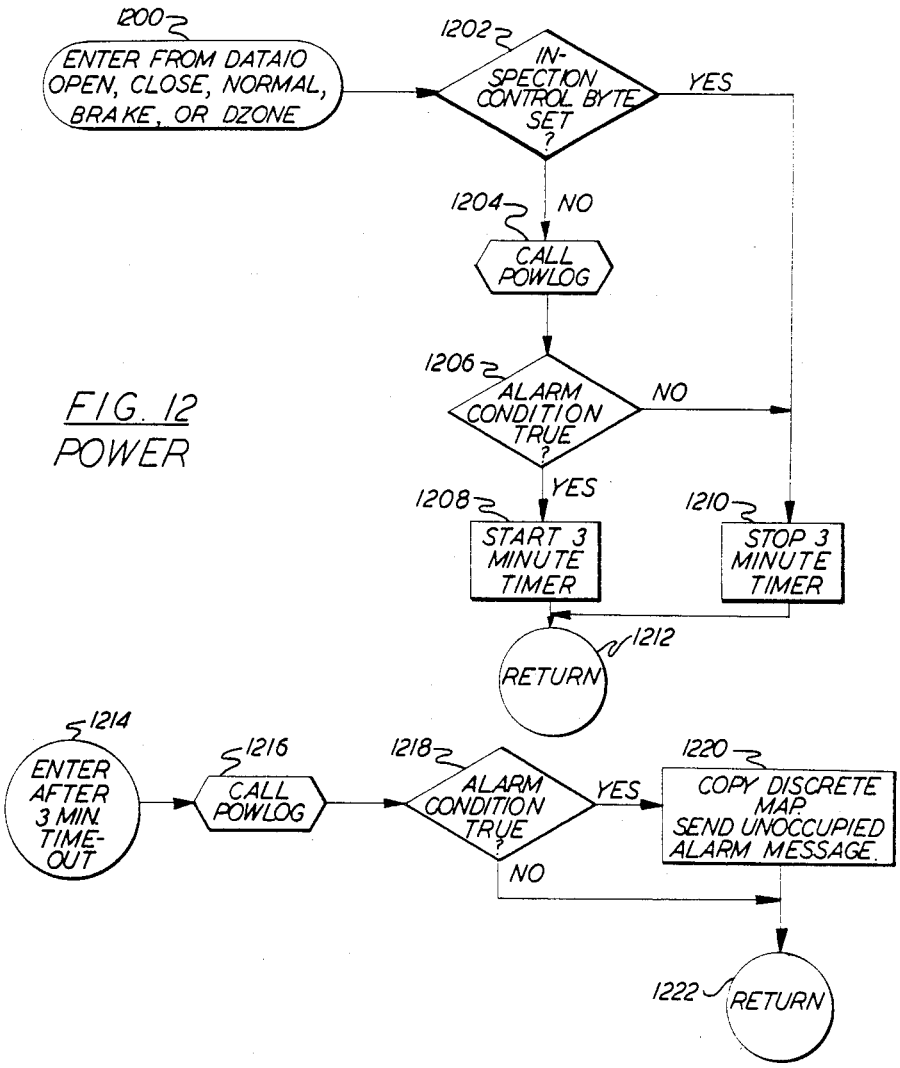
FIG. 12
POWER
FIG. 13
POWLOG
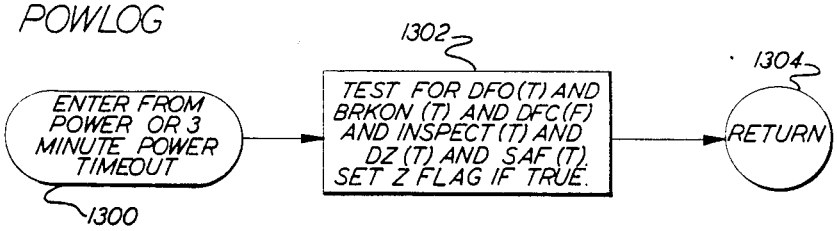

STPALM

STPCHK

NORMAL

DZONE

LEVEL

LEVCHK

BRAKE

OPEN

CLOSE

BINARY ADDRESS LINES CORRESPONDING TO EACH HEXADECIMAL BIT $A_{15}\ A_{14}\ A_{13}\ A_{12}$
$A_{11}\ A_{10}\ A_9\ A_8$
$A_7\ A_6\ A_5\ A_4$
$A_3\ A_2\ A_1\ A_0$

| DECIMAL ADDRESS | HEX BIT 3 ($16^3$) | HEX BIT 2 ($16^2$) | HEX BIT 1 ($16^1$) | HEX BIT 0 ($16^0$) | |
|---|---|---|---|---|---|
| 0 0 0 0 | 0 | 0 | 0 | 0 | 8K |
| | 0 | F | F | F | |
| | 1 | 0 | 0 | 0 | |
| 8 1 9 1 | 1 | F | F | F | |
| 8 1 9 2 | 2 | 0 | 0 | 0 | 8K |
| | 2 | F | F | F | |
| | 3 | 0 | 0 | 0 | |
| 16, 3 8 3 | 3 | F | F | F | |
| 16, 3 8 4 | 4 | 0 | 0 | 0 | 8K |
| | 4 | F | F | F | |
| | 5 | 0 | 0 | 0 | |
| 24, 5 7 5 | 5 | F | F | F | |
| 24, 5 7 6 | 6 | 0 | 0 | 0 | 8K |
| | 6 | F | F | F | |
| | 7 | 0 | 0 | 0 | |
| 32, 7 6 7 | 7 | F | F | F | |
| 32, 7 6 8 | 8 | 0 | 0 | 0 | 8K |
| | 8 | F | F | F | |
| | 9 | 0 | 0 | 0 | |
| 40, 9 5 9 | 9 | F | F | F | |
| 40, 9 6 0 | A | 0 | 0 | 0 | 8K |
| | A | F | F | F | |
| | B | 0 | 0 | 0 | |
| 49, 1 5 1 | B | F | F | F | |
| 49, 1 5 2 | C | 0 | 0 | 0 | 8K |
| | C | F | F | F | |
| | D | 0 | 0 | 0 | |
| 57, 3 4 3 | D | F | F | F | |
| 57, 3 4 4 | E | 0 | 0 | 0 | 8K |
| | E | F | F | F | |
| | F | 0 | 0 | 0 | |
| 65, 5 3 5 | F | F | F | F | |

BINARY REPRESENTATION OF MOST SIGNIFICANT BITS (HEX BIT 3)

| HEX BIT 3 | $A_{15}$ ($2^3$) | $A_{14}$ ($2^2$) | $A_{13}$ ($2^1$) | $A_{12}$ ($2^0$) |
|---|---|---|---|---|
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 1 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| A | 1 | 0 | 1 | 0 |
| B | 1 | 0 | 1 | 1 |
| C | 1 | 1 | 0 | 0 |
| D | 1 | 1 | 0 | 1 |
| E | 1 | 1 | 1 | 0 |
| F | 1 | 1 | 1 | 1 |

TABLE II

REMOTE ELEVATOR MONITORING SYSTEM

DESCRIPTION

1. Technical Field

This invention relates to monitoring selected parameters of a plurality of operating systems at a plurality of remote sites, to determine the presence of an alarm condition according to defined alarm criteria, to transmit alarm condition signals to a local office for initiating service actions, and to retransmit alarm condition signals to a central office for evaluation.

2. Background Art

As is known in the art, any number of systems operating at a plurality of remote sites may be monitored using sensors at the remote sites and transmitting information on the present status of the sensed parameters during the systems' operation at the sites, such as elevator systems in a plurality of remote buildings. The parameters selected for monitoring are chosen according to their importance in evaluating the operational condition of a system. In the case of an elevator system, typical sensors would include an alarm button sensor a door fully open sensor, a leveling sensor, a demand sensor, and a brake fully engaged sensor. These sensors produce signals which may be multiplexed into a transmitter for transmittal to a local office which monitors the status of the plurality of elevator systems. Upon receiving a signal indicating an abnormal condition, the local office personnel may logically infer the operational condition of the system by noting the presence or absence of other abnormal condition signals of other associated sensed parameters. For example, if an alarm button pressed and a door closed signal are both received, a condition in which a person is possibly stranded within an inoperative elevator car may be inferred. Additional pieces of information can be transmitted to make the evaluation task easier. Generally, the more information received, the more accurate the conclusions that may be drawn concerning the nature of conditions. For example, if in the above example, additional pieces of information are provided indicating that the car is within a door zone, that it has levelled properly with respect to a hall landing, and the car brake is fully engaged, the type of inoperative condition that has occurred can be considerably narrowed. A serviceman is then dispatched to the remote location having at least some foreknowledge of the nature of the inoperative condition which permits him to make adequate preparations for quickly correcting the condition.

As the number of monitored parameters increases, the task of evaluating whether and what kind of alarm condition exists, if any, becomes more difficult. If a local office is monitoring a large number of systems, the amount of performance information received can be very high making the interpretative task even more difficult.

An additional difficulty in using large numbers of monitored parameters is that the interpretive task can become extremely complex, making it likely that interpretive errors or oversights may occur. If such an error or oversight occurs, the owner of the building in which the inoperative elevator car is located will eventually telephone requesting a serviceman and providing whatever knowledge he may have concerning the nature of the inoperative condition. However, this is a highly undesirable form of receiving the information needed to efficiently deploy a service organization. This is especially true when a monitoring system has been installed in a building for the purpose of immediately detecting such inoperative conditions at a local service office.

From the perspective of a system manufacturer, it is detrimental to his overall operation for local service offices to be in such a position. Normally, the manufacturer learns of such servicing problems via customer complaints. It would be desirable to have a more effective method of learning of inoperative conditions that are not being effectively serviced before customer complaints are voiced.

DISCLOSURE OF INVENTION

The object of the present invention is to provide an operating system monitor capable of monitoring selected parameters and evaluating their states in order to form conclusions concerning the system's performance and whether any predefined alarm conditions are present.

According to the present invention the sensed parameters to be evaluated are received and stored by a signal processor which compares the present received values with values received and stored at an earlier time to determine if any parameter has changed state, and if so, testing the present value of the changed parameter in combination with the present values of other parameters that together define an alarm condition in order to determine if the alarm condition is present, and if so, transmitting an alarm condition signal which is then displayed as an alarm message.

In further accord with the present invention a plurality of such monitored systems may be grouped such that their individual performance and alarm condition signals are transmitted to a local office where they are evaluated by local service personnel so that appropriate service actions may be taken on a timely basis.

In still further accord with the present invention, a plurality of such local offices may retransmit performance data and alarm messages from their associated operating systems to a central office which monitors many local offices.

The remote system monitor of the present invention provides an intelligent means of automatically evaluating the operational status of an operating system. It also may be used for automatically evaluating the status of a plurality of systems organized in local geographical areas each reporting to an associated local office. The demanding task of evaluating many hundreds, thousands, or hundreds of thousands of pieces of performance data is greatly reduced by providing predefined performance criteria defining alarm conditions. The automatic provision of alarm messages to the local office ensures that proper evaluation of the performance data leads to efficient deployment of the local office service force. When retransmitted to a central office essential information necessary for long term performance projections and for the evaluation of the effectiveness of local service offices is provided for use by central office personnel.

BRIEF DESCRIPTION OF DRAWING(S)

Figure 10:
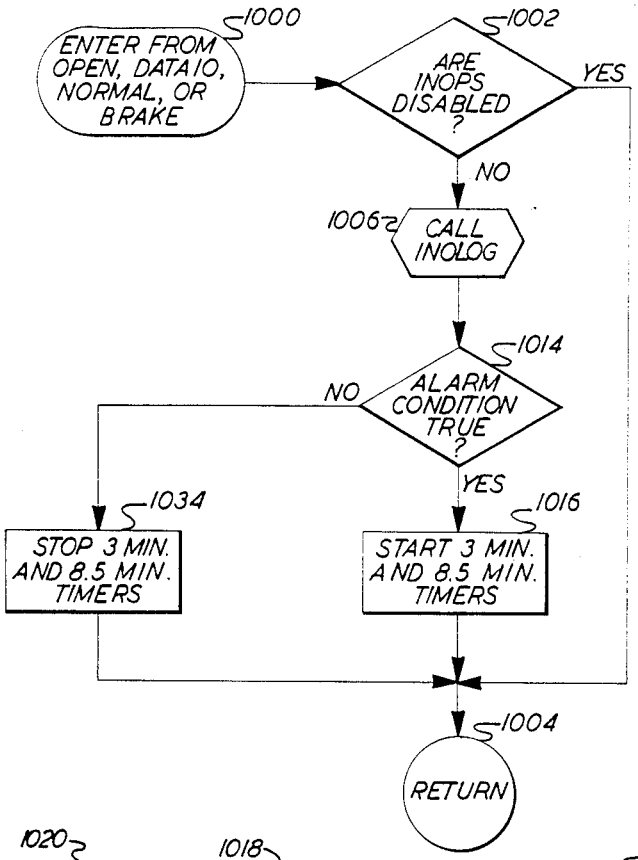
FIG. 10 is a simplified flowchart diagram of the INOP subroutine performed by the master processor in determining whether an unoccupied alarm condition is present.
Figure 10A:
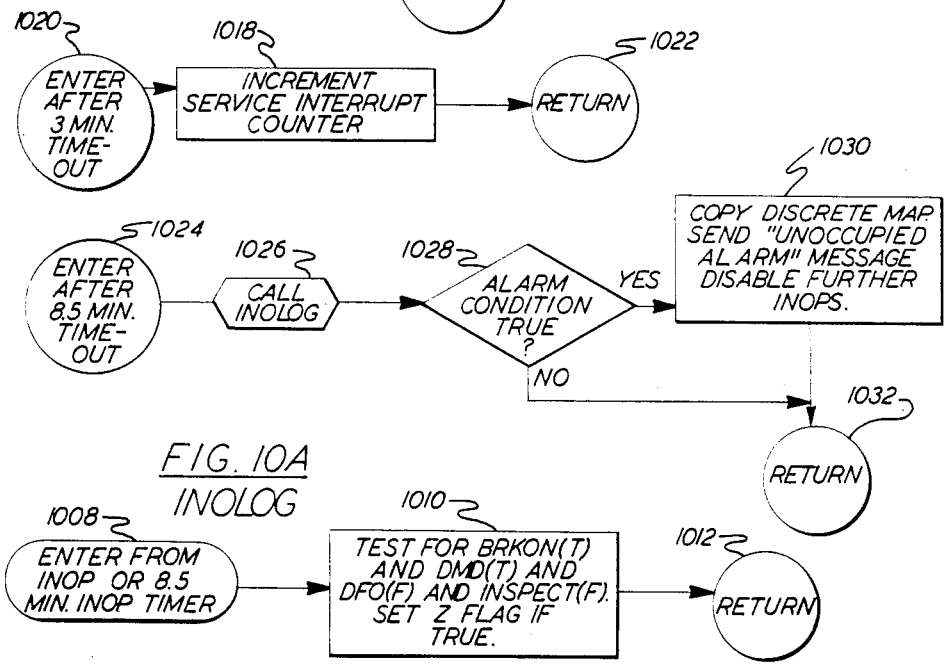
Figure 11:
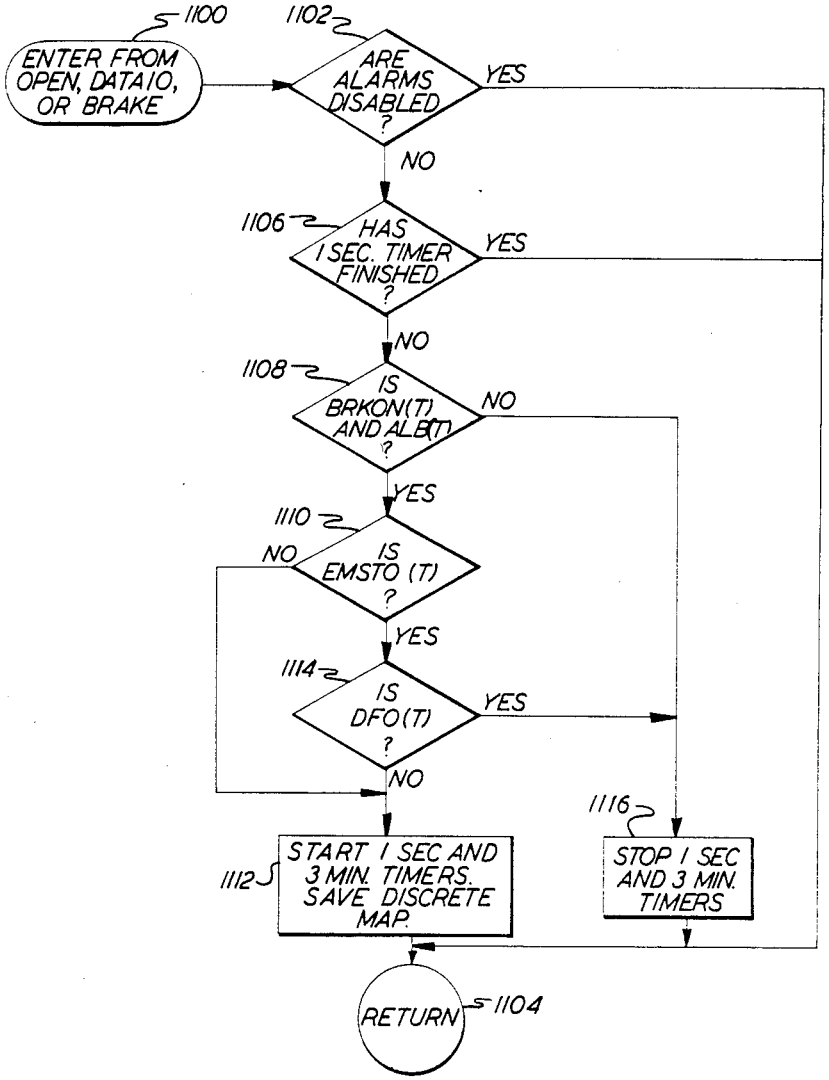
Figure 11:
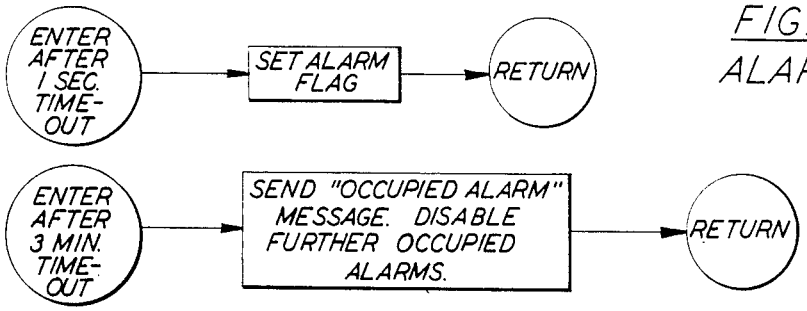
Figure 14:
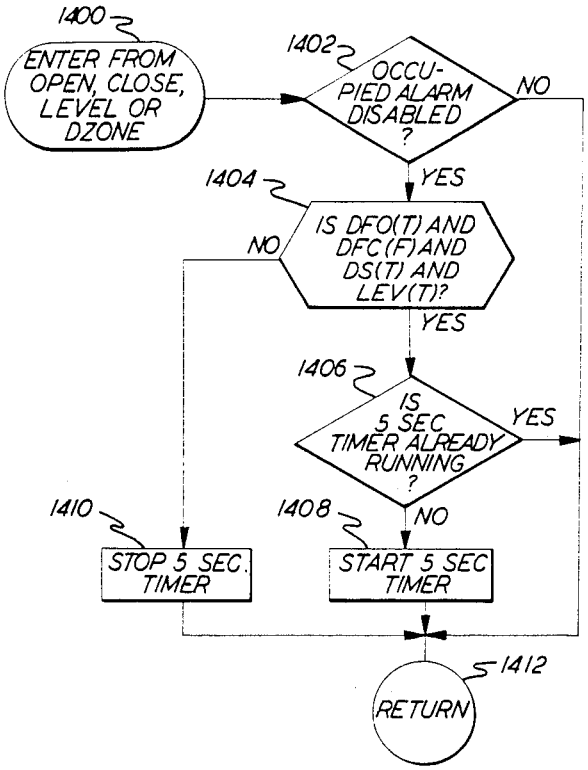
Figure 15:
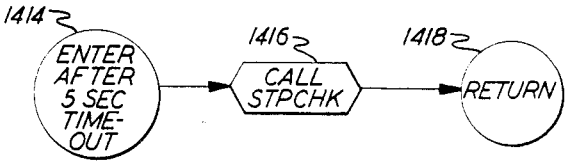
Figure 15:
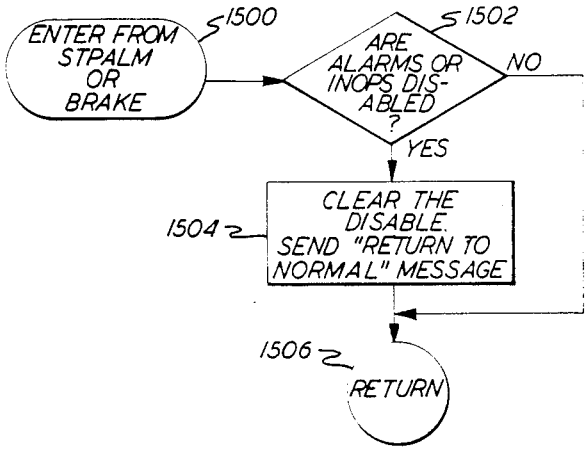
Figure 16:
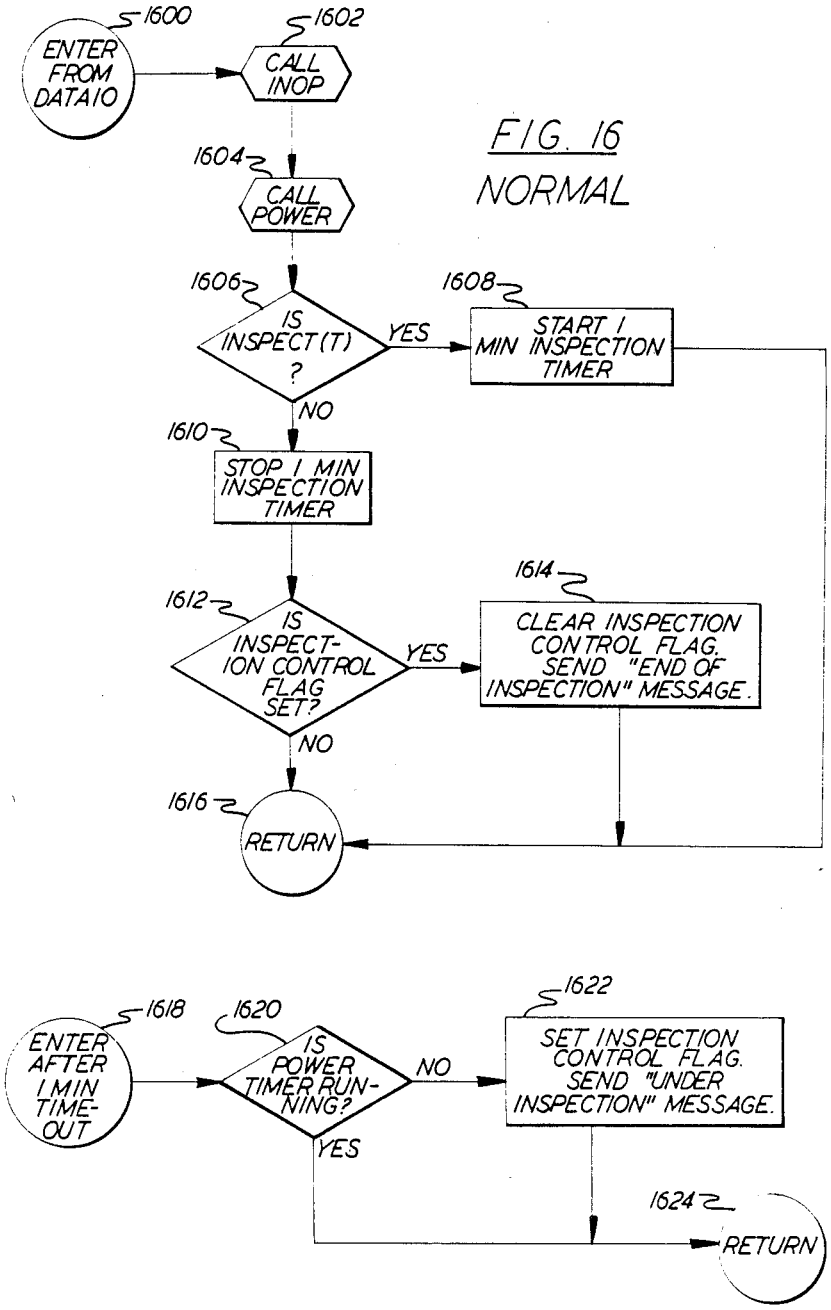
Figure 17:
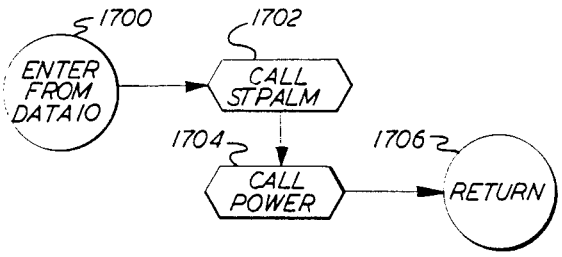
Figure 18:
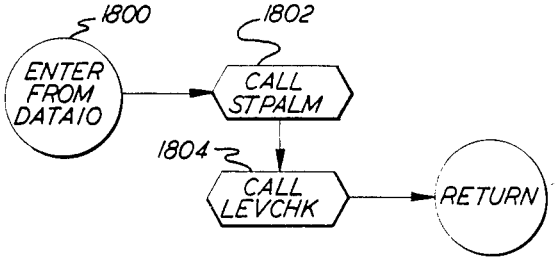
Figure 19:
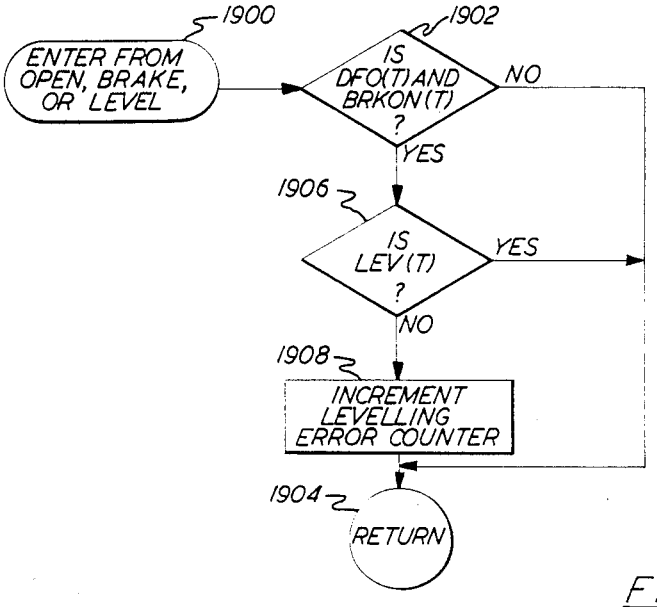
Figure 20:
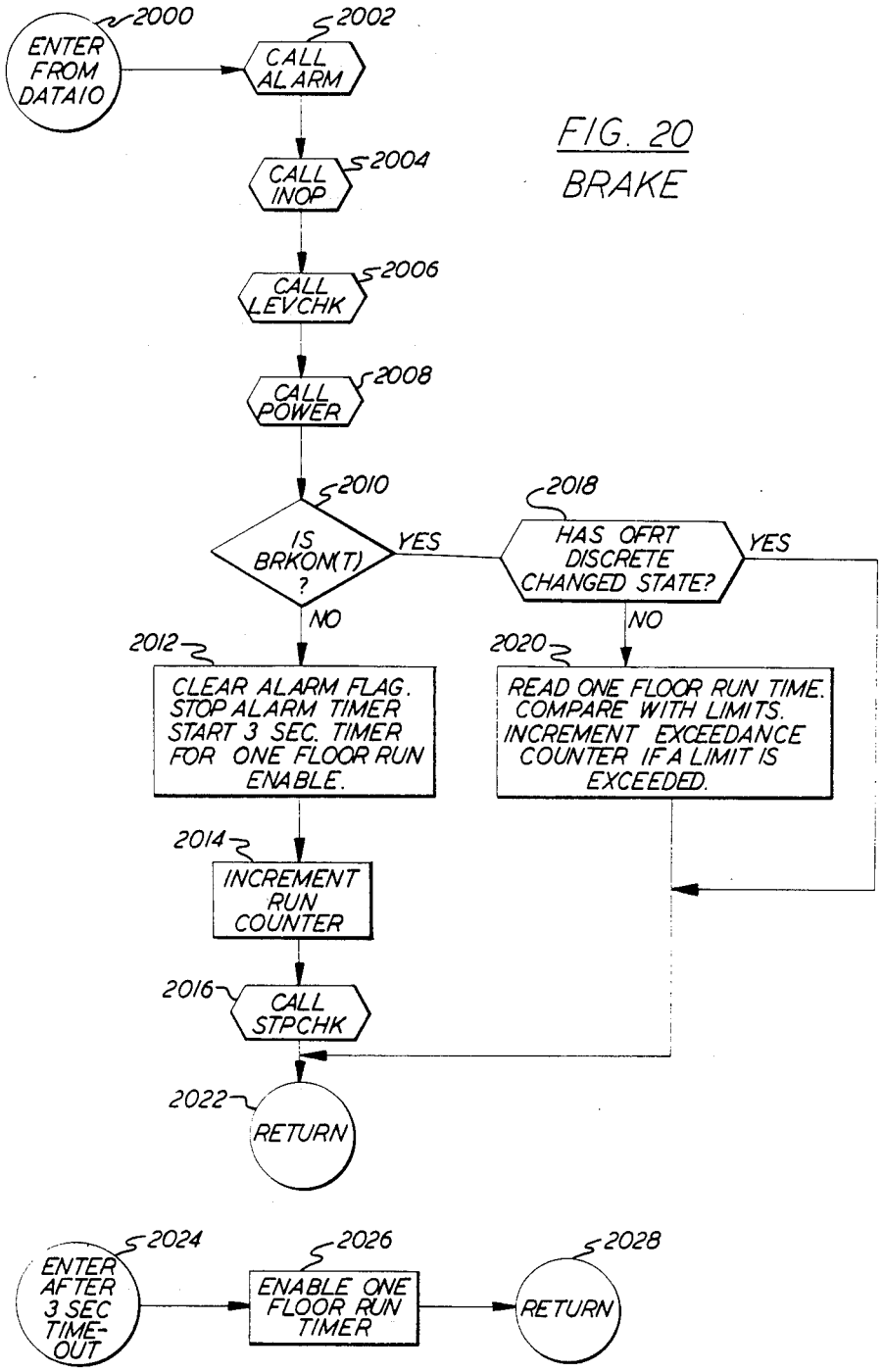
Figure 21:
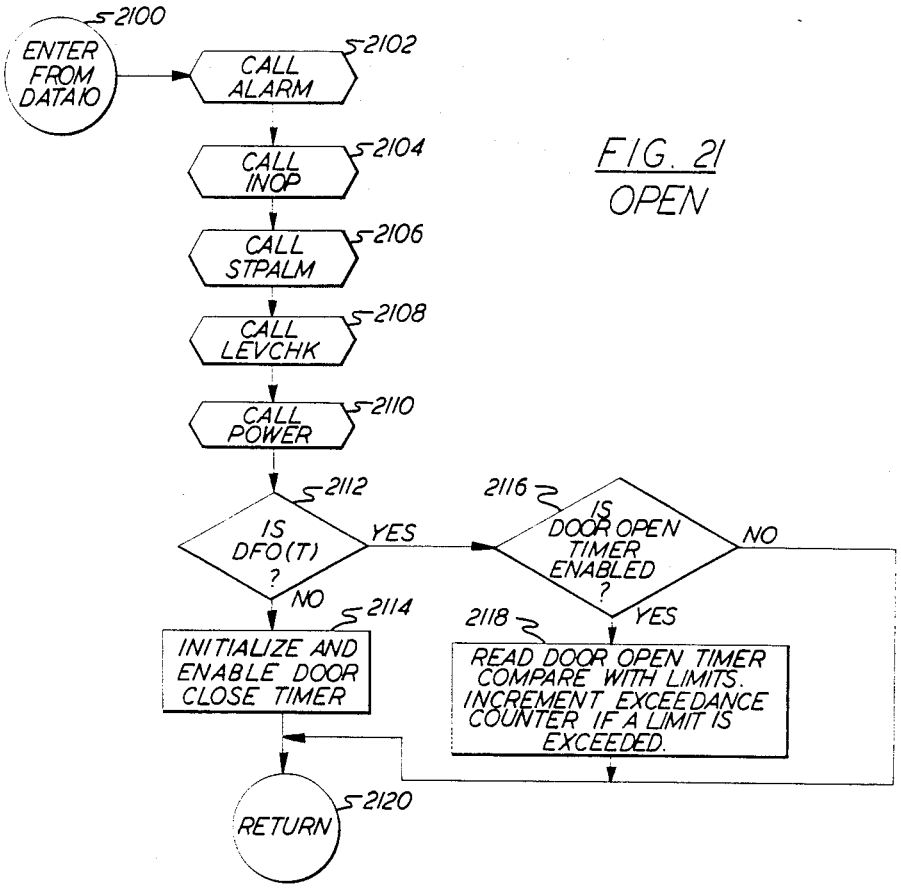
Figure 22:
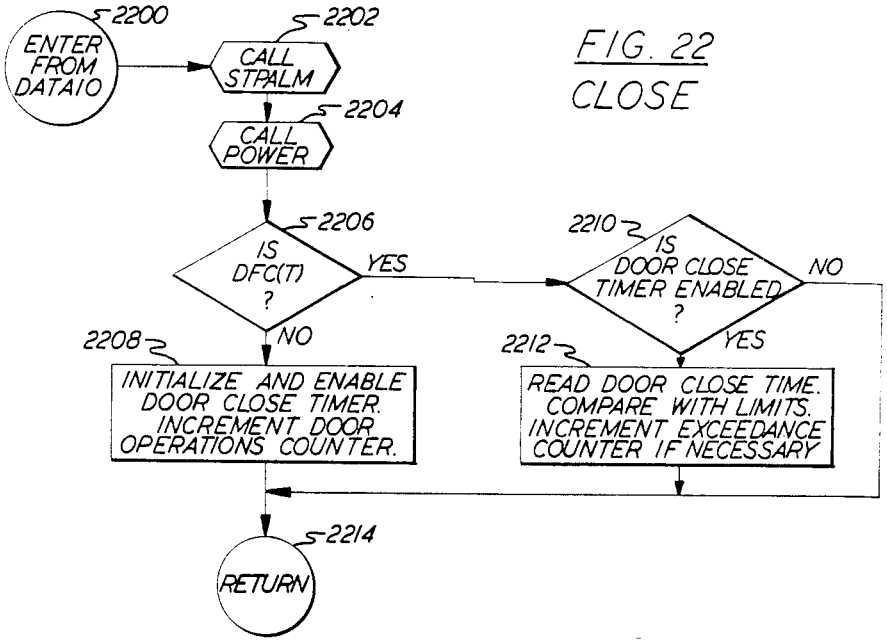
Figure 1:
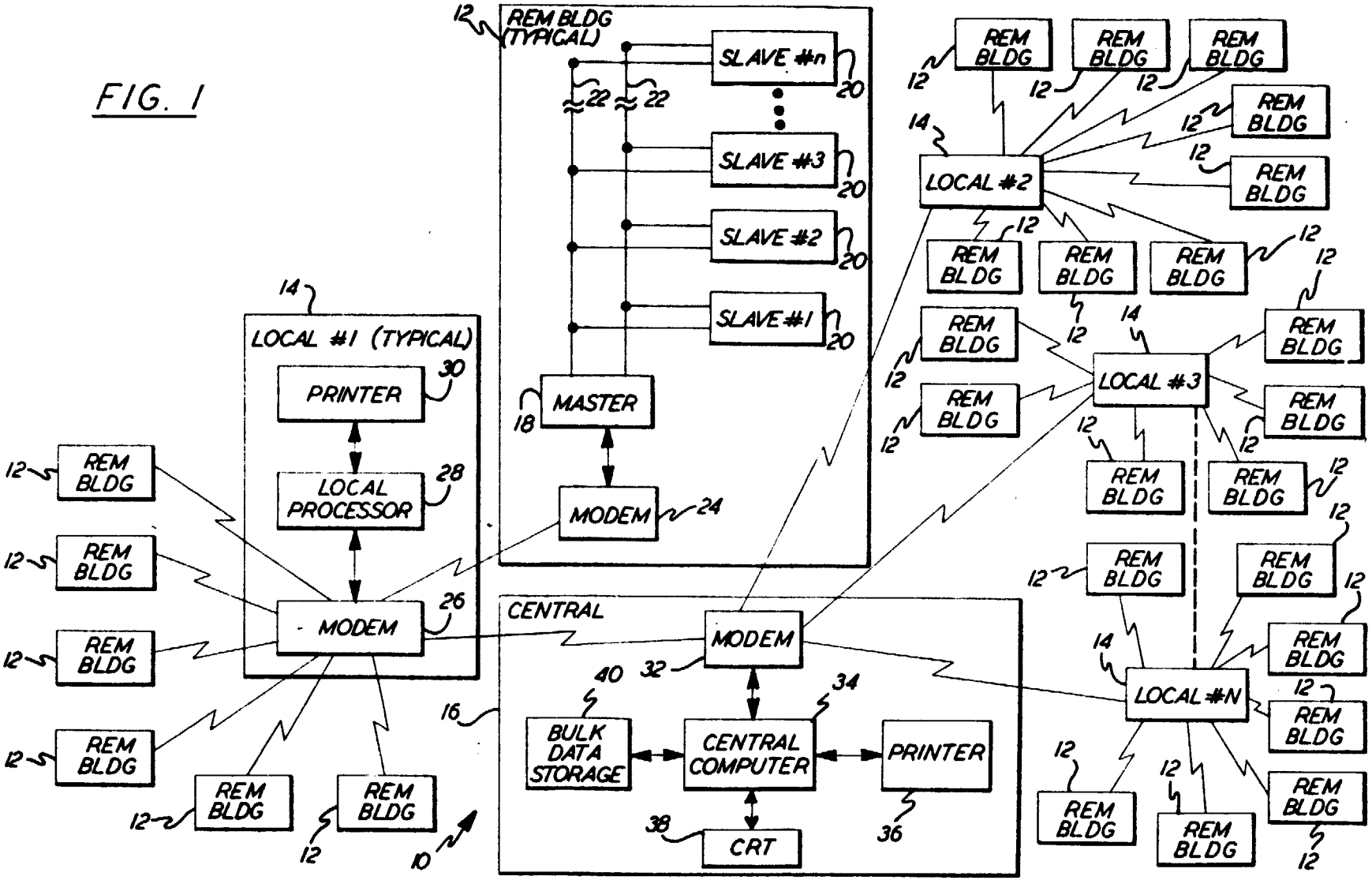
Figure 2:
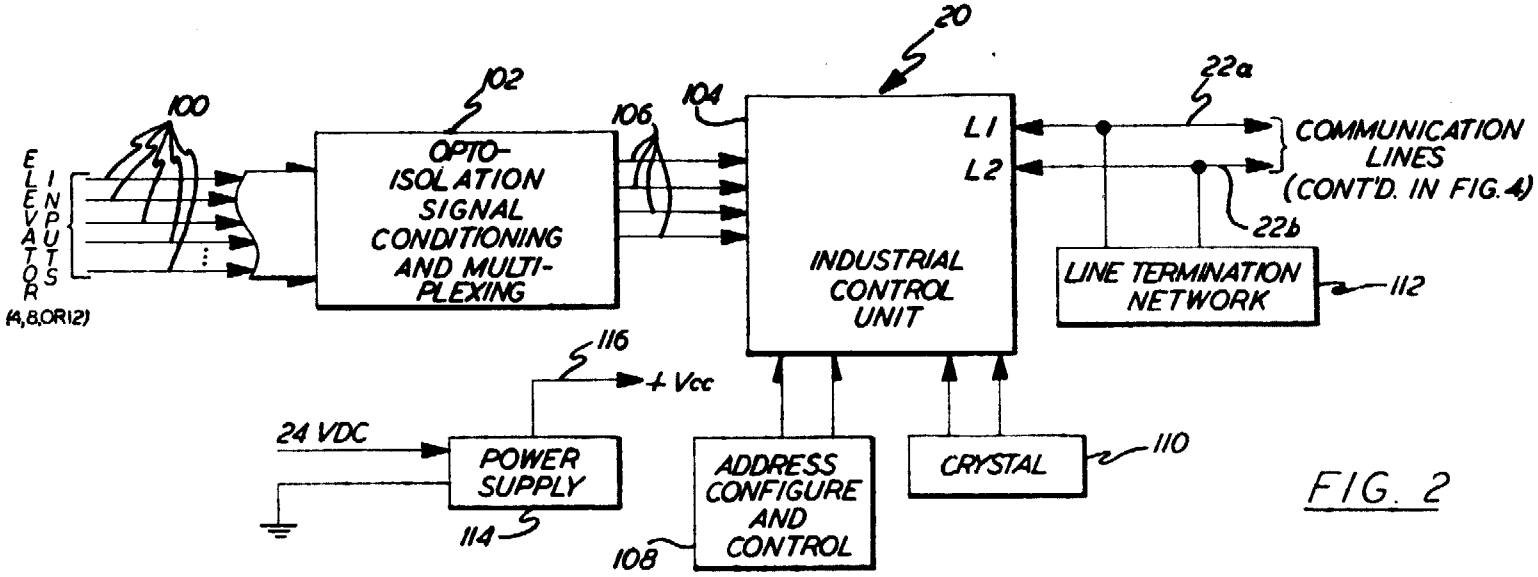
Figure 4:
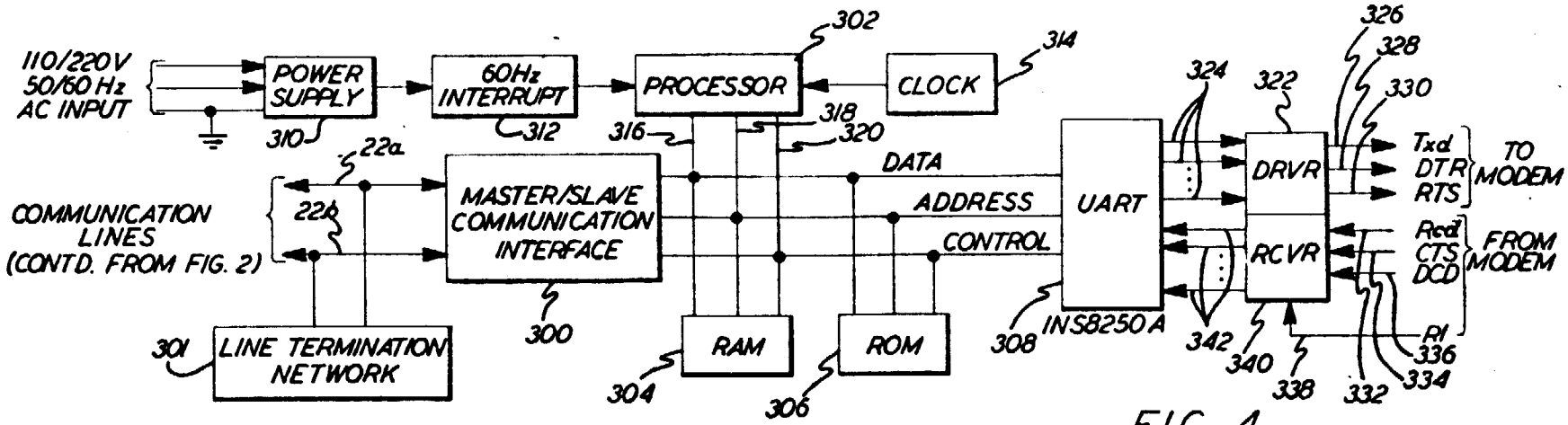
Figure 3:
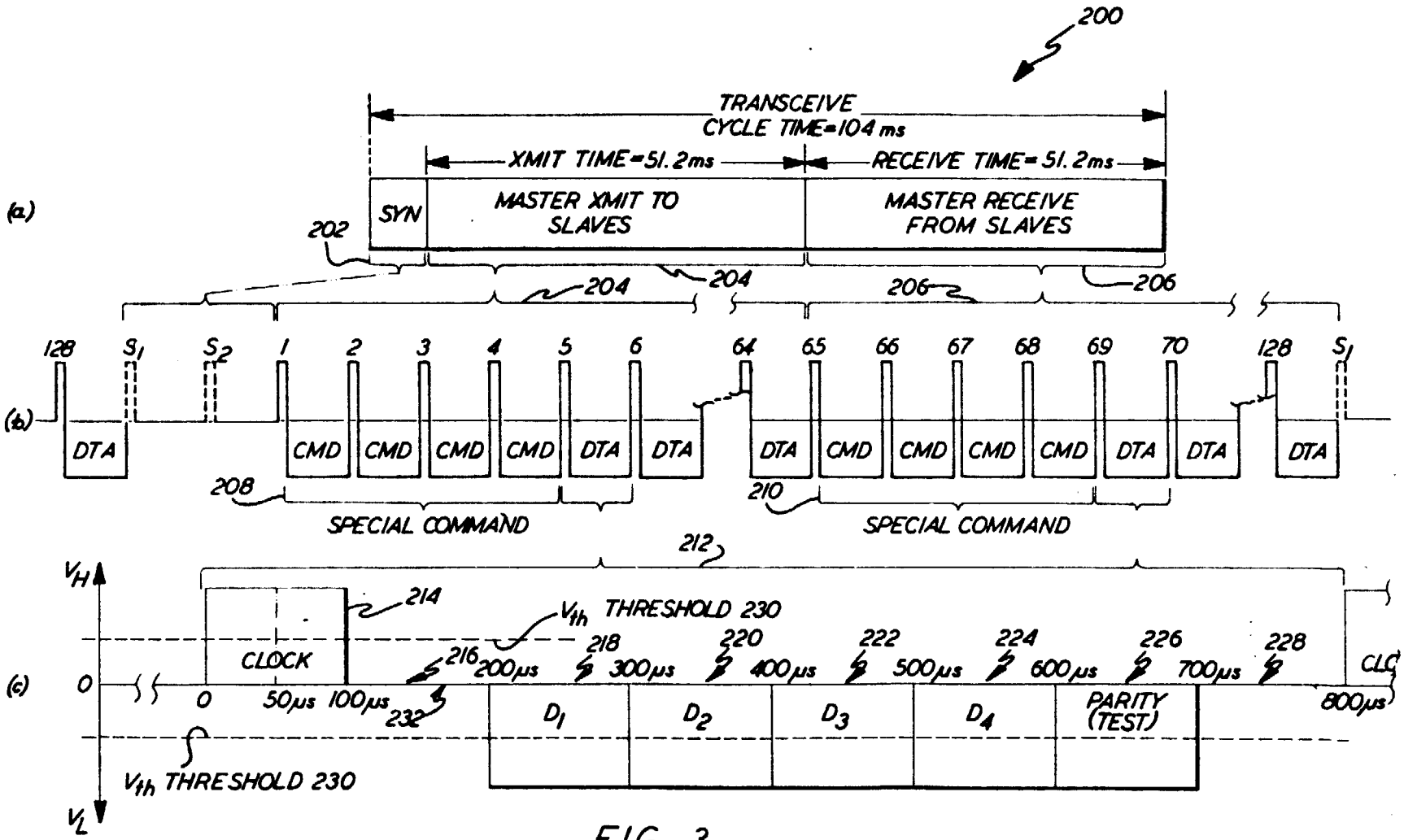
Figures 5, 5A:
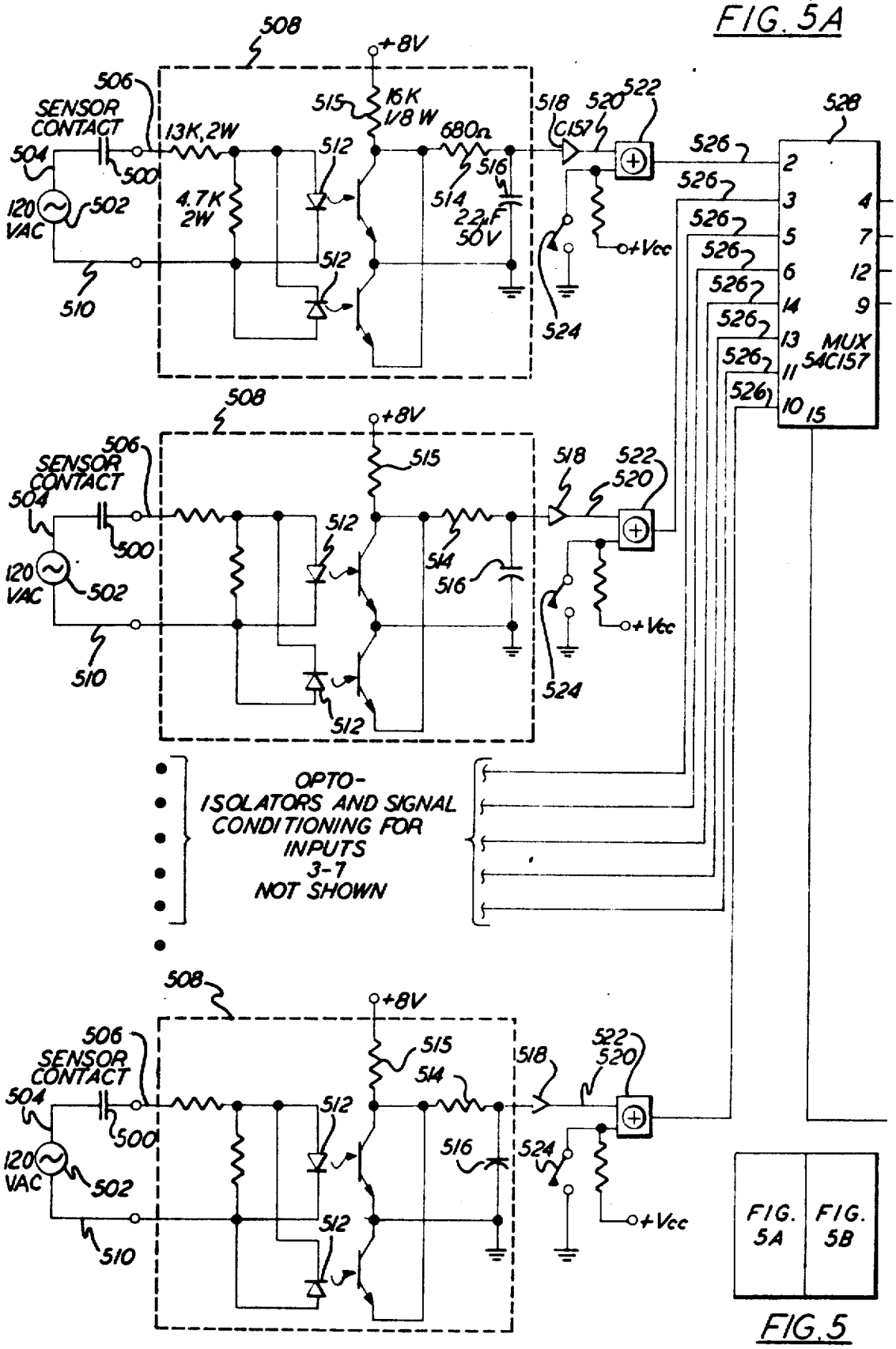
Figure 5B:
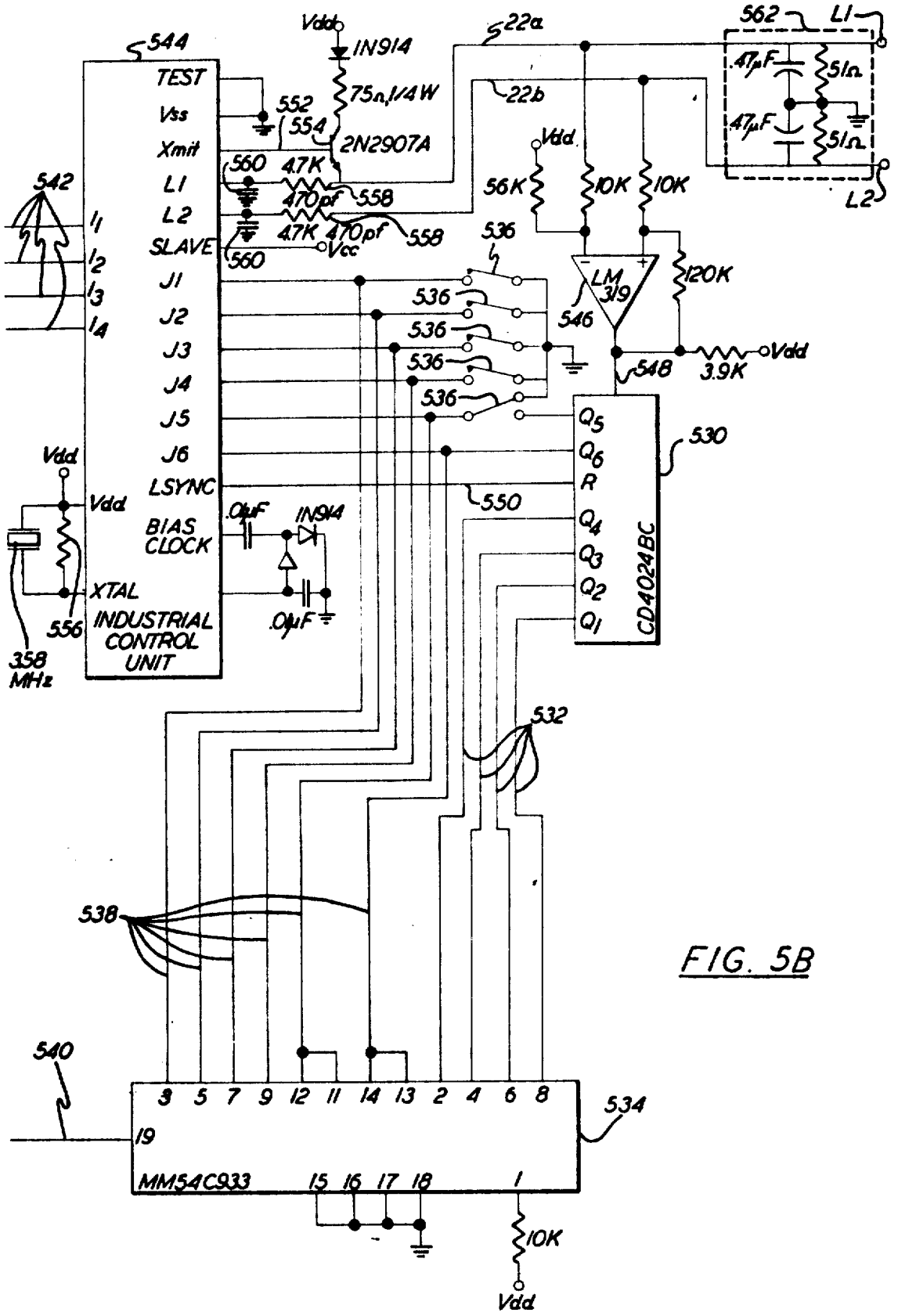
Figure 6:
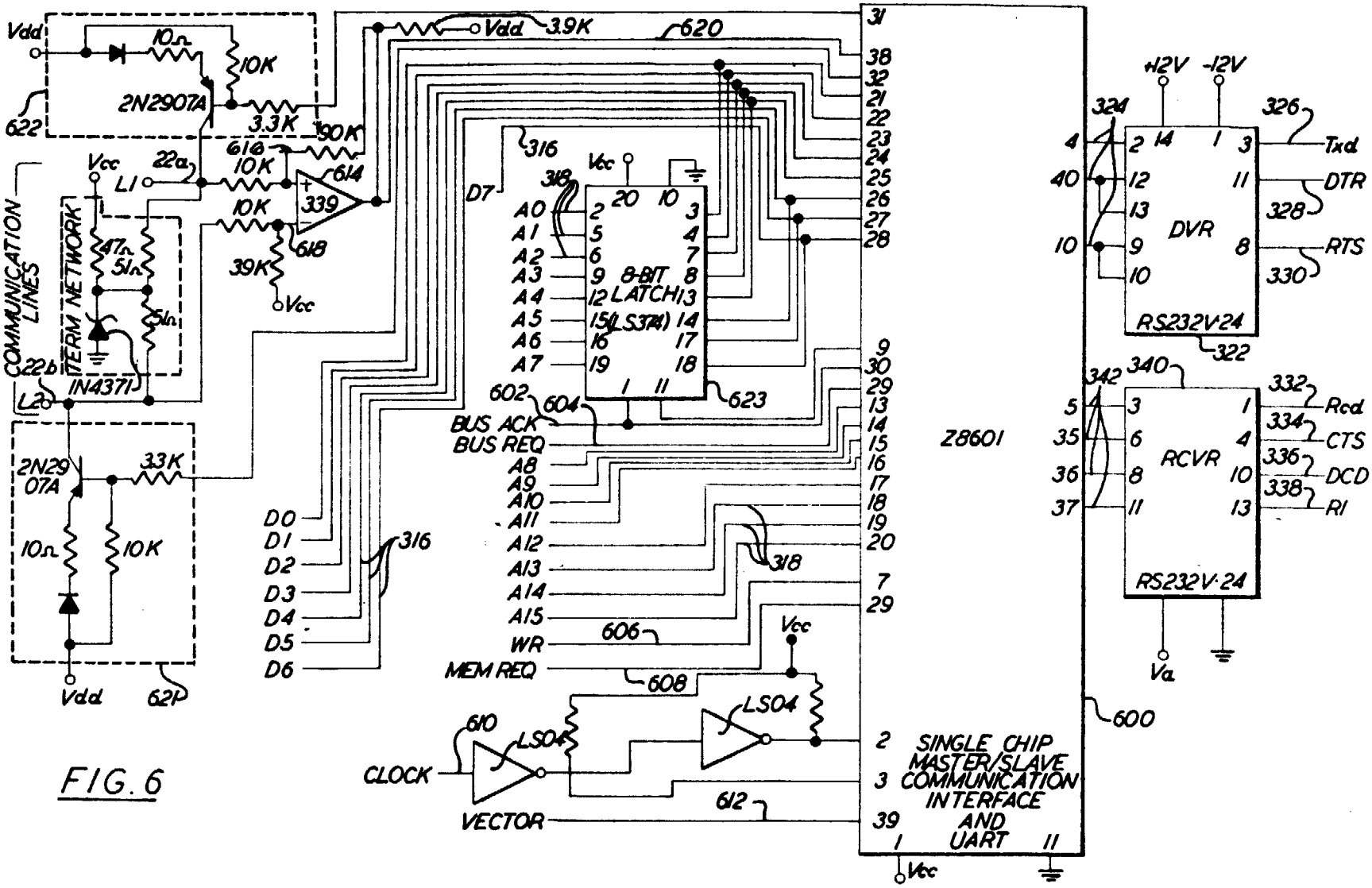
Figures 7, 7A, 7B:
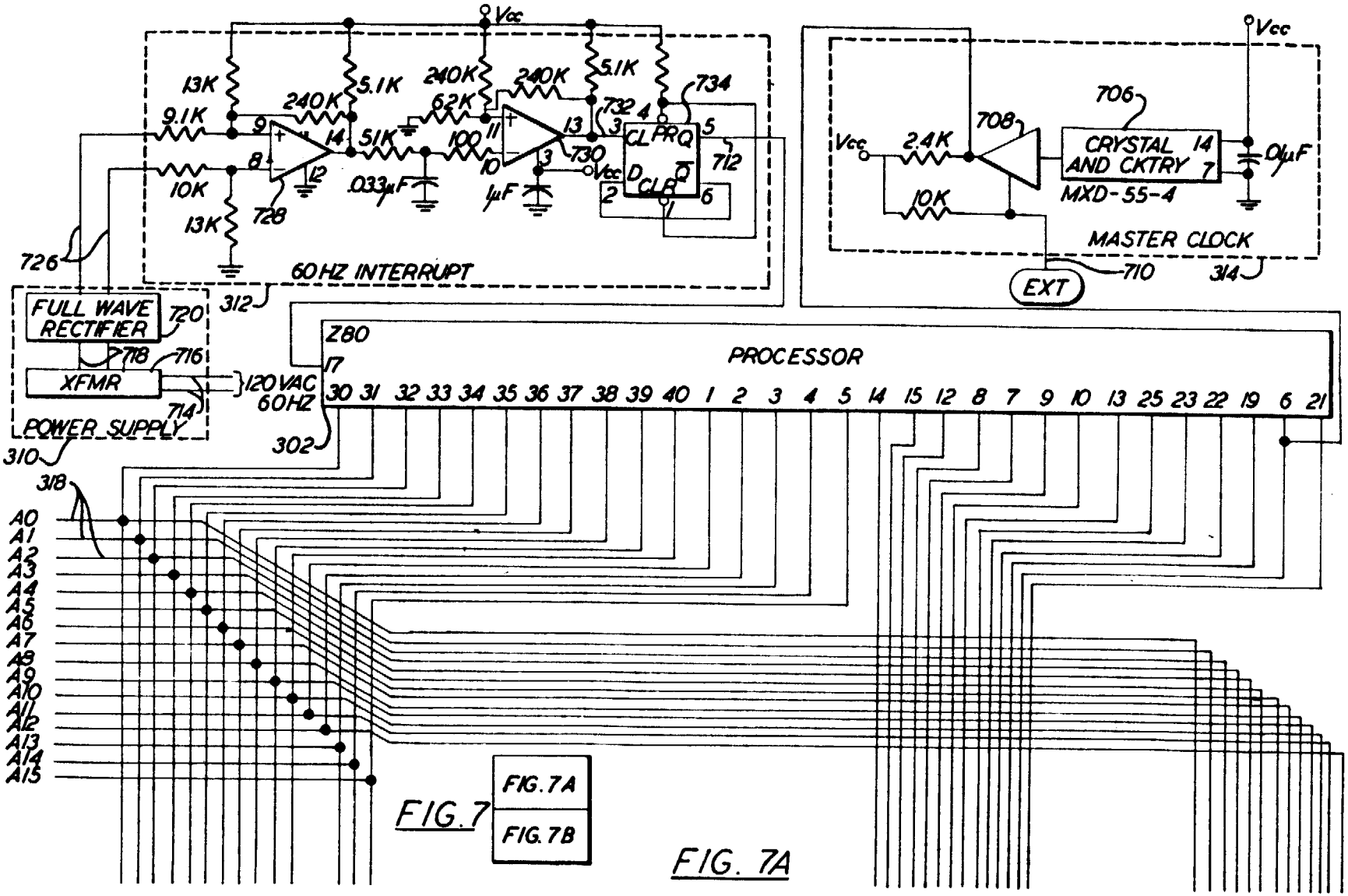
Figure 7B:
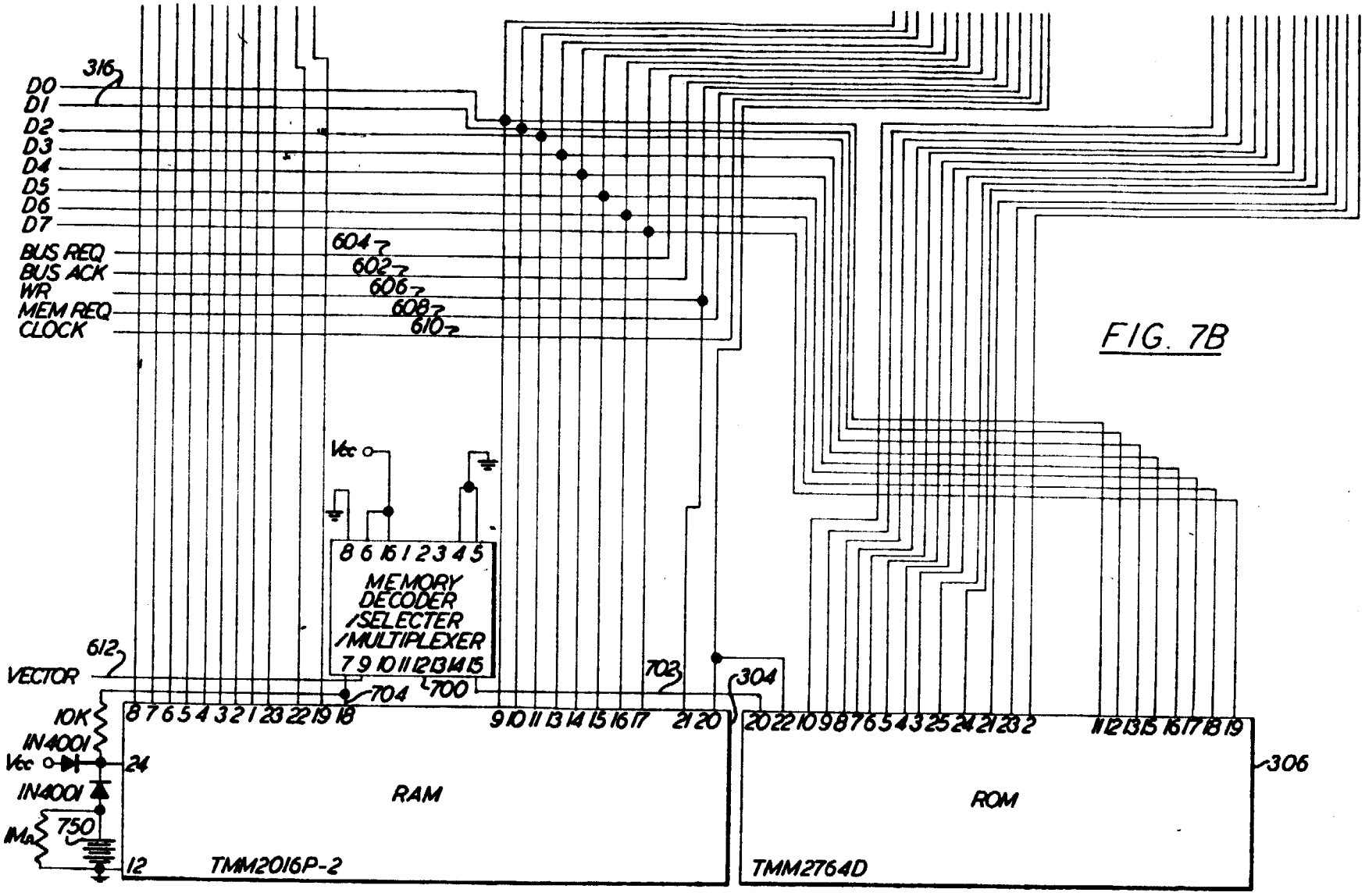
Figure 8:
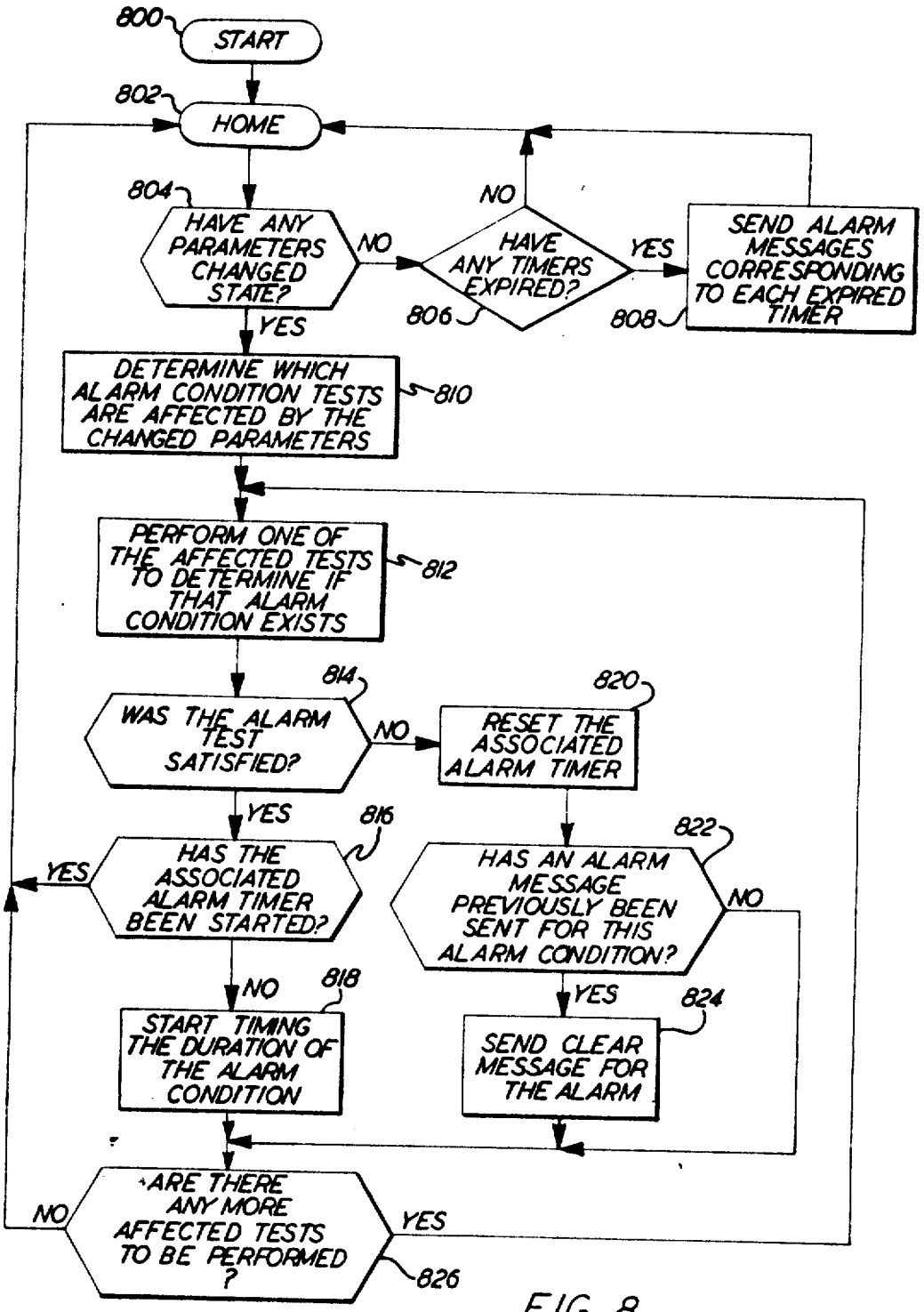
Figure 9:
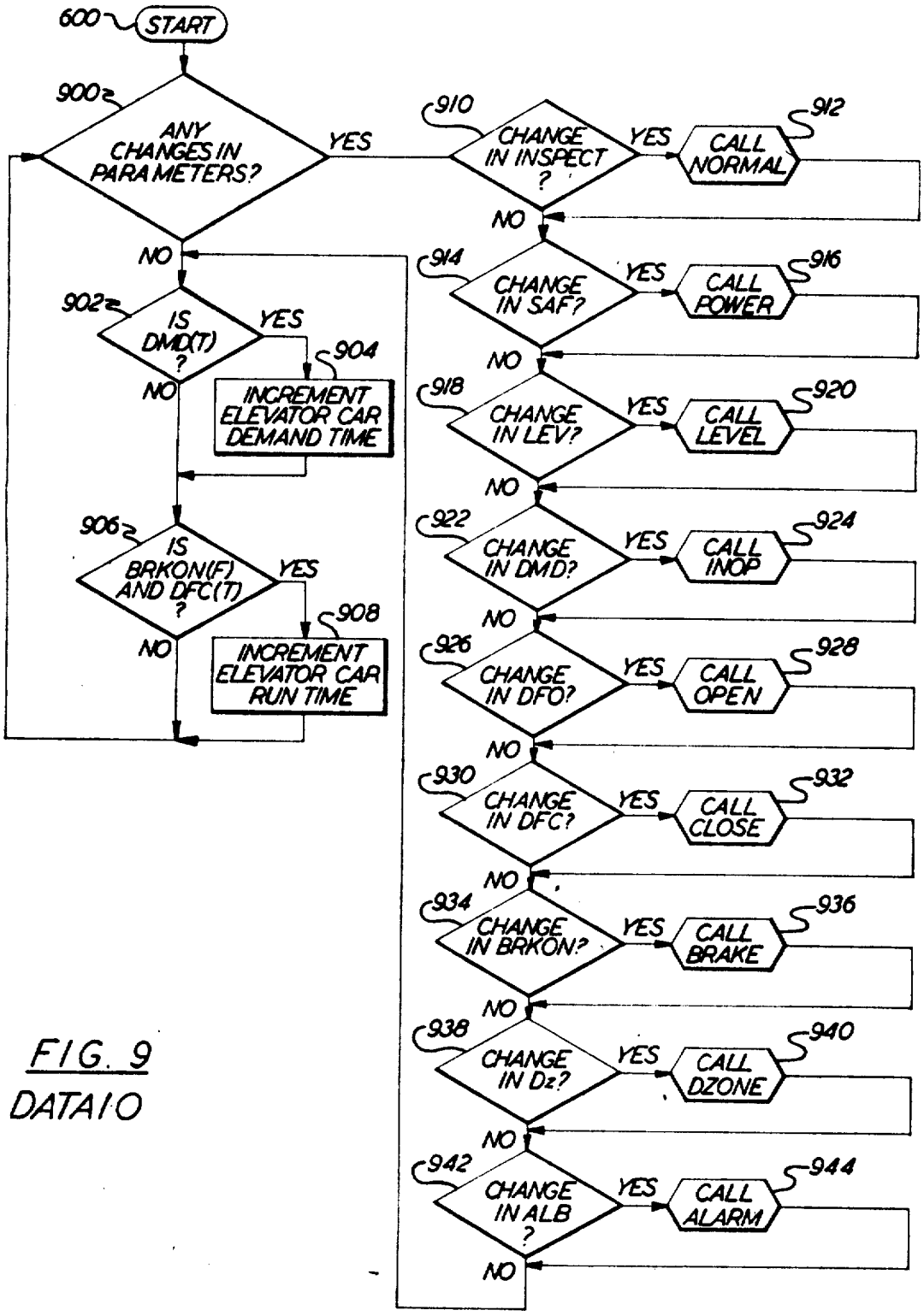
Figures 10, 10A:
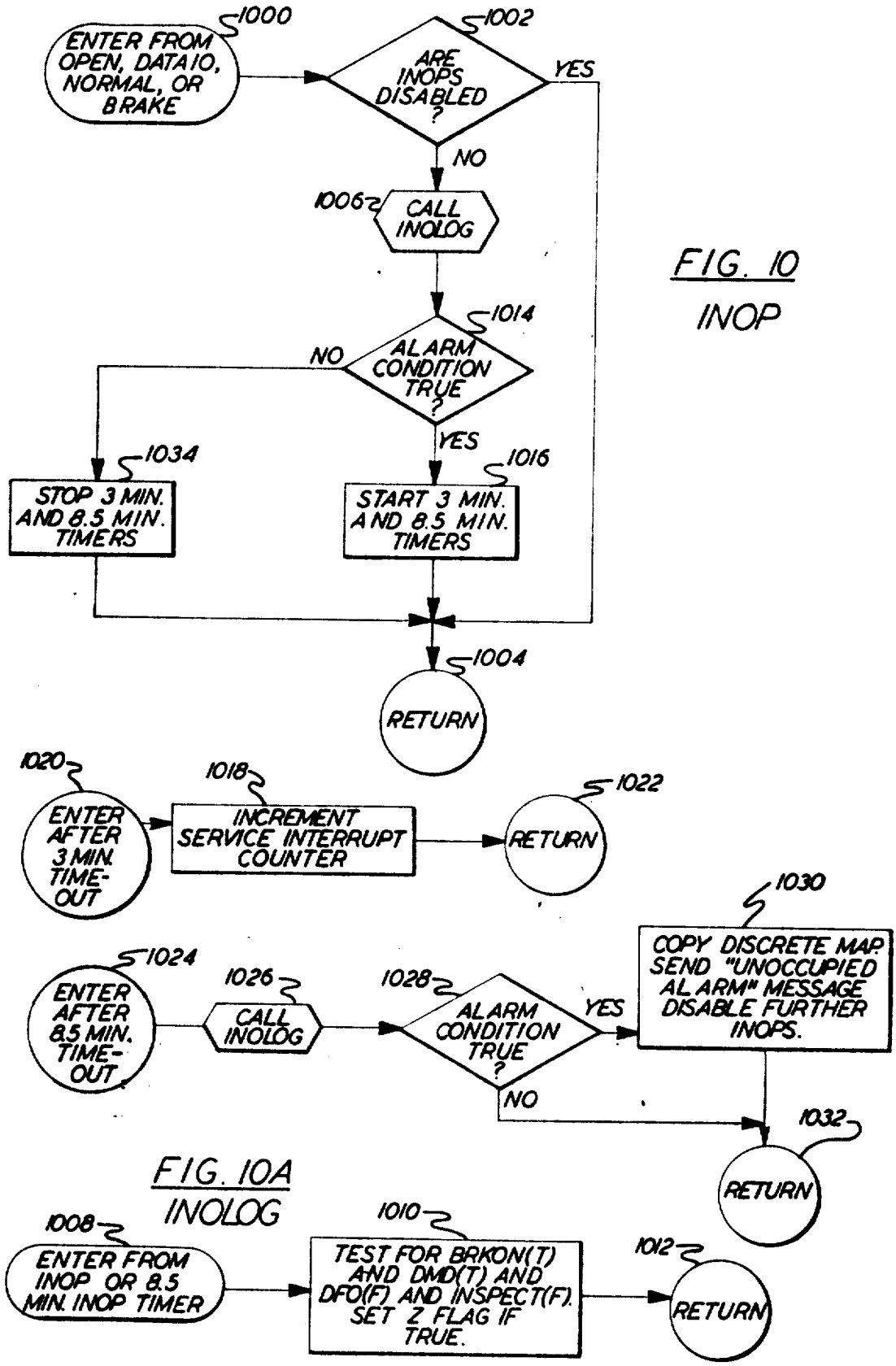
Figure 11:
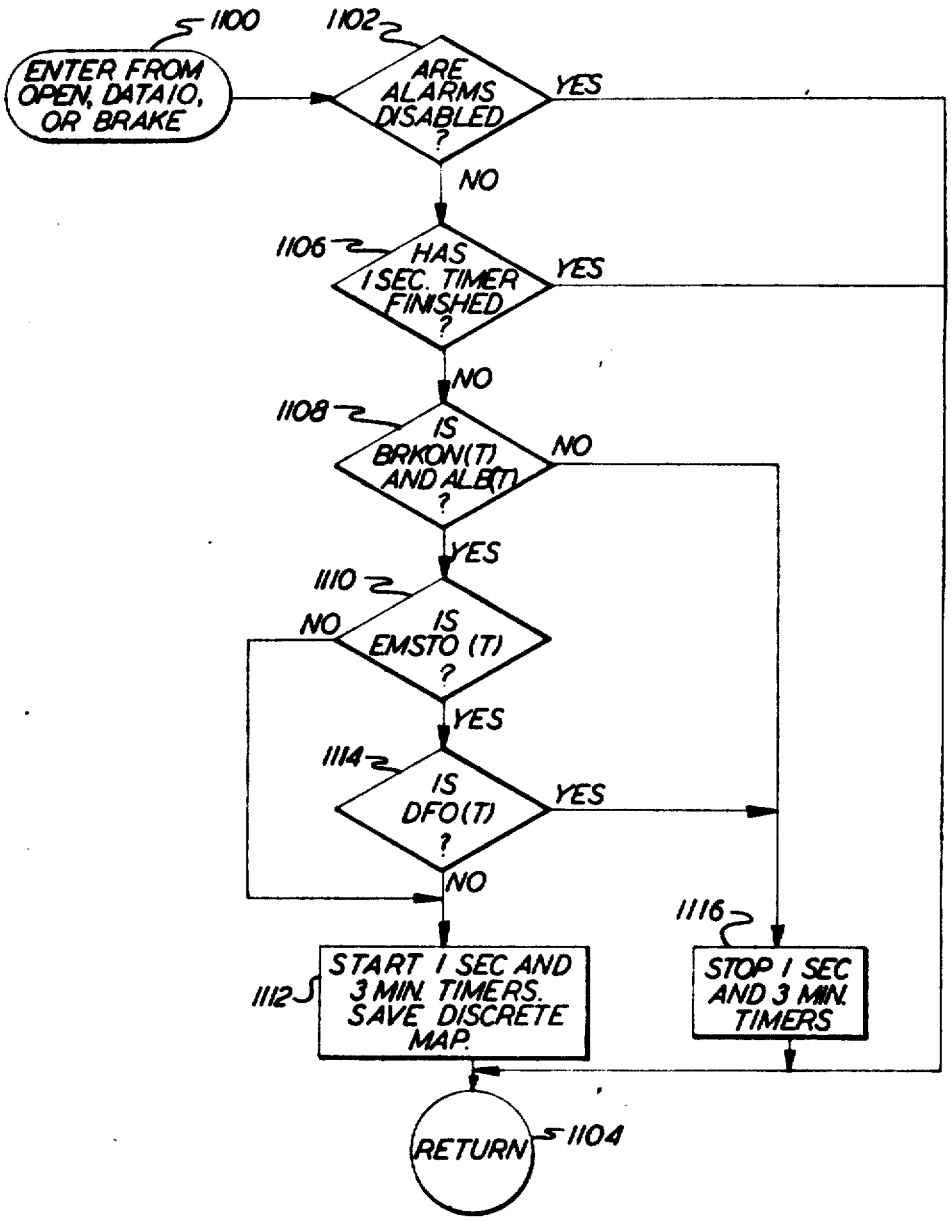
Figure 11:
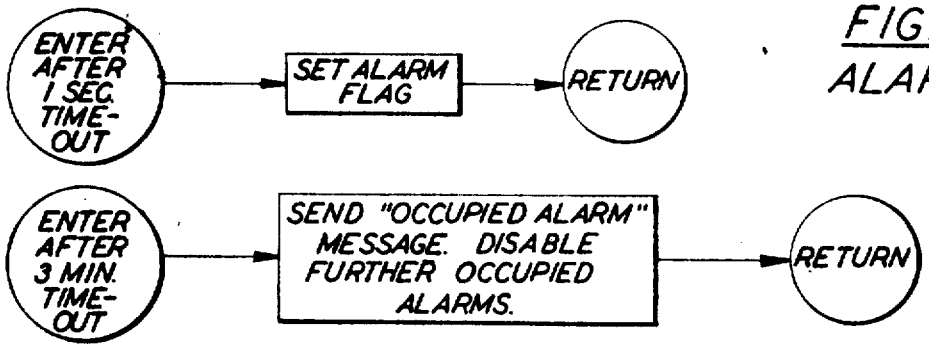
Figure 12:
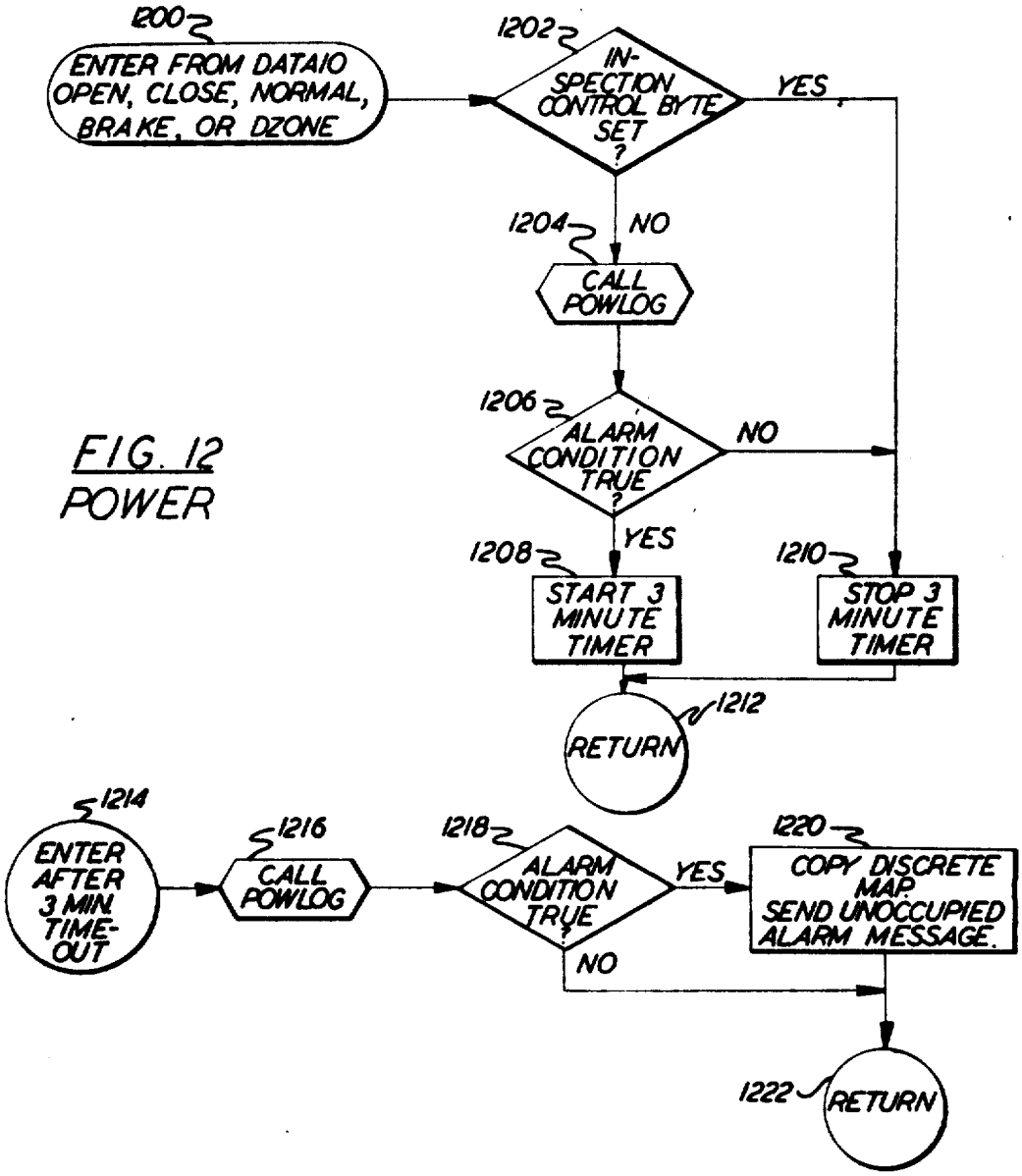
Figure 13:
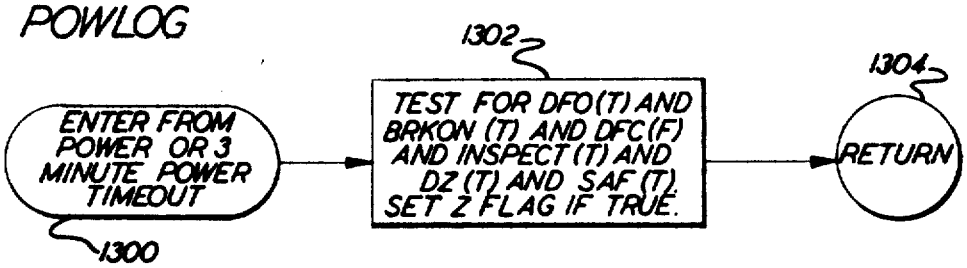
Figure 14:
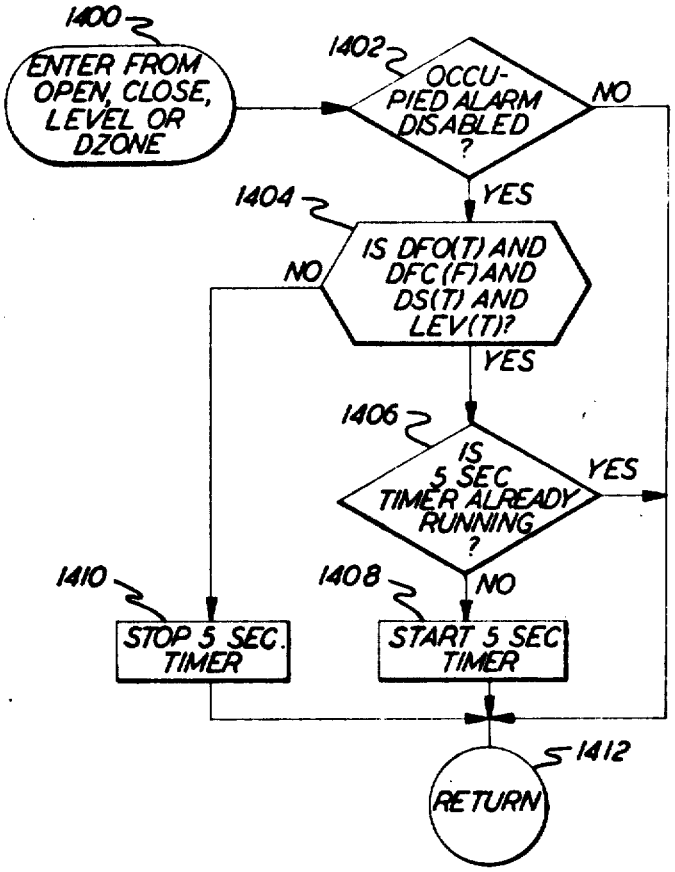
Figure 15:
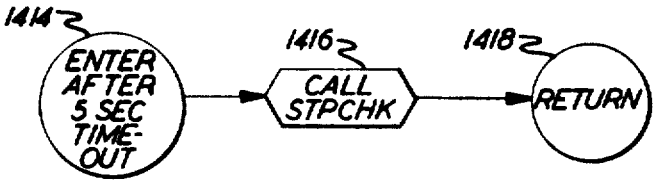
Figure 15:
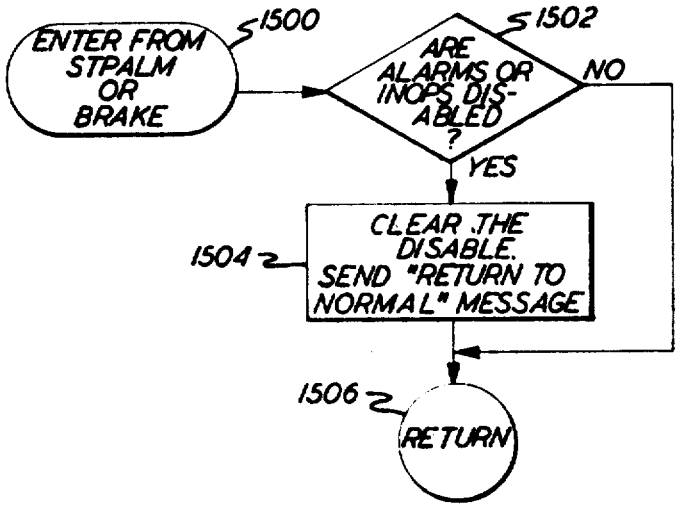
Figure 16:
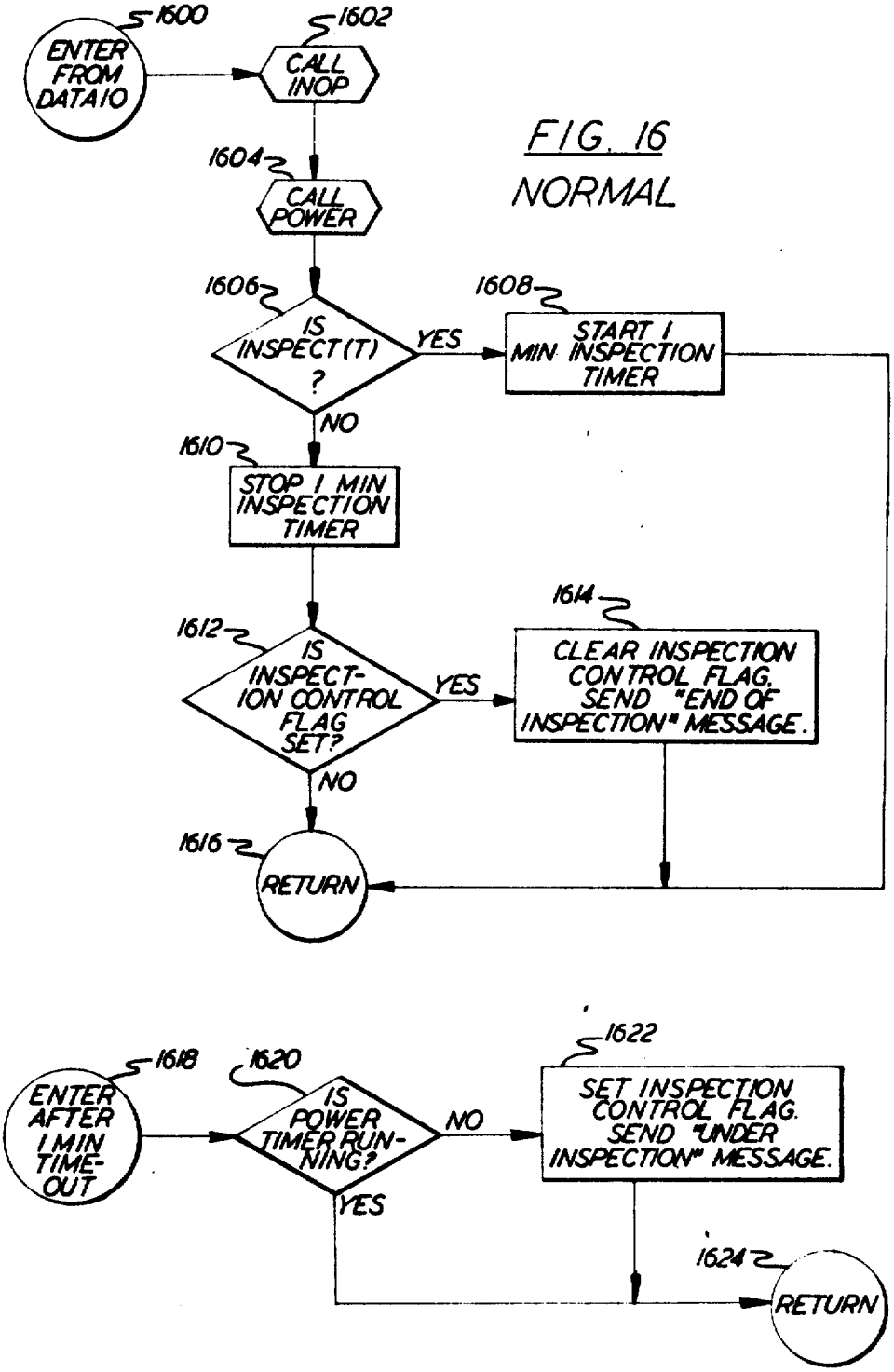
Figure 17:
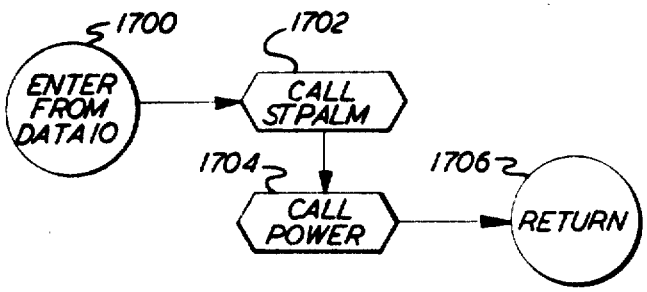
Figure 18:
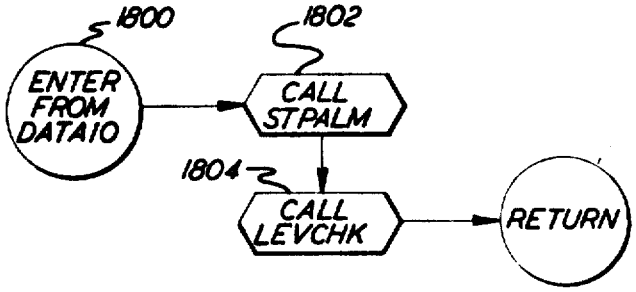
Figure 19:
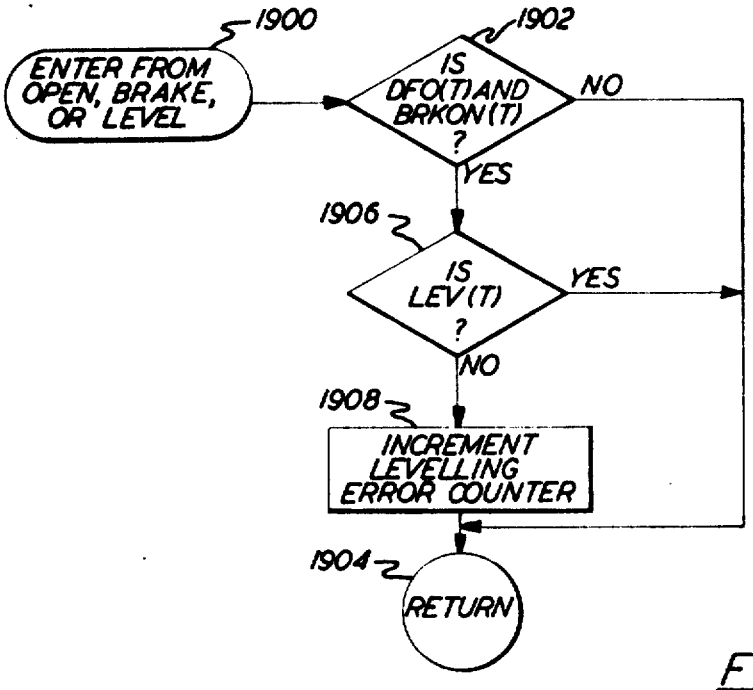
Figure 20:
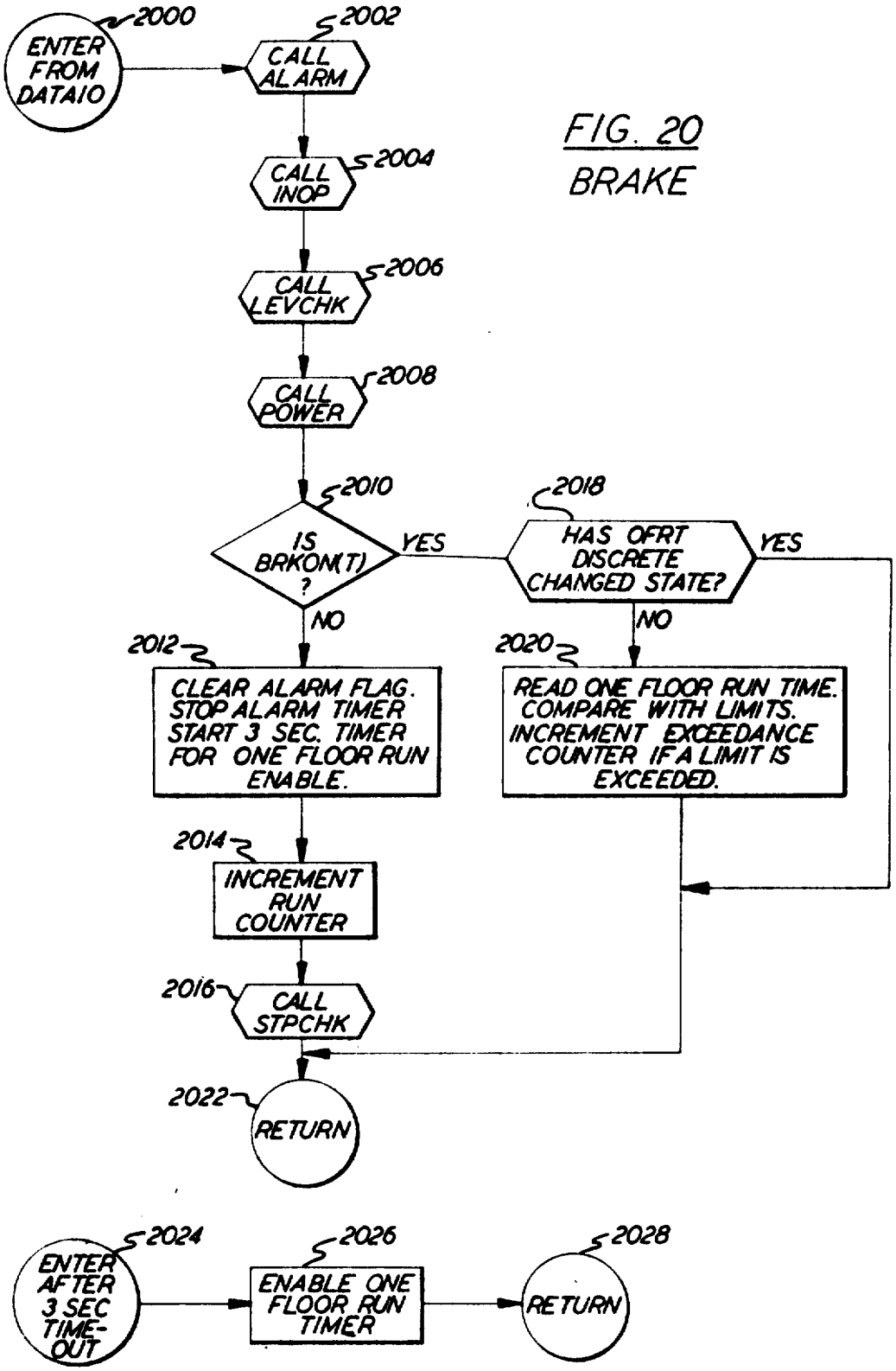
Figure 21:
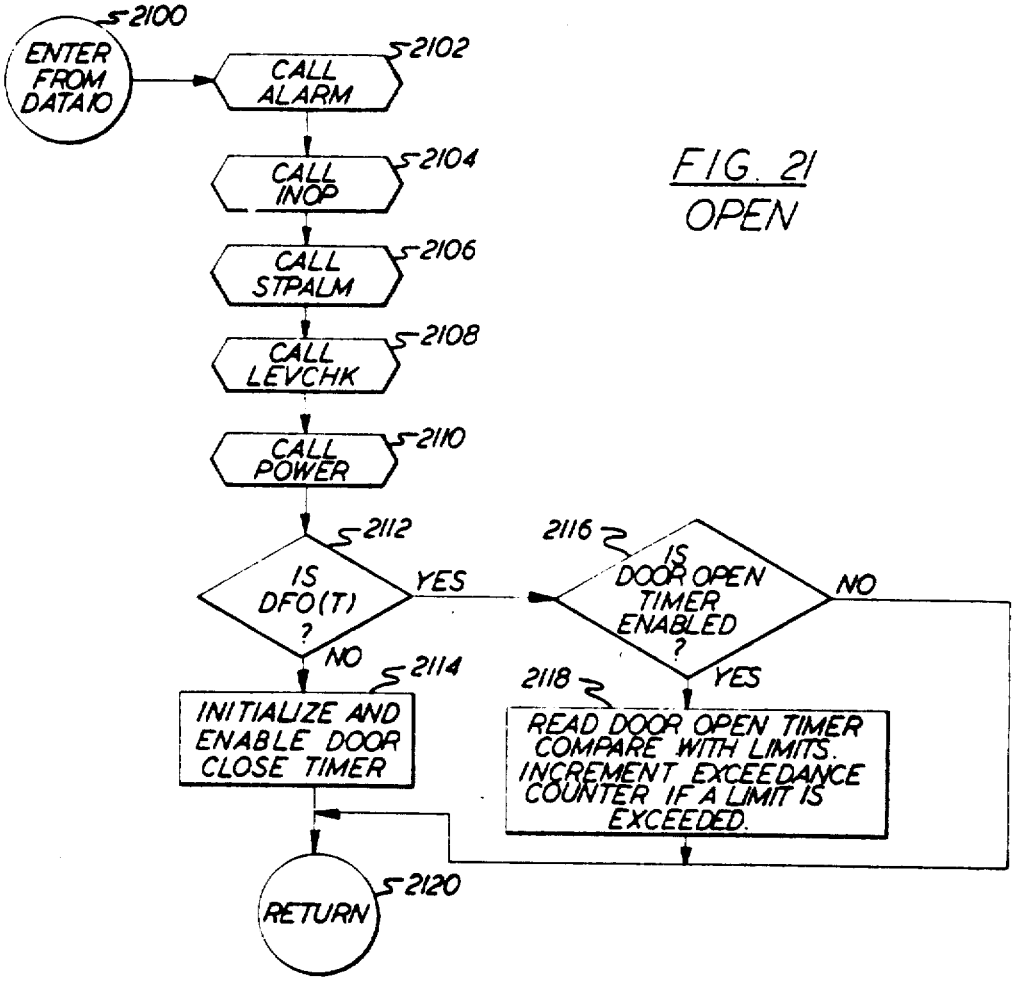
Figure 22:
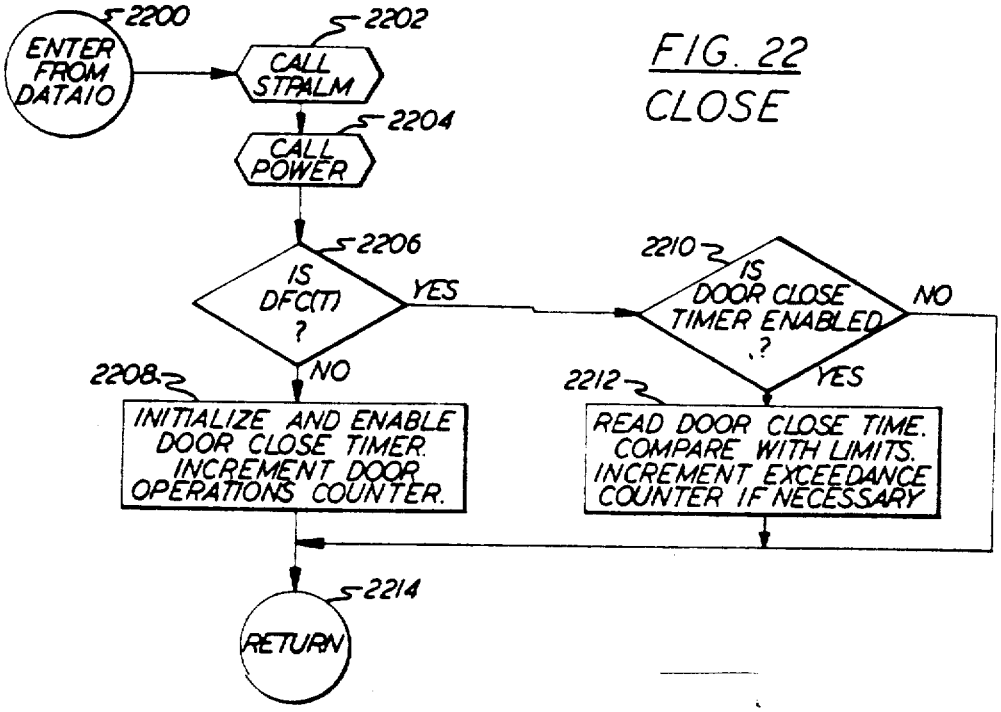

FIG. 10*a* is a simplified flowchart diagram of the INOLOG subroutine executed by the master processor in determining whether the logical conditions necessary for satisfying the unoccupied alarm condition are present;

FIG. 11 is a simplified flowchart diagram of the ALARM subroutine executed by the master processor in determining whether an occupied alarm condition is present;

FIG. 12 is a simplified flowchart diagram of the POWER subroutine executed by the signal processor in determining the presence of an unoccupied alarm condition;

FIG. 13 is a simplified flowchart diagram of the POWLOG subroutine illustrating the logical steps executed in determining the presence of an unoccupied alarm condition;

FIG. 14 is a simplified flowchart diagram of the STPALM subroutine executed by the master processor in determining whether a previously sent alarm message should be cancelled due to the absence of an alarm condition;

FIG. 15 is a simplified flowchart diagram of the STPCHK subroutine illustrating the steps executed by the master processor in sending a return to normal message;

FIG. 16 is a simplified flowchart diagram of the NORMAL subroutine executed by the master processor in determining whether an inspection action has been taken and in sending appropriate messages;

FIG. 17 is a simplified flowchart diagram of the DZONE subroutine used by the master processor in determining whether an alarm clear message should be sent or if a power loss has occurred;

FIG. 18 is a simplified flowchart diagram of the LEVEL subroutine in which the master processor executes the, STPALM and the LEVCHK subroutines;

FIG. 19 is a simplified flowchart diagram of the LEVCHK subroutine in which the master processor checks the elevator car for leveling after each stop at a floor and increments a level of error counter after the detection of each error;

Fig. 20 is a simplified flowchart diagram illustrating the BRAKE subroutine;

FIG. 21 is a simplified flowchart diagram of the OPEN subroutine;

FIG. 22 is a simplified flowchart diagram of the CLOSE subroutine.

BEST MODE FOR CARRYING OUT THE INVENTIONS

Figure 1:
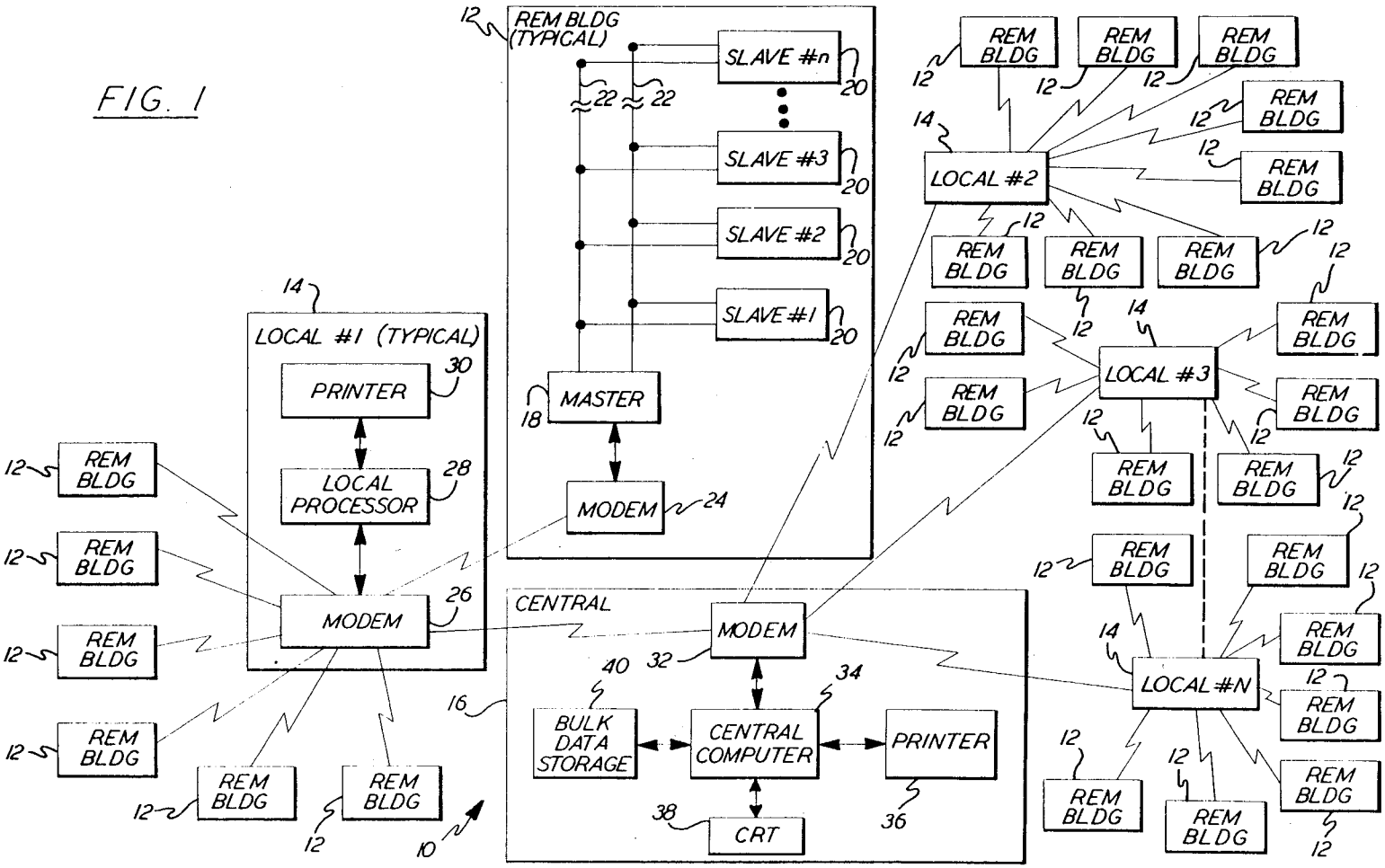
FIG. 1 is a system block diagram of a remote elevator monitoring system according to the present invention.

FIG. 1 illustrates the present remote elevator monitoring system 10 for monitoring individual elevators in remotely located buildings 12, for transmitting alarm and performance information to associated local monitoring centers 14 and for retransmitting the alarm and performance information from the local centers to a central monitoring center 16. The method of communication between the remote buildings and the various local offices and the centralized office is a unidirectional communication system whereby inoperative elevators are identified and individual elevator performance information is transferred to a local monitoring center through the use of local telephone lines. The local then forwards these messages to the central monitoring center also using telephone lines, but in this case, long distance area wide service is used. It should be understood that although the remote elevator monitoring system (REMS) disclosed herein utilizes the public switched phone network available within the local community in which a particular local monitoring center and its associated remote buildings are located, other equivalent forms of communication may be utilized. Each remote building of the REMS system includes a master 18 and one or more slaves 20. The individual slaves are attached to sensors associated with an associated elevator and elevator shaft. The slaves transmit signals indicative of the status of selected parameters via a communications line 22 which consists of an unshielded pair of wires. The use of a two wire communications line between the master 18 and its associated slaves 20 provides both an inexpensive means of data transmission and the ability to inexpensively locate the master at a location remote from the slaves. For instance, if all of the slaves are located in an elevator machinery room having a hostile environment on top of the elevator shafts, the master may inexpensively be located in a more benign environment somewhere else in the building. Each master includes a microprocessor which evaluates the performance data and determines whether an alarm condition exists according to Boolean logic equations which are coded within the software of the microprocessor. Each master communicates with a modem 24 which transmits alarm and performance data to a modem 26 in the associated local monitoring center 14. Although the architecture of the REMS within a remote building has been described as having a master communicating with one or more slaves using an efficient two wire communications line, it should be understood by those skilled in the art that less efficient means of data collection and transmission may also be used. It should also be understood that because the number of slaves capable of being attached to a given communications line is finite, it may be necessary within a given remote building to utilize more than one master-slave group.

Each of the remote buildings 12 communicates with its associated local monitoring center 14 to provide alarm and performance data. The local processor 28 stores the received data internally and alerts local personnel as to the existence of an alarm condition and performance data useful for determining the cause of the alarm. The local processor 28 alerts local personnel of these conditions via a printer 30. It should be understood that other means of communicating with local personnel, such as a CRT may as easily be used. The local processor 28 also causes alarm and performance data from the local's remote buildings to be transmitted to a modem 32 within the central monitoring center 16. A central computer 34 receives data from the modem 32 and provides alarm and performance data to central personnel via a printer 36 and a CRT 38. It should be understood that although both a printer and a CRT are shown for use with the invention, the use of only one of them would be sufficient to fully communicate with the central personnel. A bulk data storage unit 40 is used to store alarm and performance data for long term evaluation by central personnel. Although bulk data storage is a desirable feature of the present invention, it should be understood that bulk data storage for the purpose of long term performance evaluation is not absolutely essential for the practice of the present invention. The REMS described above in connection with the illustration of FIG. 1 is designed to permit a local office to monitor elevators located within its geographical area so that upon the detection of an abnormal condition a serviceman may be immediately dispatched for quick resolution of the problem. In this way, the quality of services performed for the elevator customer is greatly improved. In many cases, a deteriorating condition may be detected before it causes an elevator disablement. In cases where a disablement has occurred, the nature of the problem can often be identified before dispatching the serviceman so that the nature of the corrective action required may be determined in advance. Central office personnel are also kept informed as to performance, operating problems, and disablements in all elevators in the field. This provides an extremely valuable management tool to the headquarters operation. Personnel at the central monitoring center 16 are enabled to closely monitor the performance of essentially all of the elevators in the field. Performance trends can thereby be detected and accurate forecasts devised for use in business planning. The instantaneous nature of the knowledge provided as to the effectiveness of the service force in remedying field problems is also an invaluable aid to management in identifying and correcting local service offices having unsatisfactory service records.

Figure 2:
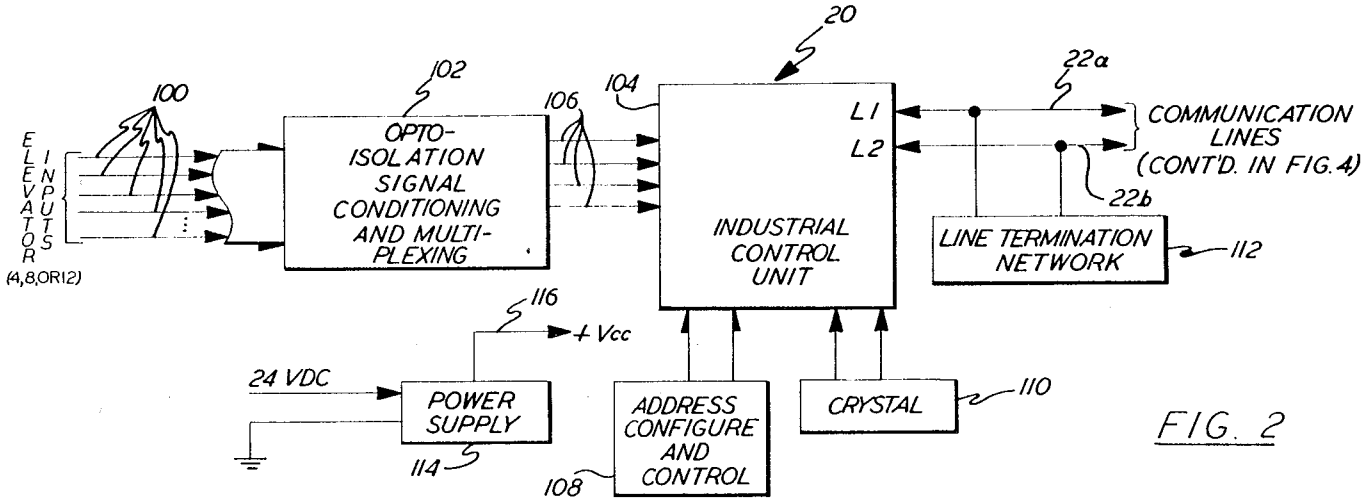
FIG. 2 is a simplified schematic block diagram of a slave unit used in the system of FIG. 1.

In FIG. 2, a block diagram of a slave unit 20 is shown. Elevator sensors (not shown) provide inputs on lines 100 to an opto-isolation, signal conditioning, and multiplexing unit 102 which isolates the input signals from the electronics contained within an industrial control unit 104, scales the input voltages, permits the setting of the relation between voltage presence or absence and the true or false condition, and multiplexes the multiple input lines 100 down to a smaller number of lines 106. The slave unit disclosed herein is capable of accepting 4, 8, or 12 elevator sensor inputs based on the structure of the communications protocol to be described in detail hereinafter. It should be understood, however, that the number of elevator inputs is not necessarily restricted to 4, 8 or 12. A different communications protocol could be used which might allow only a lesser number of inputs or which might permit a larger number, or which might utilize an intermediate number of inputs. The industrial control unit 104 scans the inputs on the lines 106 and sends the scanned information down a communications line **22*a* at the proper time. A unique address for a particular industrial control unit associated with a particular slave unit is configured by means of control jumpers, symbolized by an address configure and control block 108. The industrial control unit provides data on the line 22*a* when its unique address is identified in a timed sequence of addresses, each address corresponding to a unique slave. The industrial control unit (ICU) utilizes a crystal 110 for generating a 3.58 megahertz signal which is used internally by the ICU as a system clock. An externally generated communication clock signal is provided on a line 22*b*. A line termination network 112 is connected to the communications lines 22*a*, 22*b* close to the ICU in order to provide filtering for error free communication in a high noise environment. A power supply 114 receives unregulated 24 volts DC and provides a regulated output on a line 116 for the slave unit. The above description of the block diagram of a slave unit 20 illustrated in FIG. 2** will be described in more detail hereinafter.

Figure 3:
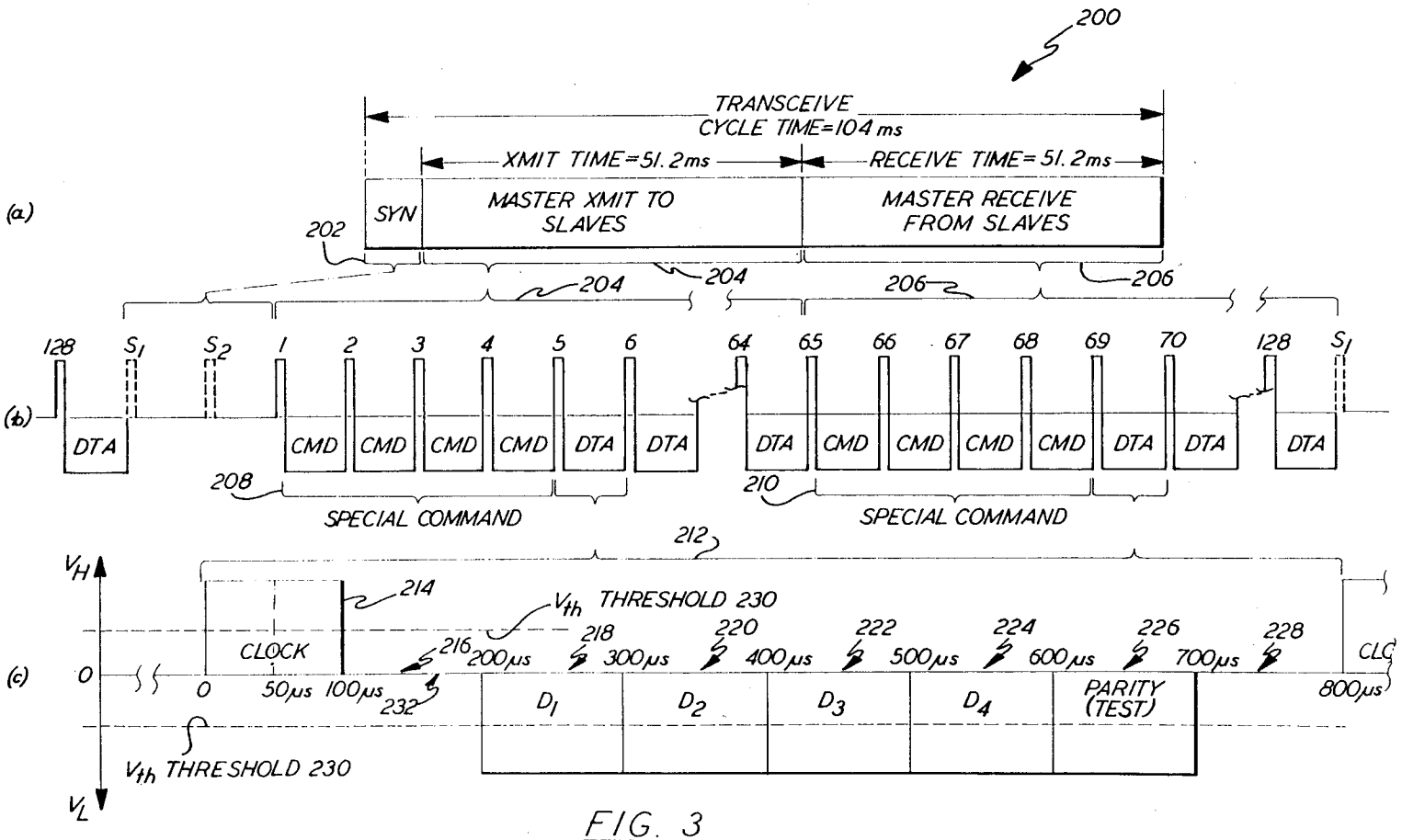
FIG. 3 is an illustration of signal waveforms used in the description of the embodiment of FIG. 1.

The communications system protocol is synchronous, half duplex, serial line format by which the master of a local monitoring center can communicate bidirectionally with as many as 60 slave units. The serial line protocol is illustrated in FIG. 3, illustrations (a)–(c). The master is capable of transmitting data to and receiving data from each of the remote slaves in successive transcieve cycles 200 (illustration (a)). Each cycle includes a sync frame 202 followed by 128 information frames divided equally between a transmit interval 204 (master transmits to slaves) and a receive interval 206 (master receives from slaves). Each information frame is marked by a line clock pulse transmitted by the master at the communication clock frequency. The sync frame 202 provides master-to-slave synchronization once per cycle. It includes two missing line clock intervals which, when added to the 128 information frame clock pulses, requires 130 equally spaced line clock intervals for each transceive cycle.

To provide the highest noise rejection the system frequency and baud rate is selected at the lowest frequency required to satisfy the particular control application, the band width being limited to compensate for the unshielded transmission line. The selected transceive cycle time is 104 milliseconds (ms) in the best mode embodiment to provide an approximate 9.6 hertz transcieve frequency (i.e. sample time frequency). For the total 130 clock pulses and a selected 104 ms cycle time the line clock frequency is 1,250 hertz (i.e., the clock period is 800 microseconds). Illustration (b) shows the 130 clock pulses as including two sync frame clock pulses ($S_1$, $S_2$) and 128 information frame clocks divided equally between the transmit frame 204 (clock pulses 1–64) and receive frame 206 (clock pulses 65–128). The sync frame clock pulses are actually missing. The sync frame itself is defined as the "dead time" interval (which includes the missing clock pulses $S_1$, $S_2$) between the 128th clock pulse of a preceding cycle and the first pulse of a present cycle. For the 104 ms cycle time the dead time is 2300 microseconds.

The 64 information frames in the transmit and receive intervals service up to a maximum of 60 slaves. The first group of four information frames in each interval 208, 210 (clock pulses 1–4 and 65–68) are reserved for special command information to all masters and slaves, such as diagnostic/maintenance testing, or control of any optional features which may be incorporated in any associated remote control devices (not used in the REMS); the remaining 60 information frames are data frames. The master is typical of transmitting information to each slave in a related transmit interval data frame and is capable of receiving data from each slave in a corresponding receive interval data frame. However, the REMS does not utilize the full capabilities of the communications system protocol in that no data is transmitted from the masters to their associated slaves in the first half of each transceive, i.e. the transmit interval 204 is not utilized in REMS. However, all slaves receive and store the commands of frames 1–4 and 65–68 as internal commands related to their operation. These commands may include turn on and turn off of the slaves (all or a selected number), or may command the slaves to send specific data patterns in a diagnostic mode to allow integrity check by the central control.

Each slave has an assigned clock address. The line clock pulses are counted and decoded by the slaves following each sync frame to determine the presence of an assigned count address at which time the slave writes a data frame from or to the communication line 22*a*. The format for the information frames, both special command frames 208, 210 and data frames, are identical, as shown by information frame 212 in illustration (c). The frame time interval is divided into eight 100 microsecond states. The first state (0–100 microseconds) corresponds to the clock pulse interval 214 and must be a minimum of 50 microseconds wide to be valid. The second state 216 (100–200 microseconds) is a "dead time" interval which allows for response time tolerances and sample time delays between the frame clock pulse and the data bits. The next five states 218, 200, 222, 224, 226 (200–700 microseconds) are five signal bit time intervals, the first four of which (218, 220, 222, 224 correspond to the four data bits $D_1$–$D_4$). The bit time is equal to the state time, or 100 microseconds for the selected 104 ms transceive cycle time. The fifth bit is a special feature bit which may be received and transmitted by each of the slaves. This fifth bit is used for special feature information which may include test routines i.e., parity tests. In the best mode embodiment the fifth bit is used to convey the special information in 36 of the available 64 information frames in each transmit and receive interval; specifically in information frames 5–40. The last state 228 is also a dead time interval prior to the beginning of the succeeding data frame.

As shown in FIG. 3 the signal data format is tristate, i.e. bipolar. The transmission line provides a differential, three state signal transmission in which the signal, as measured between the transmission line wires 22*a*, 22*b*, is in one of three states. The line 22*b* is the clock line input to the master and slaves; the line 22*a* is the data line input. The three differential states are measured with respect to the difference potential between lines 22*a* and 22*b*. When the signal magnitude on the line 22*b* is greater than the sum of the signal magnitude on the line 22*a* plus a threshold voltage ($V_{th}$) 230 then the differential state is equal to a line clock pulse (214, illustration (c)). When the signal magnitude on the line 22*a* is greater than the sum of the line 22*b* magnitude plus the selected threshold voltage the differential state input is recognized as a logic one in signal bit times 218, 220, 222, 224, 226. If the line 22*a*–22*b* differential magnitude is less than the threshold value the the differential state is recognized as a signal bit logic zero 232.

The approximate data rate for the selected 104 ms cycle time is 10 KBAUD for the first four data bits ($D_1$–$D_4$) and special fifth (test) bit of each information frame. It should be understood, however, that the present system is not limited to either the illustrated baud rate or bit number. In the present REMS higher data rates and/or more information bits may be traded off against maximum line length and noise immunity requirements. It should also be understood that the communications system protocol utilized is not the only protocol that could have been used to format the data. For example, alternate protocols and voltage levels of RS-232C, RS-423, or RS-422 could be used. In addition, information could be coded by pulse width modulation techniques as opposed to the tri-state voltage levels described hereinbefore.

Figure 4:
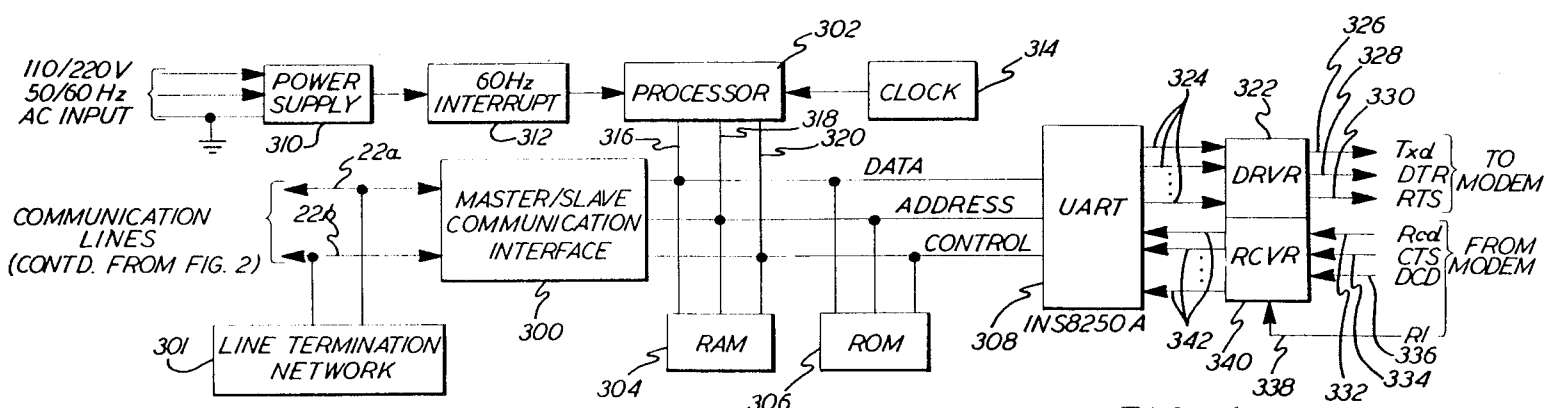
FIG. 4 is a simplified schematic block diagram of a master used in the embodiment of FIG. 1.

FIG. 4 is a master block diagram having a master/slave communication interface 300 for receiving input information on the status of the elevators from each slave at a regular interval of 104 milliseconds. The information is transmitted on a communication line 22*a* which is part of the communication lines 22*a*, 22*b* continued from FIG. 2. The lines 22*a*, 22*b* are terminated with a line termination network 301 having a purpose similar to the network 112 of FIG. 2. The information is processed by a signal processor 302 to determine if an alarm condition is present and to record and maintain additional performance data collected daily on the elevators being monitored. Alarm condition criteria and acceptable limits for the daily performance data are defined according to Boolean logic equations coded within the software of the signal processor. Associated with the signal processor 302 is a random access memory (RAM) 304, a read only memory (ROM) 306, and a universal asynchronous receiver transmitter (UART) 308 which is used to communicate with and control the modem 24 of FIG. 1. In addition, circuitry is contained within the master to provide the necessary real time clock interrupts associated with counting and measuring of unit intervals of time for the purpose of determining alarm conditions and maintaining the correct time of day. The power supply 310 to the master can be 110 V or 120 V, 50 or 60 hertz. The outputs of the power supply are a regulated five volt supply and a plus or minus 12 volt supply to provide all of the power for the logic which is contained within the master and also an unregulated 24 volt supply which is sent to all of the slaves associated with the particular master. From the power supply an analog circuit derives 50 or 60 hertz interrupts. This circuitry takes a full wave AC sign wave from the power line and detects the zero voltage crossover of the wave to generate a periodic interrupt which is set at the same frequency as the line. This interrupt will occur every 16.6 milliseconds for a 60 cycle line and every 20 milliseconds for a 50 cycle line and is fed directly into the processor to automatically increment timers contained within the processor which denote the passage of time to the system. A clock generator 314 consists of a crystal control oscillator which provides all the synchronous clocking information for the master system circuitry. Interfaced to the processor on data line 316, address line 318, and control line 320, is 8K×8 of ROM 306, which may also be erasable, programmable read only memory (EPROM). Contained within this memory are all of the logic functions associated with the performance of the master. In addition, 2K×8 of random access memory (RAM) 304 is provided for local data retention. This memory can be written and read from the processor 302 and the master/slave communication interface 300. Contained within the RAM memory is a common storage area which is used to pass information between the master/slave communication interface 300 and the signal processor 302. This common memory area is accessed by the processor under software control to obtain the latest input data from each elevator. This input data is rewritten in registers of memory in the processor to become what is known as the "bit map" of the input data. Detection of a change in state of one of the bits in the bit map is used in the logical flow of predetermined algorithms to determine the presence of an alarm condition and/or significant performance data associated with the bit change. Upon detection of an alarm condition, the processor will forward a specific alarm message to its associated local monitoring center. The message is sent from the processor to the modem 25 (FIG. 1) via a universally asynchronous receiver transmitter (UART) chip which provides the necessary formatting and control signals for operation of the modem. Data is transmitted from the UART to a driver circuit 322 on a line 324. A transmit data (T×d) line 326, a data terminal ready (DTR) line 328, and a request to send (RTS) line 330 operatively connect the driver circuitry 322 to the modem 23 (FIG. 1). Received back from the modem are received data (Rcd) on a line 332, a clear to send (CTS) signal on a line 334, a data character detect (DCD) signal on a line 336, and a ring indicator (RI) signal on a line 338 at a receiver circuit 340. The receiver circuit transmits signals to the UART via lines 342. In addition, a ground reference signal (not shown) is provided to the modem. The line 326 functions as the data line through which messages are transmitted to the modem. The data terminal ready (DTR) line 328 is required to provide a signal to the modem that indicates the master is ready for communication. When the master is ready to transmit a message through the modem the DTR is set to a logic one level which is then followed by an initialization sequence which is sent via the transmit data line 326 to the modem. Subsequent to transmission of the initialization sequence, a response is received on the received data (Rcd) line 332 from the modem indicating to the processor that the modem has been initialized and is prepared to dial. At that point, a dialing sequence is sent from the processor to the modem through the transmit data (T×d) line 326. The dialing sequence consists of a command function to dial followed by the necessary digits to call the local monitoring center 14 (FIG. 1). In most cases this will consist of a seven digit number; however, in those cases where the remote building's modem is interfaced to a private PBX within a building, 8 or 9 digits may be necessary and can be accommodated. In response to the dialing sequence, the processor will wait for the reception of a data carried detect (DCD) signal on the line 336 from the modem. This occurs once the modem has completed the dialing cycle and has received a carrier signal back (the carrier signal is a tone frequency capable of being modulated with the signal on the line 332. Upon the reception of a data carried detect (DCD) signal the master is now ready to transmit the message to the local monitoring center detailing the alarm condition or performance data. This same sequence is also followed at the end of the 24 hour period designated as the performance day. This data, however, is not associated with an alarm condition but rather reflects operating performance data which has been accumulated by the processor during the last 24 hour period with regard to the elevators that it monitors. Upon transmission and reception of the message at the local monitoring center an acknowledgement signal will be received on the received data (Rcd) line 332. At that time the processor will "hang up" the modem by causing the DTR signal on the line 328 to the logic zero level. In response to the DTR signal at the logic zero level the modem disconnects from the local monitoring center and clears the telephone line. In the event that an error has occurred in the transmission instead of an acknowledgement, a not acknowledged (NAK) signal will be received on the line 332 from the local monitoring center. In response to the reception of a NAK, four more attempts will be made by the master to complete transmission to the local. If, after five attempts, communication has not been established correctly without error, the remote will "hang up" and reinitiate the entire sequence again in approximately 60 to 90 seconds. This process will continue until a successful communication has been accomplished. Therefore, if a failure of the local phone line occurs, a remote continues to communicate to a local until that line is restored. Upon initial power up or after a power failure occurs at a remote building the master will communicate, through the modem to the local monitoring center to receive the correct time of day. The local monitoring center contains a chronograph which contains a master clock for the remote building associated with that local office. In this way the remote master processor is synchronized with the master clock in the local monitoring center. Depending upon the remote processor's local address, which is its identification to the local processor, it will use this time of day to perform a daily performance data transfer which is related to its address, in a very specific equation.

Referring back to FIG. 1, the local monitoring center 14 contains a modem 26, local processor 28, and a printer 30. The processor contains the data base for the remote elevator monitoring system within the geographic area, and the software to receive messages from each remote building and print the appropriate English message for that message received. In addition, the performance data is received and forwarded to the central monitoring center 16 on a daily basis. The communication between the processor 28 and the modem 26 is similar to that of the master 18. The modem 26 at the local monitoring center 14 will detect the occurrence of a ring indication and transmit a ring indicator (RI) to the local processor 28. Upon detecting a RI signal the local modem 26 will answer and establish connection to a remote building's modem 24. The message upon receipt will then be placed into memory of the processor 28 and software will then determine the type of message. If the message is received error free, an acknowledgement is then sent back to the remote building and the modem 24 at the remote building will hang up. Upon receipt of a message at the local monitoring center 14 of an alarm condition a printout will be generated on the alarm printer which will indicate the occurrence of the alarm condition and the condition of the elevator. In addition, if there is a person trapped on the elevator it will be highlighted as well. In this way, any alarm condition and its nature is known at the local monitoring center 14 in approximately 25 seconds from its detection within the remote building's master. The local monitoring center will also print a message whenever any elevator is placed on "attendant" operation indicative of the turning of a switch contained within the elevator which removes it from automatic service, or that a service mechanic has thrown a switch in the master itself indicating that service actions are being taken on the elevator system within the building. At the end of the "attendant" operation or service within the building, the local will print a message "all clear". Any alarm condition is cleared upon receipt of an "all clear" message at the local monitoring center which is also forwarded to the central monitoring center via telephone line. These messages are transmitted by the local monitoring center 14 to the central monitoring center 16 in much the same manner that they are transmitted from a remote building to the local. However, in this case a slightly different message format is utilized to indicate to the central monitoring center the specific local monitoring center from which the message is being received. Contained within that, of course, is the necessary data to identify the remote building and its elevator from which the message was received at the local monitoring center. A duplicate copy of the printout obtained at the local monitoring center is obtained at the central monitoring center under this action so that two printouts of every alarm and "all clear" are obtained within the system. This is important in cases where the local may have experienced a failure in its printer which may be due to a mechanism break down, loss of paper, operator error, etc. In all such cases, any alarm not received at a local will be forwarded to the central where it will be identified and action can be taken.

In addition to alarms, daily performance data is forwarded from the locals to the central at specified time intervals. This data is stored under an archival system as received by central. Bulk storage may be implemented using tape, disk, etc. for instant retrieval and performance report generation. These reports can be automatically generated via the centralized computer program. The purpose of this daily performance data and its archival storage is to allow the operators of the REMS the ability to retrieve specific performance data collected via the system to evaluate past performance of the elevators in order to project long term performance. It is important to note that the daily performance called in, in addition to providing daily performance data about all elevators being monitored, also provides an important message verifying the operation of the individual units operating in the various remote buildings throughout the system. Since it is not uncommon not to receive any alarms from a particular elevator during the day, the daily call in is generally the major form of communication within the system. In the event that a remote building does not call in, it is immediately highlighted via the local monitoring center's computer printout and is also reiterated at the central printout. This provides the local monitoring center immediate notice that the system is not functioning in a particular remote building so that a service person can be dispatched the next day to investigate the cause of the failure, thus, the daily call in provides a supervisory function which detects a broken down system in a particular REM building within one day.

Figures 5, 5A:
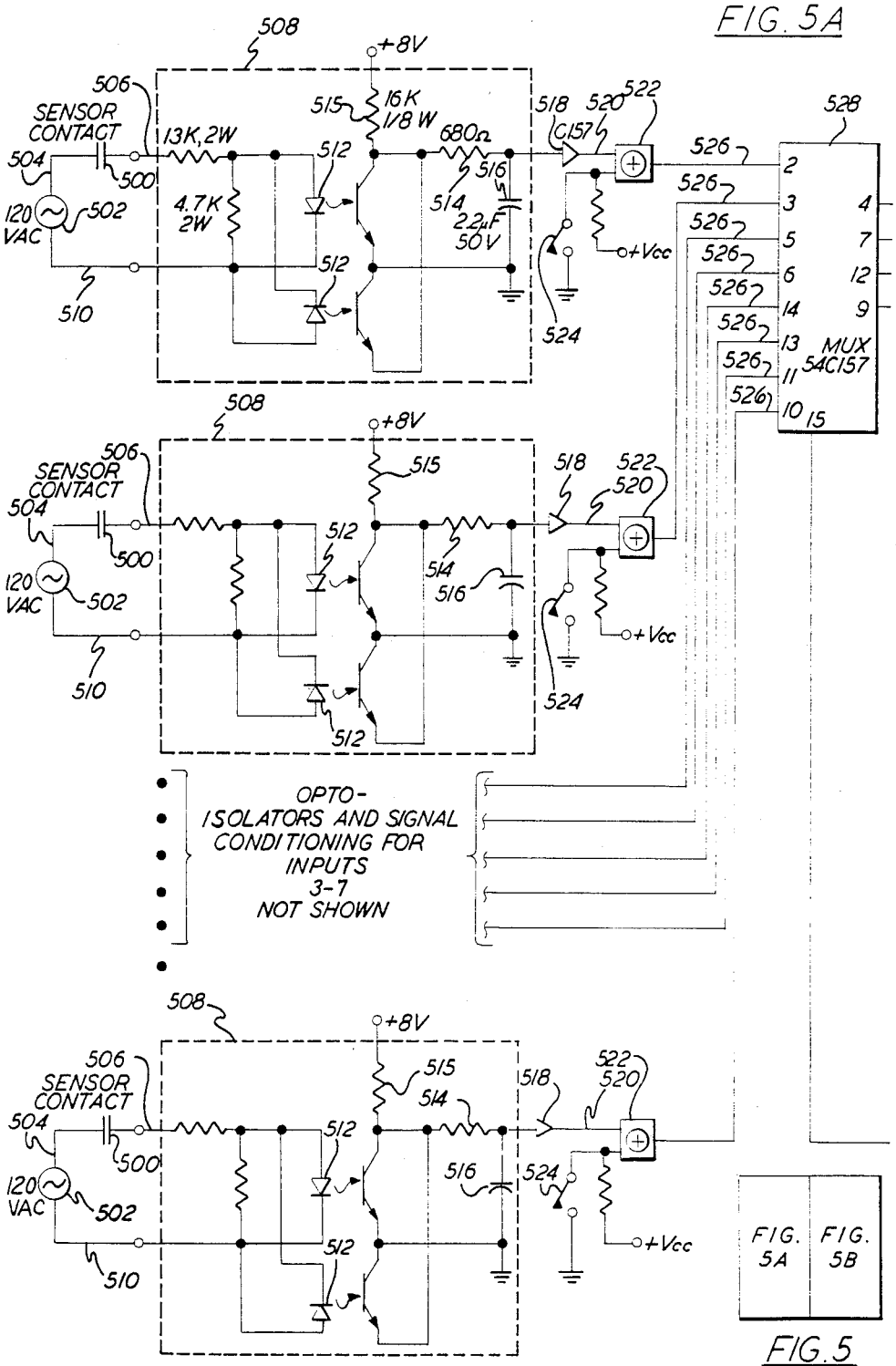
FIG. 5 is a simplified schematic diagram of the slave unit shown in FIG. 2.
Figure 5B:
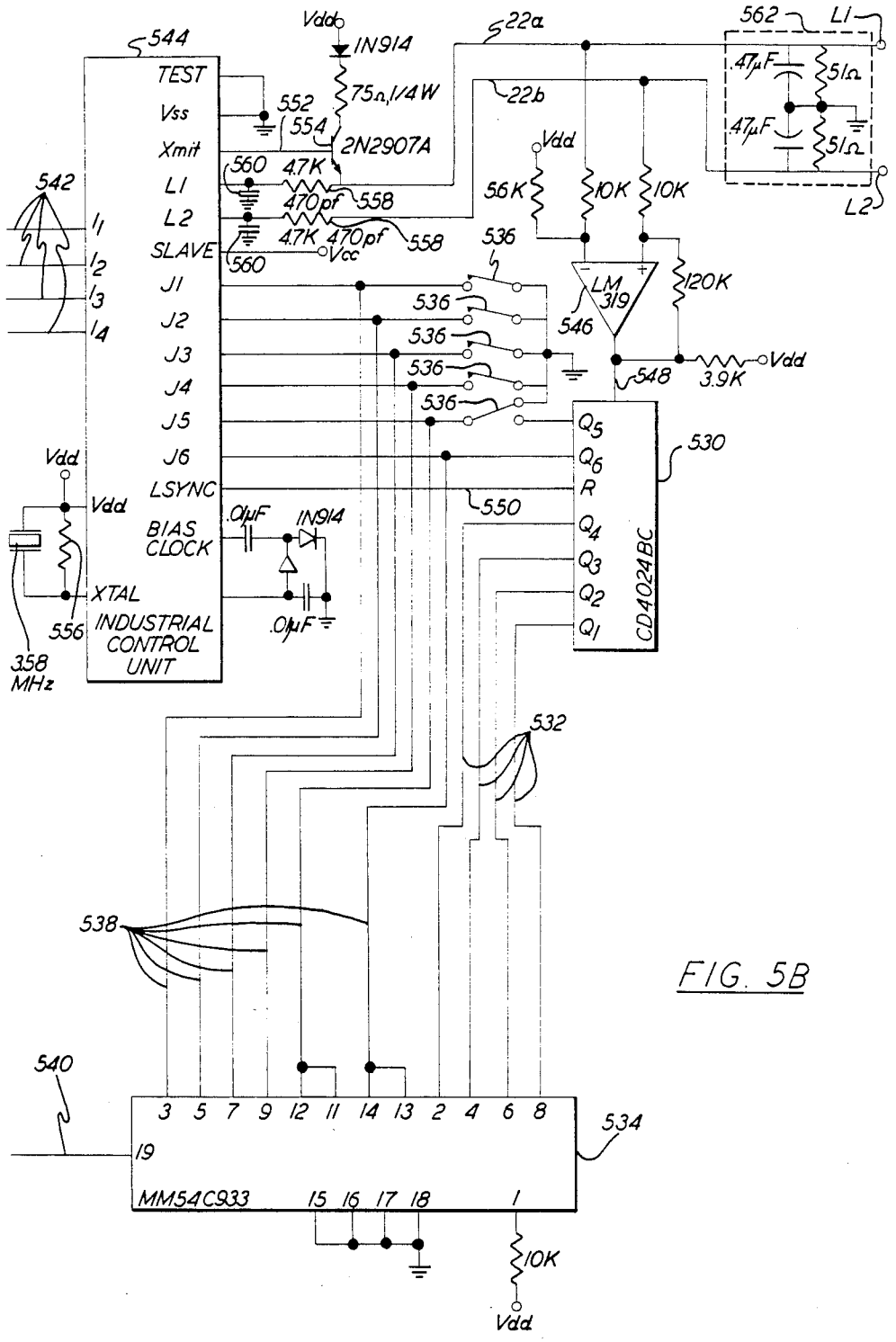

FIG. 5 is a detailed schematic diagram of a slave unit of the present invention shown interfaced to elevator sensor contacts 500 and associated 120 VAC sources 502. The contacts 500 and sources 502 are operatively connected on lines 504. Each contact is also operatively connected on a line 506 to an opto isolation and signal conditioning network 508. Each 120 VAC source is also connected on lines 510 to the opto isolation and signal conditioning network 508. The elevator sensor contacts 500 are presented to the opto isolators 508 in order to completely isolate the slave unit from the elevator signals it is monitoring in order to eliminate high frequency noise spikes of high potential from entering the slave system via a common ground connection. Each opto isolation circuit 508 consists of two opto isolators (photo transistors) 512 which are placed back-to-back to provide for complete positive and negative signal conditioning. The opto isolators 512 turn on at any voltage greater than one-half the AC peak sine wave input value. Once either opto isolator turns on, it discharges a RC charge circuit, having a resistor 514, a resistor 515, and a capacitor 516, and thereby present, through a buffer amplitude 518, on a line 520 a logic zero signal (0.5 V) to an exclusive or gate 522. When the AC input drops below one-half of the peak voltage, the photo transistor 512 turns off and the RC charge circuit begins to recharge the capacitor 516 according to the relation $V_o = V_{in}(1-e^{t/RC})$. This charging time, however, is one-sixth the total time it takes to cover a complete AC cycle. Since the time constant of the charge circuit is 35 milliseconds the input voltage never reaches the level of 2½ volts required to transition the control logic. The actual charge voltage input is approximately 0.534 volts or less. Therefore, as long as an AC signal is present, a logic zero is present on the line 520 into the exclusive or gate 522. In the absence of an AC signal for more than 34 milliseconds, the capacitor 516 charges up to a value of Vcc and the signal on the line 520 is not allowed to switch state indicating the absence of an AC signal. The purpose of the exclusive or gate 522 is to permit the presence or absence of an AC signal on the line 506 to indicate either a true or false condition depending upon the position of a switch 524. If the switch 524 is in the open position, a logic one on the line 520 will cause a logic zero to be present on output line 526. A logic zero on the line 520 will cause the output on the line 526 to be a logic one. Similarly, if the switch 524 is in the closed position, a logic one on the line 520 will cause the output on the line 526 to be logic one. If the value of the voltage on the line 520 is equivalent to a logic zero then the output on the line 526 will assume a logic zero value. It should be understood that it is not absolutely necessary in the practice of the invention to utilize relatively high (e.g. 120 VAC, 120 VDC, or 24 VDC) voltage sources for sensing purposes. A relatively high voltage is used to overcome any high noise voltages which may be induced on the wires used to connect to the sensor contacts which may be located in a noisy electromagnetic environment. It should also be understood that it is not necessary to isolate the sensor contacts from the control logic within the slave unit by means of opto isolators. Isolation may be achieved using traditional relay isolation methods. Or, if the sensor contacts 500 are located in a benign electromagnetic environment, isolation may not be required. It should also be understood that the setting of the meaning of the presence or absence of voltage on the line 526 by means of, in this case an exclusive or gate 522, could as easily be accomplished by other logic gates or circuit configurations. It should also be noted that FIG. 5 only illustrates several opto isolators and their associated signal conditioning networks, and that many other inputs could have been illustrated in a theoretically unlimited number, although the practical number of inputs in the best mode embodiment is either 4, 8, or 12 inputs.

In most cases, where many inputs are attached to a slave unit, it is necessary that multiplexing circuitry 528 be contained in the slave to select the proper set of four inputs at the assigned time within the communications system protocol so that the correct information is inserted into the proper information frame. This is accomplished by means of a multiaddressing binary counter 530 which counts the number of clock pulses transmitted on the line 22*b* and presenting the present value of its count on lines 532 to an address comparator 534. The permanent address of the particular slave unit is preset by setting a series of switches 536 or jumpers in a combination of open and closed positions depending on the binary value of the permanent address. The setting of the switches causes the lines 538 to carry the various voltage values equivalent to either a logic zero or a logic one in the combination necessary to represent the permanent binary address and present it to the address comparator 534. When the binary counter 530 reaches a count corresponding to the value set by the switches 536 the address counter transmits a signal on a line 540 to the multiplexer 528 which then presents the information contained on a first four group of output voltages on the lines 526 on lines 542 to an industrial control unit 544. The transmittal of the first group of four information bits in parallel form on the lines 542 causes the industrial control 544 to retransmit the four bits in serial form, each bit being transmitted during the appropriate data frame so that the particular bit is transmitted during an appropriate corresponding bit time 218, 220, 222, 224 (see FIG. 3*c*). After the data bits for the data frame have been transmitted, a subsequent clock pulse is sensed on the line 22*b* by means of a comparator 546 and its address output is increased by one on the lines 532 and the address comparator 534 provides a signal on the line 540 to the multiplexer 528 indicating that the transmission line is ready to receive the next group of four inputs. If there are more than four inputs associated with a particular slave, the next group of four inputs should be selected and their information transmitted on the lines 542 to the industrial control unit 544 for transmittal on the line 22*a*. The binary counter continues to increase its count as each clock pulse is received from the comparator 546 on a line 548 and the address comparator 534 continues to transmit a signal on the line 540 to the multiplexer 528 indicating that the next group of inputs are to be presented to the industrial control unit until there are no longer any more groups associated with the particular slave to transmit. After the groups of inputs from all the slaves on a given transmission line have been exhausted and after the conclusion of a particular transceive cycle (lasting 104 milliseconds), the count of the binary counter 530 and of all the counters in slaves on the same transmission line are zeroed after receiving a LSYNC signal on a line 550 at a reset (R) input. It should be under-stood that systems using an industrial control unit having four parallel inputs, a multiplexer would not be necessary if only four inputs were used. Similarly, if a serial type transmission line were not used, the need for an industrial control unit, which transforms data from parallel to serial form (among other things) would not be necessary. In that case, the binary counter 530, the address comparator 534, the clock detector 536, and the address select switches 536 would not be necessary for practicing the invention.

The Xmit output of the industrial control unit 544 provides sufficient current on a line 552 to turn on a transistor 554 to transmit a data bit on the line 22*a* for each corresponding bit received from lines 542 at the inputs $I_1$–$I_4$. In addition to the communications line illustrated by the lines 22*a* and 22*b*, there exists a two wire DC power distribution line (not shown) connected to the industrial control unit.

The Xtal input to the industrial control unit can accept a zero to 10 volt 3.58 MHZ squarewave from the system clock or be connected to one side of a 3.58 MHZ series resonant color burst television crystal. The other side of the crystal should be connected to $V_{DD}$. Also a large resistor 556 (about 10 megohms) should be connected between XTAL and $V_{DD}$ to ensure a reliable crystal operation. A bias clock output provides a 1.78 megahertz 50 percent duty cycle (XTAL/2) 0 to 8.0 volts CMOS output to a $V_{EE}$ charge pump network. This circuit has two switching diodes and two small ceramic capacitors to invert the output of the 1.78 megahertz signal and produce a −6.0 VDC output which is applied to input line comparators within the industrial control unit so as to increase their negative common mode range. The SLAVE input is connected to $V_{cc}$ for slave operation. Additional noise suppression is accomplished by the addition of a RC network on both the L1 and L2 inputs. A time constant of approximately 2.2 microseconds should be sufficient to limit common mode voltage transients without degrading performance. In FIG. 5 a resistor 558 and a capacitor 560 are used on both the L1 and L2 ports. A termination network 562 serving the purpose of providing a DC signal return path and limiting the bandwidth of the transmission line to just what is needed by the industrial control units is attached to the line at the last slave on the line. This reduces large high frequency common mode voltage transients induced by such noise sources as relay coils, and induction motors.

Figure 6:
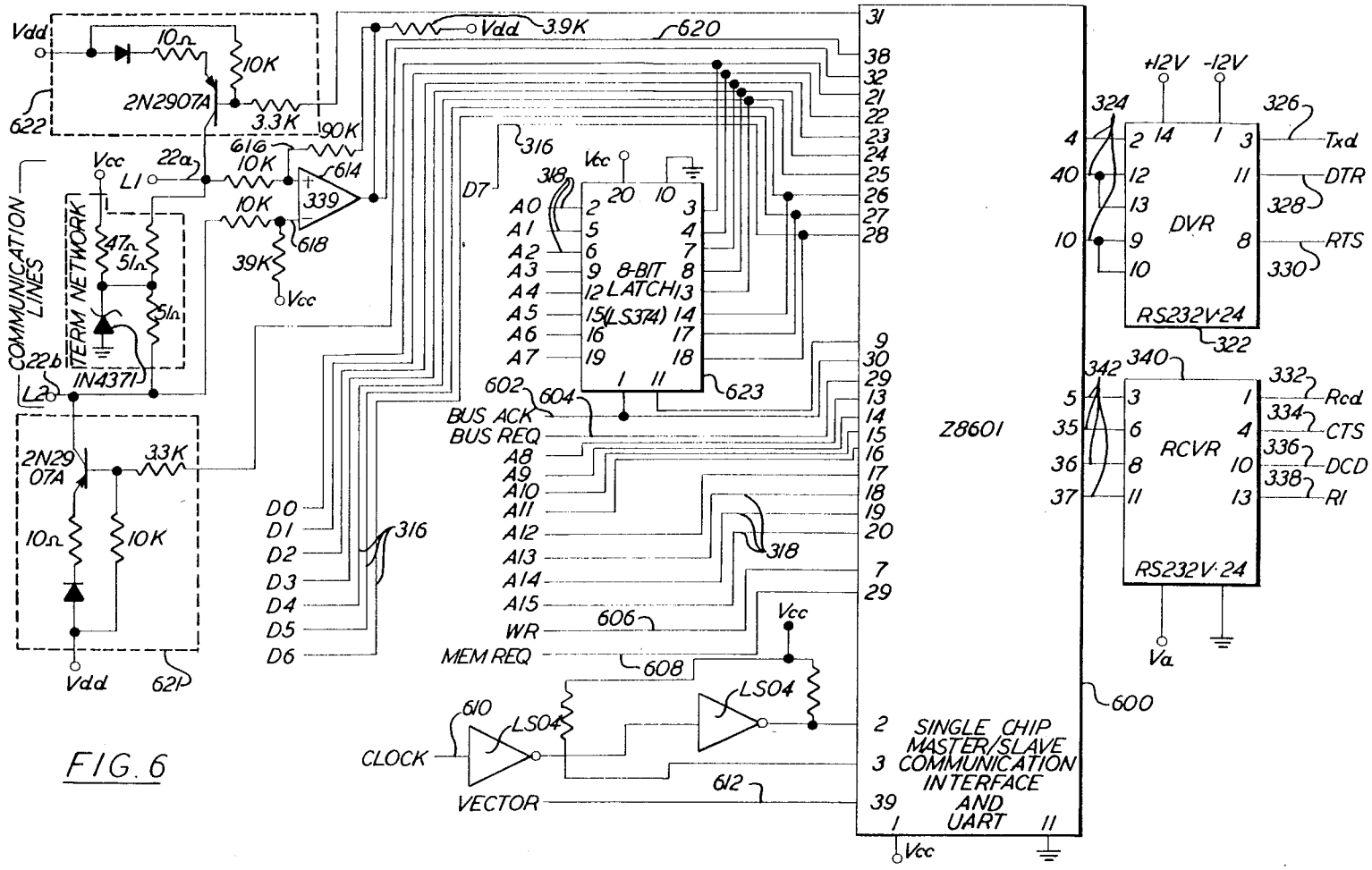
FIG. 6 is a simplified schematic diagram of part of the master block diagram of FIG. 4.
Figures 7, 7A, 7B:
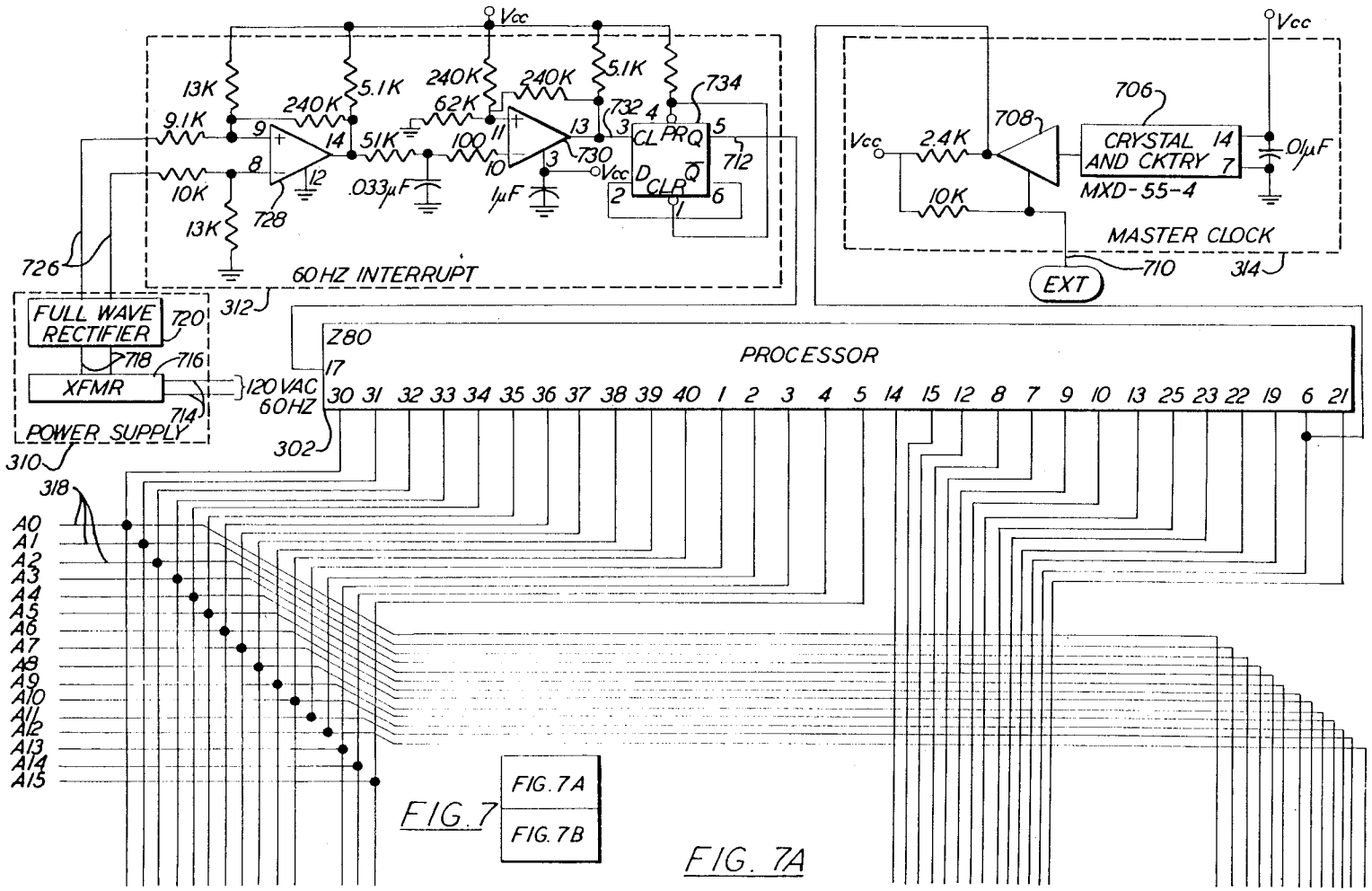
FIG. 7 is a simplified schematic diagram of part of the master block diagram of FIG. 4.
Figure 7B:
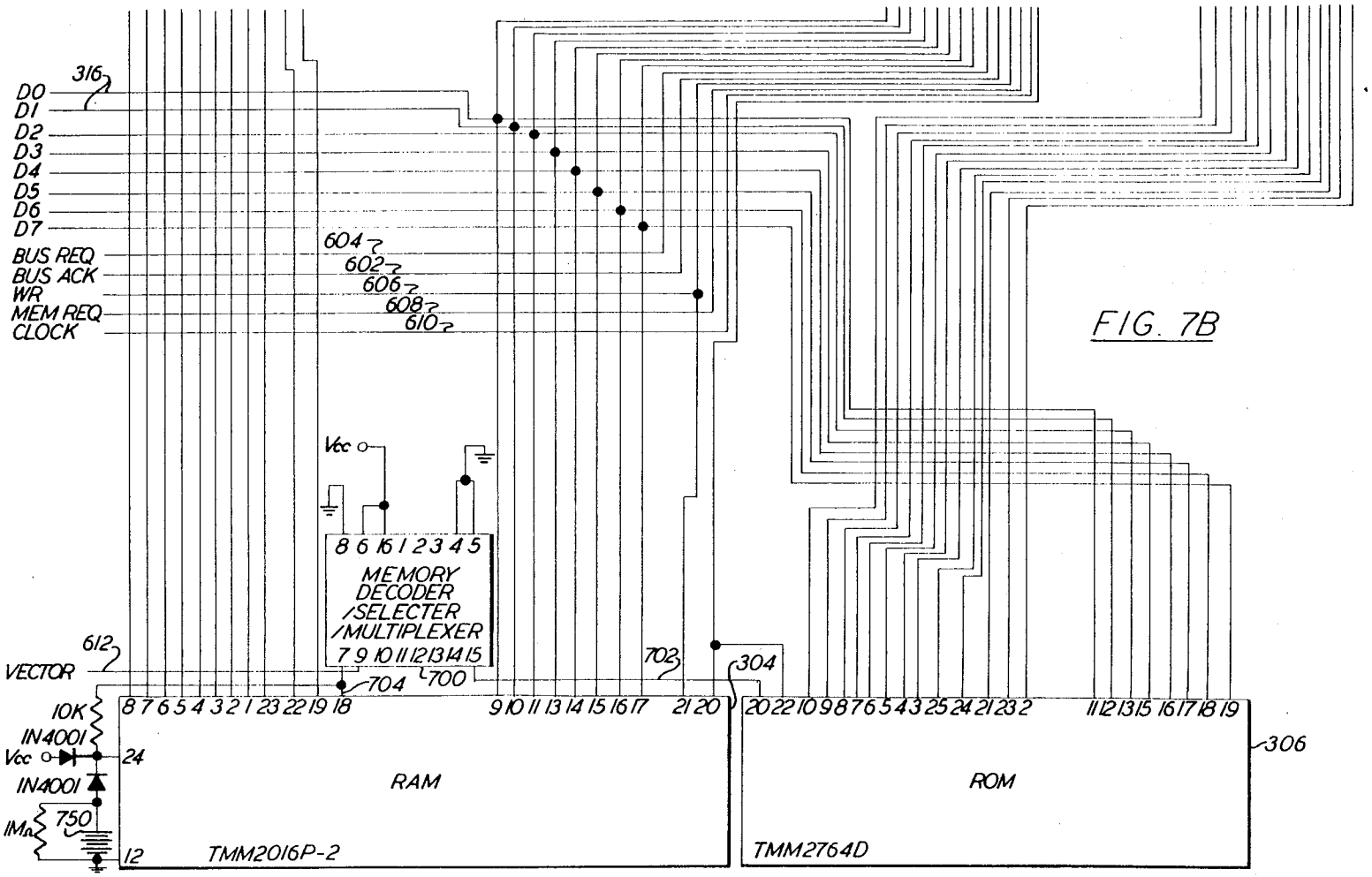

In FIGS. 6 and 7 are illustrated in more detail the block diagram of FIG. 4. FIG. 6 shows the master/-slave communication interface 300 and the UART 308 of FIG. 4 in a single chip 600 implementation of the master/slave communication interface and UART. Also shown, in common width FIG. 4, are a driver circuit 322 and a receiver circuit 340 which transmit and receive signals, respectively, from the modem 24 of FIG. 1.

In FIG. 7, is shown the processor 302, the RAM 304, the ROM 306, the 60 HZ interrupt 312, the power supply 310, and the clock 314 of FIG. 4. Of course, the common data lines 316, address lines 318, and control lines 320 of FIG. 4 are shown in both FIGS. 6 and 7. The data lines 316 of FIG. 4 are designated alphanumerically as D0–D7, the address lines 318 are designated A0–A15, and the control lines 320 include a BUS ACK line 602, a BUS REQ line 604, a WR line 606, a MEM REQ line 608, a CLOCK line 610, and a VECTOR line 612.

Referring to FIG. 6, the communication lines 22*a*, 22*b* together connect the master with one or more slave units. A comparator 614 compares the voltages on lines 616 618 and and provides a data bit on a line 620 to the single chip 600 whenever the voltage on the line 22*a* is 0.8 volts greater than the voltage on the 618. A circuit 621 provides clock pulses on line 226. A similar circuit 622 provides the capability of writing data onto line 22*a*; although this capability is not used in the best mode embodiment, it is included for possible future use.

An eight bit latch circuit 623 is used to demultiplex data and address information provided on lines 316. The latch recovers the address information and holds it for a selected period for later presentation to the least significant bits (A0–A7) of the address bus. The most significant bits of the address bus (A8–A15) are provided directly to the address bus 318 from the single chip 600.

During the second half (the receive time) of each transceive cycle (see FIG. 3) the master receives data from the slaves on the communication lines 22a, 22b and stores the data in a discrete bit map in available memory, which in the single chip implementation consists of 128 bytes of RAM which, in the best mode embodiment, is a Zilog Z8601. After each transceive cycle is concluded and the data transmitted from the slaves to the single chip has been stored within the single chip's 128 bytes of RAM, a bus request signal is transmitted from the single chip on a line 604 to the processor 302 of FIG. 7 for direct memory access (DMA) by the single chip 600 (Z8601) into the 2K of RAM 304. The DMA technique momentarily interrupts the processor (which may be a Zilog Z80) 302 so that control of the address and data lines are relinquished by the processor 302 to the single chip 600. The processor does this by causing its internal drivers associated with each of the address and data lines to go into the high impedance state so that the single chip's drivers associated with the same lines may temporarily assume control of the address and data buses. Once the single chip has halted the processor and assumed control of the address and data buses, it then proceeds to write the discrete bit map from its 128 byte RAM into the RAM 304 of FIG. 7. It then releases the bus request line and the processor resumes operation.

In the best mode embodiment the ROM is an 8K×8 (8K words (bytes), 8 bits/word) electrically programmable read only memory (EPROM) which is a Toshiba TMM2764D. The RAM 304 of FIG. 7 is a 2K×8 Toshiba TMM2016P-2. It should be noted in FIG. 7 that although the data bus has 16 lines, which are capable of addressing 65,536 addresses (64K bytes) the EPROM is only an 8K byte device and the RAM 304 is only a 2K byte device. The EPROM is assigned the first 8K bytes of addressable memory and the RAM is assigned the last 2K of addressable memory, i.e. the EPROM has hexidecimal addresses from 0000 to 1FFF and the RAM from F800 to FFFF. A memory decoder/selector/multiplexer 700 is illustrated in FIG. 7 which permits the selection of the proper memory space according to the three most significant bits of the address presently on address lines A13–A15. The logic levels assumed by lines A13–A15 determine which memory (the EPROM or the RAM) is selected. If line A15 assumes the logic zero level then the selected address presently on the address bus must be between addresses 0000 and 7FFF. But since the EPROM is assigned addresses 0000 to 1FFF this is not sufficient information to enable the EPROM. The EPROM is enabled by causing a line 702 to transition from a logic level 1 to a logic level 0 when A15=0, A14=0, and A13=0. This may be seen in Table II, which is a diagram showing the locations of the addresses selected for the RAM and the EPROM within the 64K bytes of addressable memory. The ranges of addresses within 64K are shown in both decimal and hexidecimal form. The values which may be taken on by the last four (and the most significant) bits of the address, i.e. A15–A12, are also shown in Table II in the order of most significant to least significant. It may be seen that for the addresses between decimal 0 and 32,767 (hexidecimal 0 and 7FFF) the most significant hexidecimal numeral (HEX bit 3) increments from 0 to 7. As may be seen from the accompanying binary representation of the four most significant data line A15–A12 for HEX bit 3, the binary equivalent for the most significant bit (A15) remains at zero for all addresses between hexidecimal 0 and 7FFF, i.e. for the first 32K bytes of addressable memory. In a similar fashion, it may be discerned at any address on the address but having the lines A15–A13 at a binary logic level of zero must necessarily have its address in the first 8K bytes of memory (decimal 0 to 8,191; hexidecimal 0 to 1FFF). Since the EPROM has had the first 8K of addressable memory assigned to it, the memory decoder/selector 700 of FIG. 7 provides a logic zero level output select on the line 702 whenever A15, A14, A13 all have assumed the logic zero level. This enables the processor 302 to read instructions out of the EPROM. In a similar fashion, when the logic level one is detected on all three lines A15–A13 the address on the data bus must be in the last 8K bytes of addressable memory, i.e. somewhere between hexidecimal address E000 and FFFF (decimal 57,344 and 65,535). In response to all three lines being at the logic one level, the memory decoder/selector/multiplexer 700 causes a line 704 to assume the logic zero level which enables the 2K RAM 304 for selection of memory locations in the last 2K bytes of addressable memory, i.e. from 62K to 64K.

If the processor 302 of FIG. 7 determines, in a program for determining whether an alarm condition exists to be described in more detail hereinafter, that an alarm condition exists, a signal is provided by addressing memory address C000 memory decoder/selector/multiplexer 700 that causes the line 612 in FIG. 6 and FIG. 7 to provide a VECTOR signal to the single chip 600 which indicates that a message is to be sent to the local office. In response to a VECTOR signal, the single chip 600 of FIG. 6 provides a bus request signal on the line 604 to the processor 302 of FIG. 7 whereby operation of the processor is suspended and the single chip executes a DMA in order to read a location in RAM 304 having a code which corresponds to an instruction which indicates that a message is to be transmitted to a local office. In response to this information, the single chip then initiates a transfer sequence utilizing the modem to communicate with the local wherein the previously described sequence culminating in the reception of a carrier detect signal is executed whereby the master is in communication with the local office. At this point the single chip will execute a DMA into RAM to obtain the message for transmittal out through the modem.

The master clock 314 of FIG. 7 provides a clock for both the processor and the single chip so that they may be in synchronism. The clock 314 includes a crystal with associated circuitry 706 and a buffer circuit 708. An external signal may be provided on a line 710 which disables the master clock 314 and which permits the clock line 610 of FIGS. 6 and 7 to be driven externally by an external clock for test purposes.

The 60 HZ interrupt circuit 312 shown in FIG. 7 generates 60 cycle interrupts on a line 712 which are presented to the processor 302 so it can keep track of time. The power supply 310 receives 120 VAC/60 HZ power on lines 714 which are presented to a transformer 716. The transformer provides a transformed signal on lines 718 to a full wave rectifier 720 which provides a rectified signal on lines 722 to the interrupt circuit 312. The interrupt circuit includes amplifiers 728, 730 which provide a 120 HZ signal on a line 732 to a divide by two flipflop 734 which provides the 60 cycle interrupt on the line 712 to the processor 302. It should be understood that another frequency interrupt could be used, e.g. 400 Hz or 50 Hz in Europe.

A small lithium battery 720 is provided along with associated resistors and diodes to ensure that upon a power failure the contents of the RAM are not lost.

Figure 8:
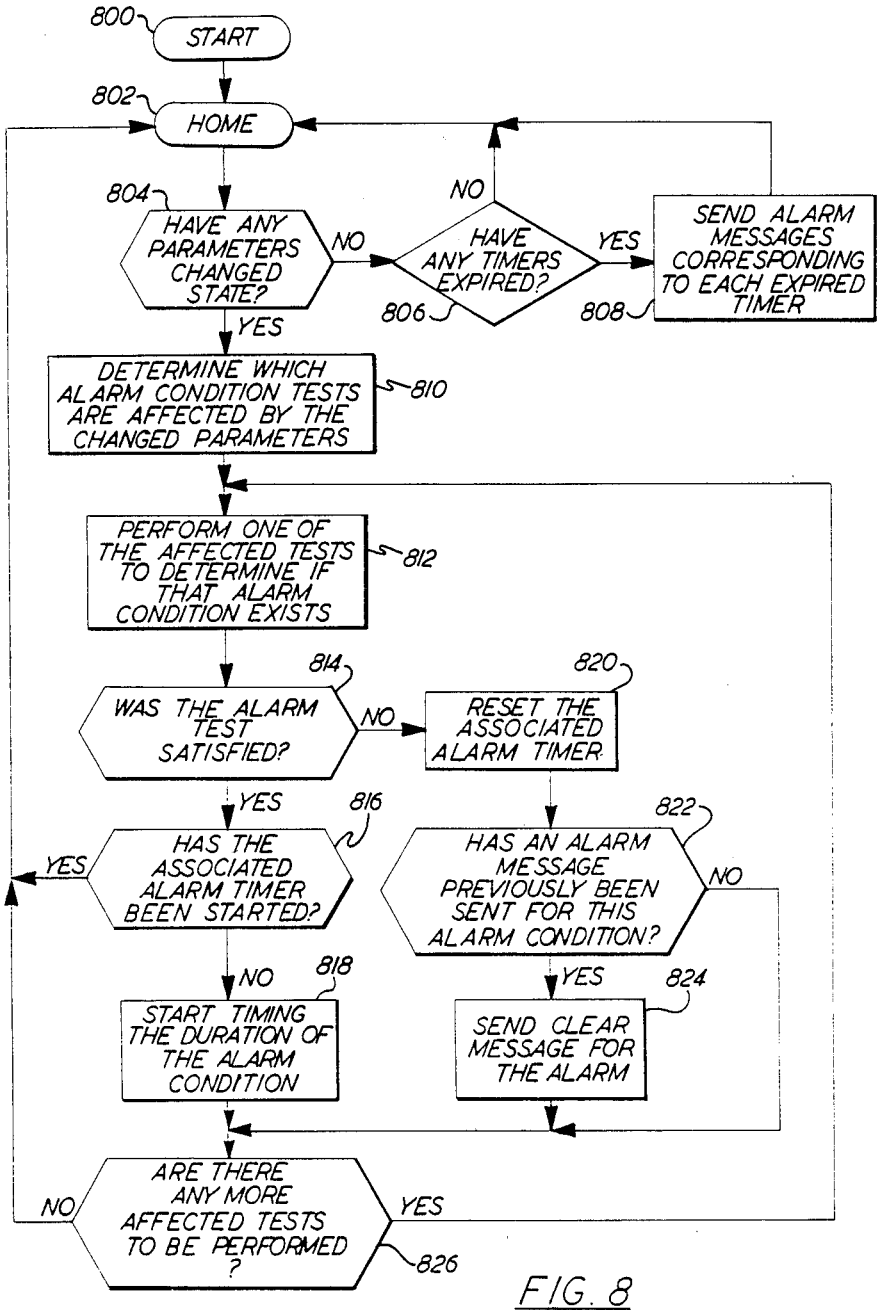
FIG. 8 is a simplified flowchart diagram illustrating the steps executed by the master processor in determining the presence of an alarm condition.

In FIG. 8, a simplified flowchart is shown, illustrating the steps taken by the signal processor 302 (of the master illustrated in FIG. 4) in determining whether an alarm condition exists, and in controlling the flow of alarm messages. Starting in a START instruction 800, the flowchart next proceeds to a HOME instruction 802 from whence the program next executes a decision instruction 804 which determines whether any of the monitored elevator parameters have changed state since the last time the instruction 804 was executed. If not, the program next determines in a decision instruction 806 whether any timers have expired. If no timers have expired the program returns to the HOME instruction 802 from whence it will reenter the decision instruction 804. If one of the alarm timers has expired, the program proceeds from the decision instruction 806 to an instruction 808 which causes alarm messages corresponding to each expired timer to be sent from the remote building to the local monitoring center.

If it is determined in the decision instruction 804 that one or more parameters changed state, the program next executes an instruction 810 that determines exactly which alarm condition tests are affected by the changed parameters. Since the status of each parameter is ascertained every 104 milliseconds (see FIG. 3), each affected alarm condition test is performed (assuming there has been a state change) in an instruction 812 every 104 milliseconds. Of course, it should be understood that upon many occasions, no state changes will be detected. If it is determined in a decision instruction 814 that the Boolean expression for the particular alarm condition under test is satisfied, then the answer to the question of whether the associated alarm timer has been started is determined in a decision instruction 816. If the associated timer has been previously started, the program proceeds back to the home instruction 802. If not, the program next starts timing the duration of the associated alarm condition in an instruction 818.

If it is determined in the instruction 814 that the particular alarm test performed in the instruction 812 was not satisfied, the associated alarm timer is reset to zero in an instruction 820. After resetting the alarm timer, the program next proceeds to a decision instruction 822 where it is determined whether a previous alarm message has been sent for the particular alarm condition which has not been cleared. If an alarm was previously sent it must be cleared in an instruction 824 and the program then executes a decision instruction 826. If not, the program proceeds directly to the decision instruction 826. As can be seen from the flowchart, the decision instruction 826 may be entered from any one of three different paths, i.e. from the instructions 818, 822, or 824, which are merely the concluding instructions of a loop which began with the instruction 812 and which concludes with the instruction 826. The loop is reexecuted as many times as there are remaining alarm tests affected by the changed parameters detected in instructions 804 and 810. If any more affected tests remain, decision instruction 826 branches back to instruction 812 in order to perform the next available test. If no more tests remain to be be performed during the particular cycle then the program branches from instruction 826 back to the HOME instruction 802 and the program may then be reexecuted in its entirety.

Figure 9:
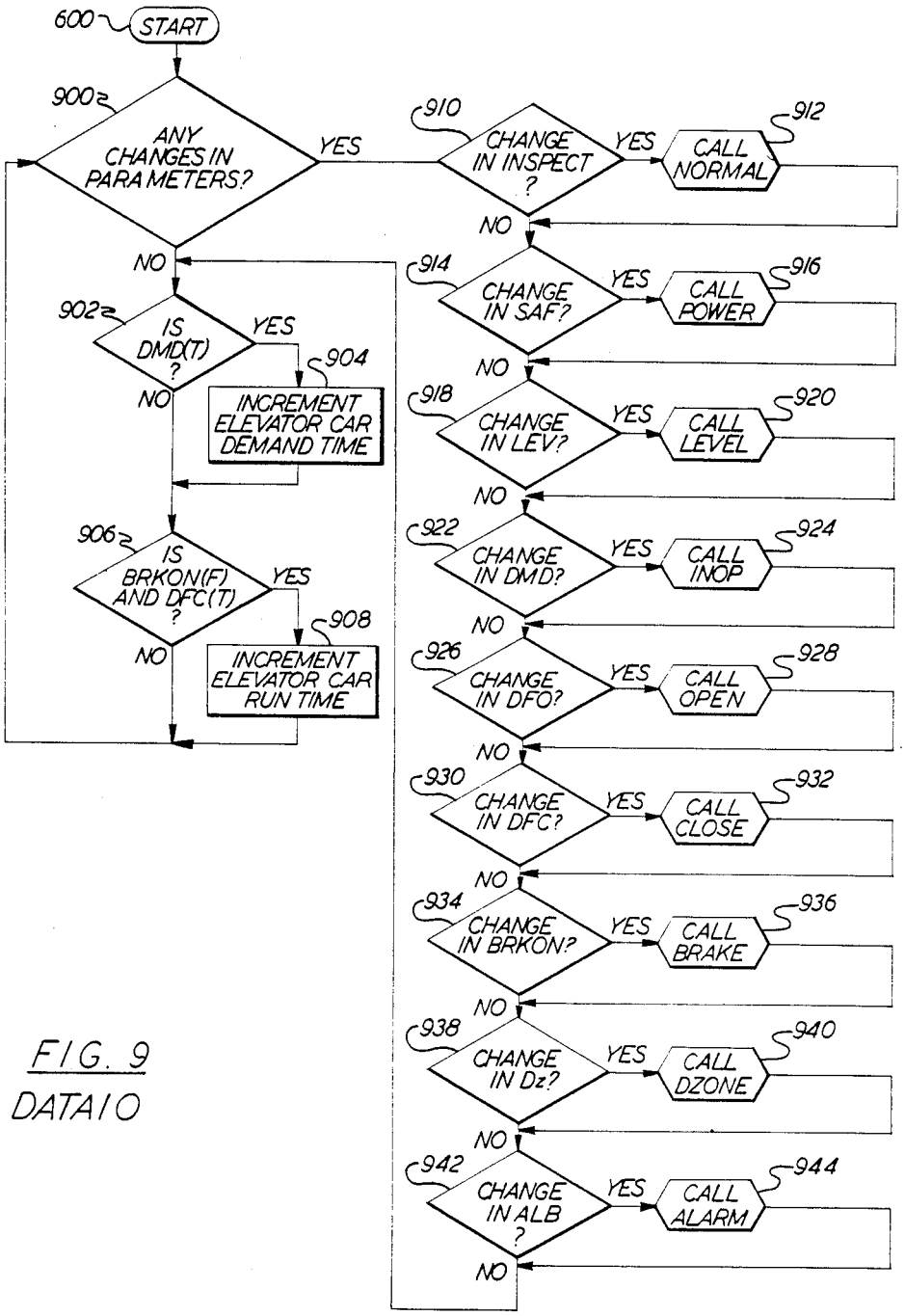
FIG. 9 is a simplified flowchart diagram illustrating the steps executed by the master processor in determining whether any parameters have changed states within a given cycle.

In FIG. 9, a flowchart is shown, illustrating in more detail than FIG. 8, the steps executed by the signal processor 302 of FIG. 4. Included in FIG. 9 are separate subroutines, any one of which is called in response to a change in state of an associated parameter. Flowcharts illustrating the steps executed by the signal processor 302 of FIG. 4 for each of the separate subroutines are illustrated in FIGS. 10–22. A list of the variables tested by the software is provided in Table I.

TABLE I

| | |
|---|---|
| DFO(T) | Door Fully Opened |
| DFC(T) | Door Fully Closed |
| ALB(T) | Alarm Button Pushed |
| DMD(T) | Car Has Demand |
| BRKON(T) | Brake Fully Applied |
| EMSTO(T) | Emergency Stop Button Pushed |
| DS(T) | Door Switch Actuated by Car |
| INSPECT(T) | Inspection Key Actuated |
| LEV(T) | Car Leveling Correctly |
| SAF(T) | Safety Chain NOT Broken |
| DZ(T) | Car in Door Zone |

Referring now to the flowchart of FIG. 9, the program begins in a START instruction 800 and proceeds to a decision instruction 900 in which a determination is made whether any of the monitored parameters (see Table I) have changed state in the particular elevator being tested. If none of the parameters for the elevator have changed since the last interrogation, the program proceeds to an instruction 902 in which a determination is made as to whether the elevator car "has demand". An elevator "has demand" when a passenger, either within the car or in a hallway landing, has pressed either an elevator floor button or call button, respectively. If the car "has demand" a variable DMD is detected as having the true (T) value and the program branches to an instruction 904 in which a counter (which keeps track of the total demand time on the particular elevator car) is incremented by the appropriate amount. If it was determined in the instruction 902 that the car did not "have demand" or, after incrementing the demand time counter in instruction 904, the program next executes a decision instruction 906 in which it is determined whether the elevator car door is fully closed with the elevator brake not applied. The Boolean expression BRKON(F) AND DFC(T) is used to make this evaluation. The variable BRKON assumes the value representing the true condition when the elevator car has its brake fully applied and the false value when the brake is not fully applied. If the Boolean expression BRKON(F) AND DFC(T) is not satisfied, i.e. it is not true, then the program returns to the instruction 900 and reevaluates, at the proper time, the question of whether any new changes in state in the monitored parameters have occurred since the last interrogation. If it is determined in instruction 906 that the Boolean expression BRKON(F) AND DFC(T) is true then the program executes an instruction 908 in which a count representing the total elevator car "run time" is appropriately incremented. The program then proceeds back to instruction 900 for more data gathering. The frequency of repetition of the execution of the instruction 900 depends on the frequency at which data on the status of the monitored elevators is gathered, e.g. in the best mode embodiment as illustrated in FIG. 3 the periodicity of information gathering is every 104 milliseconds.

If it is determined during a particular data interrogation interval (e.g. 104 milliseconds), that one or mcre of the moniotored parameters has changed state, the program then executes a series of individual parameter interrogations in order to determine exactly which parameters have changed state so that the question of whether the presence of one or more alarm conditions or the lack thereof can be determined. If it is determined that a particular parameter has changed state, an associated subroutine is then called for execution and the effect of the change in the parameter with respect to the predefined alarm conditions is determined and the appropriate alarm or clear alarm messages are sent, or appropriate alarm message inhibit actions taken.

Starting with a decision instruction 910, in which it is determined whether a variable INSPECT has changed state since the last interrogation, the program calls a subroutine NORMAL in an instruction 912 if it did change state or, if not, it proceeds to a decision instruction 914. The decision instruction 914 is also ultimately executed even if there was a change in INSPECT after execution of the NORMAL subroutine as indicated in the flowchart. The INSPECT variable is used to monitor whether or not the elevator car is being held in a nonoperational state by a serviceman having a key for disabling the car, either at the control panel within the car, or at the elevator controller in the elevator machinery room. The INSPECT variable changes state when the serviceman disables or enables the car with a key. The NORMAL subroutine is used to determine, among other things to be described more fully hereinafter, whether to transmit either an UNDER INSPECTION or END OF INSPECTION message to the local monitoring center.

The status of a variable SAF is evaluated in the decision instruction 914. The variable SAF is used to indicate the status of a series connected chain of safety contacts. If one of the contacts opens, the chain is broken, and the variable SAF assumes the false value. As long as the safety chain is not broken the variable SAF is true. If a change is detected in the variable SAF in the decision instruction 914, a subroutine POWER is called in an instruction 916. Each of the safety contacts used in the safety chain is associated with a particular safety parameter considered necessary to maintain an associated condition which ensures safe operation of the elevator car. The POWER subroutine is executed after detecting a change in the safety chain to determine, among other things to be described in more detail hereinafter, whether a power failure has occurred.

After executing either instruction 914 or 916, the program next executes a decision instruction 918 in which a change in a variable LEV (since the last interrogation) is detected. If a change has occurred the program calls a subroutine LEVEL in an instruction 920. The variable LEV is utilized to monitor whether the car is leveling correctly. A true value indicates that it is, while a false value indicates otherwise. The LEVEL subroutine is used, among other things, to increment a leveling error counter whenever a leveling error is detected.

After detecting no change in LEV or after executing subroutine LEVEL, the program next executes a decision instruction 922 in which it is determined whether the variable DMD has changed state. If it has, a subroutine INOP is called in an instruction 924. The examination of the DMD variable in instruction 922 is done merely to determine whether a change in the value of the DMD variable, the function of which has already been described fully in connection with instruction 902, has occurred. If it has, the INOP subroutine is executed in order, among other things, to determine whether an UNOCCUPIED ALARM condition exists and, if so, to send an UNOCCUPIED ALARM message to the local monitoring center.

After finding no change in the variable DMD, or after executing subroutine INOP, the program next executes a decision instruction 926 in which a determination is made whether a change in state in a variable DFO has occurred since the last interrogation. If a change has occurred, a subroutine OPEN is called in an instruction 928. The variable DFO is used to indicate whether or not the elevator car door is fully open. A fully open condition renders the value of the variable DFO true. Any condition other than fully open causes the value of DFO to be false. If there has been a change in DFO, the OPEN subroutine is called, (a) to determine whether the change in state has affected any of the predefined alarm conditions, (b) to initialize and enable a door close timer if the door is fully opened, (c) to read a door open timer if it was previously enabled, (d) to increment an exceedence counter if necessary, and (e) for other purposes to be described in more detail hereinafter.

After detecting no change in DFO, or after executing the OPEN subroutine, the program next executes a decision instruction 930 in which a determination is made whether a variable DFC has changed since its last interrogation. If it has, a subroutine CLOSE is called in an instruction 932. The DFC variable is used to indicate whether or not the elevator car door is fully closed or not. If it is, the variable DFC assumes the true value. If not, it assumes the false value. If DFC has changed from true to false or vice versa since the last interrogation, the subroutine CLOSE is called in order to determine the amount of time it took for the door to fully close, to compare that value with established limits, and to increment an exceedence counter if necessary, among other things to be described more fully hereinafter.

After determining that no change has occurred in the variable DFC or after executing subroutine CLOSE, the program next executes a decision instruction 934 in which a determination is made whether the variable BRKON, previously described in connection with decision instruction 906, has changed since its last interrogation. If it has, a subroutine BRAKE is called in an instruction 936. The BRAKE subroutine is called in order to determine, among other things to be described more fully hereinafter, whether any of the predefined alarm conditions have now become satisifed due to the change in the variable BRKON.

If no change is detected in BRKON, or if the execution of subroutine BRAKE is concluded, the program next executes a decision instruction 938 in which a determination is made whether a variable DZ has changed since its last interrogation. If it has, a subroutine DZONE is called in an instruc-tion 940. If the variable DZ has true value, an elevator car in a door zone is indicated. A false value indicates otherwise. The DZONE subroutine is called in order to determine, among other things to be described in more detail hereinafter, whether a power failure has occurred.

If no change in DZ was detected in instruction 938 or if the execution of subroutine DZONE is concluded, the program next executes a decision instruction 942 in which a determination of whether a variable ALB has changed since its last interrogation is made. If it has, a subroutine ALARM is called in an instruction 944. The variable ALB is used to indicate whether or not an alarm button has been pressed. During the time while the alarm button associated with the particular elevator car is pressed, the variable ALB assumes the true value. Otherwise, it assumes the false value. The ALARM subroutine is used, among other things to be described in more detail hereinafter, to determine whether an elevator car having its brake on and an alarm button pushed is stopped with its emergency stop button actuated with or without its doors fully open. This particular test, to be described more fully hereinafter, is useful particularly for distinguishing potential rape situations from other emergency stop situations.

After executing the instruction 910–944 to determine the present condition of the elevator car, the program next executes the instruction 902 in a manner similar to that described hereinbefore.

In this way, the selected parameters are periodically interrogated to determine their current status and whether any changes have occurred since the last interrogation and if so, whether any alarm conditions have now been met or cleared or whether the boundaries of any performance criteria have been crossed. Each of the subroutines described above will be described in more detail in connection with FIGS. 10–22.

In FIG. 10, the instructions executed by subroutine INOP are illustrated. An instruction 1000 indicates that the INOP subroutine may be entered from the main program DATAIO, or from any of the subroutines OPEN, NORMAL, or BRAKE. The subroutine next executes a decision instruction 1002 which determines whether the UNOCCUPIED ALARM message was previously sent and if so, whether it is still in effect. If it was sent and is still in effect, the subroutine branches to the return instruction 1004 and the calling program next executes the step following the last step executed prior to calling the INOP subroutine. If the UNOCCUPIED ALARM MESSAGE (INOPS) was not previously sent and further INOPS are not disabled, the program next executes an instruction 1006 in which a subroutine INOLOG is called. After entering subroutine INOLOG in an instruction 1008 as shown in FIG. 10*a*, the program next executes an instruction 1010 in which the Boolean expression BRKON(T) AND DMD(T) AND DF0(F) AND INSPECT(F) is evaluated. The INOLOG subroutine is called in the INOP subroutine in order to determine if an unoccupied abnormal elevator shutdown has occurred. This would be indicated if the brake is on, there is demand, the door is not open, and no inspection is indicated. If an unoccupied abnormal shutdown has occurred, a flag denoted "Z" is set, and the subroutine concludes in a return instruction 1012. The purpose of the "Z" flag is to signal to a decision instruc-tion 1014 the occurrence of an unoccupied abnormal elevator shutdown.

After it is determined whether an unoccupied abnormal shutdown has occurred, the INOP subroutine executes the instruction 1014 in which a determination is made whether the alarm condition tested for in instruction 1010 of subroutine INOLOG is true, i.e. whether the "Z" flag has been set. If the alarm condition is true the program next executes an instruction 1016 in which both a 3 minute and an 8.5 minute INOP timer are started. The 3 minute INOP timer is to ensure that the alarm condition is present for 3 minutes before incrementing a SERVICE INTERRUPT counter in an instruction 1018 which is executed after entering an instruction 1020 after the expiration of the 3 minute INOP timer period. Of course, if the 3 minutes expire and the SERVICE INTERRUPT is incremented, the program returns to executing the next sequential step in the program at the point where it was interrupted after the 3 minute time-out as indicated by the return instruction 1022. Similarly, if 8.5 minutes after starting the 8.5 minute INOP timer, the alarm condition is still true, the program enters an instruction 1022 which then proceeds to call subroutine INOLOG in an instruction 1026. Once again, the INOLOG subroutine tests for an unoccupied abnormal shutdown and then returns to a decision instruction 1028 in which a determination of whether the "Z" flag has been set is made. If so, an UNOCCUPIED ALARM message is sent to the local monitoring center in an instruction 1030. Instruction 1030 also causes a discrete map which is the current record of all elevator parameters in the remote building (current as far as the current 104 millisecond interval is concerned) to be copied into a message buffer in RAM for transmittal to the local and also disables further INOPS. If the alarm condition was found not to be true in instruction 1028, or if the instruction 1030 has been executed, the program next returns to the step it was about to execute before the 8.5 minute INOP time-out occurred, as indicated by a return instruction 1032. If the alarm condition is determined in instruction 1014 of the INOP subroutine to be not true, the subroutine branches to an instruction 1034 which stops both the 3 minute and 8.5 minute timers if they had been previously started and are still running.

In FIG. 11, the ALARM subroutine is illustrated in detail. As may be observed from an instruction 1100, the ALARM subroutine may be entered from the main program DATAIO, or subroutines OPEN or BRAKE. Assuming that that subroutine ALARM has been entered from the main program, i.e. a change has occurred in the variable ALB (the reasons for entering subroutine ALARM from subroutines OPEN or BRAKE will be discussed in connection with the detailed descriptions of each of those subroutines), the program next executes a decision instruction 1102 in which a determination of whether further OCCUPIED ALARMS have been disabled is made. If they have been, the program branches to a return instruction 1104 which returns the program control to the routine that called the ALARM subroutine. If no prior OCCUPIED ALARMS are still in effect, the program next executes an instruction 1106 in which a determination of whether a one second ALARM timer (to be described later) has timed out (expired) is made. If it has finished its timing period the program branches to the return instruction 1104 and the ALARM subroutine is exited. The purpose of the one second ALARM timer is to require a trapped passenger to push the alarm button for a sufficient time to prevent nuisance of false alarms. If the one second ALARM timer has finished, the program next executes an instruction 1108 which evaluates the Boolean expression BRKON(T) AND ALB(T) which is a means of determing whether the elevator is stopped with its brake on while at the same time the alarm button is being pressed. If the Boolean expression is true, the program next determines in an instruction 1110 whether a variable EMSTO is true or false. EMSTO indicates whether or not the emergency stop mechanism has been actuated from within the elevator car. The false condition indicates that the mechanism has not been actuated. In that event, a one second ALARM timer and a 3 minute ALARM timer are started in an instruction 1112. Also, the current values contained within the discrete map are saved in the message buffer for transmittal to the local. The purpose of the one second timer has been described hereinbefore in connection with instruction 1106. The purpose of the 3 minute timer is to ensure that the elevator is in fact shut down and not momentarily disabled. The purpose of the discrete map has been described hereinbefore in connection with FIG. 10. If it is determined in instruction 1110 that the emergency stop mechanism has been actuated, a possible rape situation is indicated with the emergency stop switch activated and the alarm button possibly victim actuated. The program next executes an instruction 1114 which determines whether or not the door is fully open. The reason for including this instruction after determining that the emergency stop button mechanism has been actuated, is to still provide for the possibility of not generating an OCCUPIED ALARM message for an elevator car having its brake on and its alarm button pressed when the emergency stop mechanism is actuated only if the door is fully open. It is common for personnel to hold a car at a floor with the doors open. If the door is fully open, the program next executes an instruction 1116 which stops both the one second and 3 minute ALARM timers. Instruction 1116 is also executed subsequent to instruction 1108 if it is determined in that instruction that BRKON(T) AND ALB(T) is not satisfied.

In FIG. 12, the POWER subroutine is illustrated. Entrance into the subroutine is made in an instruction 1200 where it may be seen from the diagram that any one of the routines DATAIO, OPEN, CLOSE, NORMAL, BRAKE, or DZONE may call the POWER subroutine. Assuming, for purposes of illustration, that entrance into the POWER subroutine has been made from the main DATAIO program (the reasons for calling subroutine POWER during execution of the remaining subroutines has been or will be explained in connection with the detailed explanations of each of those routines), the program next executes a decision instruction 1202 in which a decision as to whether an inspection control byte has been set is made. The significance of testing for a serviceman inspection before testing for a power failure is to ensure that the change detected in the safety chain (see instructions 914 and 916 of FIG. 9) is not the result of the serviceman shutting down the elevator. If a maintenance or service operation is not responsible for the change in the safety chain, the subroutine next calls a subroutine POWLOG in an instruction 1204.

Referring now to FIG. 13, a flowchart illustration of the POWLOG subroutine is shown. Entrance into the subroutine is made at an instruction 1300 where it may be seen that either the POWER subroutine or a 3 minute POWER timer "time-out" may call POWLOG. Assuming, for the moment, that POWLOG has been called by POWER, the POWLOG subroutine next executes an instruction 1302, in which a test is made according to a Boolean expression DFO(T) AND BRKON(T) AND DFC(F) AND INSPECT(T) AND DS(T) AND SAF(T), and a flag "Z" is set if the expression is true. The POWLOG subroutine then returns program control according to an instruction 1304, to the routine from which it was called. The purpose of testing using the above Boolean expression in the POWLOG subroutine is to determine whether power has been removed from the elevator.

Returning now to FIG. 12, the POWER subroutine next executes a decision instruction 1206 in which a determination is made as to whether the "Z" flag was set in the POWLOG subroutine, i.e. whether the power was removed is true. If it is, a 3 minute POWER timer is started in an instruction 1208.

If the inspection control byte is found in decision instruction 1202 to be set, the subroutine branches to an instruction 1210 where the 3 minute POWER timer is stopped. Instruction 1210 will also be executed subsequent to a finding in instruction 1206 that the "Z" flag was not set in subroutine POWLOG. The 3 minute POWER timer is stopped in both of these cases because either the removal of power was deliberate by the serviceman or because power has not been removed. Subsequent to either starting or stopping the 3 minute POWER timer, the POWER subroutine next executes an instruction 1212 which returns to the routine from which subroutine POWER was called.

After returning to the routine that originally called the POWER subroutine the main program DATAIO is eventually returned to while the 3 minute timer, if started, is still running. If the POWER subroutine is not directly called again while its timer is still running and the 3 minute timer expires, the program will interrupt what it is doing and return to the POWER subroutine at an instruction 1214 which causes an instruction 1216 which calls subroutine POWLOG to be executed. After it is determined in subroutine POWLOG whether or not power is still removed from the elevator exists, the test for which has been fully described hereinbefore in connection with FIG. 13 an instruction 1218 is executed in which a decision as to whether the "Z" flag has been set or not is made. If it has, an instruction 1220 causes the discrete map to be copied into the message buffer for transmittal to local and an UNOCCUPIED ALARM message is sent to the local monitoring center. If decision instruction 1218 determines that no alarm condition exists or if instruction 1220 has been executed, an instruction 1222 returns program control back to the original (calling) program at the point at which it was interrupted.

In FIG. 14, a flowchart illustration of a subroutine STPALM is shown. The STPALM subroutine may be called from any one of the subroutines OPEN, CLOSE, LEVEL, or DZONE as is indicated by an instruction 1400. After entering the subroutine at instruction 1400, a decision instruction 1402 is next executed whereby a determination is made as to whether occupied alarms are disabled. The purpose of making this determination is to prevent redundant alarms from being sent to local. If the occupied alarms are found to be disabled an instruction 1404 is executed in which a Boolean expression DFO(T) AND DFC(F) AND DS(F) AND LEV(T) is evaluated to determine whether the car is at a landing with its door open, i.e. whether the alarm condition is no longer present. If it is determined that the alarm condition has been corrected, a decision instruction 1406, in which a determination is made as to whether a five second STPALM timer is already running, is executed. If the timer is not running, an instruction 1408 starts it. If it was found in decision instruction 1404 that the occupied alarm condition has not been corrected, the five second timer is stopped in an instruction 1410. The timer is stopped after finding that the occupied alarm condition has not been corrected because a return to normal message would be inappropriate. If it were found in instruction 1402 that occupied alarms had been disabled, or if the five second timer were found to be already running in instruction 1406, or if it was found necessary to either stop or start the five second timer in instructions 1410 or 1408, subroutine STPALM next executes a return instruction 1412 which causes program control to be returned to the subroutine from which STPALM was called.

If after five seconds the five second timer is still running, the program returns to subroutine STPALM at an instruction 1414 which causes a STPCHK subroutine to be called in an instruction 1416.

Referring now to FIG. 15, a flowchart illustrating subroutine STPCHK is shown. As may be seen from an instruction 1500, the STPCHK subroutine may be entered from either of the subroutines STPALM or BRAKE. Assuming, for the purposes of the description begun in FIG. 14 that STPCHK has been called by STPALM (the reasons for calling STPCHK by the BRAKE subroutine will be discussed more fully in connection with the detailed description of that subroutine) the program next executes a decision instruction 1502 in which a determination of whether occupied or unoccupied alarms have been and remain disabled. If so, the occupied or unoccupied alarm disables are cleared in an instruction 1504. Also, a "RETURN TO NORMAL" message is sent to the local monitoring center. If it is determined in instruction 1502 that no occupied or unoccupied alarms have been and remain disabled, or if instruction 1504 has been fully executed, the program next branches to an instruction 1506 which returns control of the program to the subroutine from which STPCHK was called.

Returning now to FIG. 14, after execution of subroutine STPCHK in instruction 1416, subroutine STPALM next executes a return instruction 1418 which returns control of the program to the subroutine from which STPALM was called.

In FIG. 16, a flowchart illustrating the subroutine NORMAL is shown. The subroutine is entered in an instruction 1600 which next causes subroutine INOP to be called in an instruction 1602. the INOP subroutine has been described fully hereinbefore in connection with FIG. 10 and 10*a*. Referring back to FIG. 10*a*, it will be observed that the Boolean expression tested in subroutine INOLOG includes the variable INSPECT. Since a change in that variable has been detected which caused the NORMAL subroutine to be called (see FIG. 9, instructions 910 and 912), it is necessary to determine, before determining whether to send an "UNDER INSPECTION" message or an "END OF INSPECTION" message, whether any previously sent UNOCCUPIED ALARM messages are still valid. If it is determined in the instruction 1010 of FIG. 10*a* that the status of the "Z" flag must now be changed, the INOP subroutine illustrated in FIG. 10 will then take the appropriate steps.

After executing the INOP subroutine, the program control is returned to the NORMAL subroutine and an instruction 1604, which calls the POWER subroutine, is executed next. The reason for calling the POWER subroutine is because the alarm condition detected by POWER depends on the status of the variable INSPECT which has just changed, as detected in instruction 910 of FIG. 9. If the three minute POWER timer, as described in connection with FIG. 12, is running, the change in the variable INSPECT may result in the POWER subroutine stopping the three minute POWER timer. After determining the effect of the change in the variable INSPECT in the POWER subroutine, the NORMAL subroutine of FIG. 16 next executes a decision instruction 1606 in which a determination is made as to whether the variable INSPECT is true or not. If it is true, i.e. either a key has been turned in the elevator control panel or the elevator machine room, an instruction 1608 is executed in which a one minute INSPECTION timer is started. If it is determined in instruction 1606 that the INSPECT variable is false, an instruction 1610 is executed in which the one minute INSPECTION timer is stopped (if it is running; if it is not running no action is taken except to proceed to the next instruction). The next instruction 1612 determines whether the INSPECTION control flag has been set. If it has, an instruction 1614, in which the INSPECTION control flag is cleared and an "END OF INSPECTION" message is sent to the local monitoring center, is executed. If it is found in instruction 1612 that the INSPECTION control flag was not set, or if either instructions 1608 or 1614 have been fully executed, the subroutine NORMAL returns program control to the main program DATAIO in an instruction 1616.

If, after one minute, no further changes have occurred in the variable INSPECT, the main program will be interrupted and returned to the NORMAL subroutine at an instruction 1618 which next executes a decision instruction 1620 in which a determination is made as to whether the POWER timer is running or not. If it is not, an instruction 1622 is executed in which the INSPECTION control flag is set and an UNDER INSPECTION message is sent to the local monitoring center. If it is determined in instruction 1620 that the POWER timer is running, it is inappropriate to set the INSPECTION control flag or to send the UNDER INSPECTION message and program control is returned in an instruction 1624 to the main program. Instruction 1624 is also executed subsequent to the execution of instruction 1622.

In FIG. 17, a flowchart illustrating the subroutine DZONE is shown. Entrance to subroutine DZONE is made in an instruction 1700 from the main DATAIO program after detection of a change in the variable DZ in instruction 938 of FIG. 9. A change in DZ indicates either the arrival or departure of a car from a door zone at a landing. The purpose of subroutine DZONE is to ensure that if an alarm condition timer associated with either the STPALM or POWER subroutines is running at the time that a change in variable DZ is dectected that the subroutines STPALM or POWER will have the opportunity to stop any such timers. Subroutine DZONE first calls subroutine STPALM in an instruction 1702 and after determining whether the alarm test is satisfied in the instruction 1404 of FIG. 14, it returns either instruction 1406 or instruction 1410 to subroutine DZONE. Subroutine DZONE next executes an instruction 1704 which calls subroutine POWER which is then executed according to the flowchart shown in FIG. 12. If the alarm condition tested for in subroutine POWLOG in the instruction 1302 (FIG. 13) is no longer true, subroutine POWER will stop the three minute POWER timer in an instruction 1210 and then returned to subroutine DZONE. An instruction 1706 returns control of the program from subroutine DZONE to the main program DATAIO.

In FIG. 18, a flowchart illustrating the steps of subroutine LEVEL is shown. Beginning with an instruction 1800 the main program DATAIO enters subroutine LEVEL and next executes an instruction 1802 which calls subroutine STPALM in order to determine if the change detected in the variable LEV in instruction 918 of the main program DATAIO (FIG. 9) should, in the absence of a disabled alarm, start or stop the five second STPALM timer (which is used to sent a RETURN TO NORMAL message). After determing whether the alarms are disabled and, if not disabled, returning to subroutine LEVEL, or, if disabled, starting or stopping the five second STPALM timer, program control is returned to subroutine LEVEL for execution of the next instruction 1804 which calls subroutine LEVCHK. FIG. 19 illustrates the flowchart of subroutine LEVCHK which begins at an instruction 1900 which may be entered from any of the subroutines OPEN, BRAKE or LEVEL. The reason for calling subroutine LEVCHK is to determine, after detecting a change in the variable LEV if the elevator is level (which indicates if the elevator is level with a landing floor), whether a leveling error has occurred. Leveling errors sometimes occur when an elevator is approaching its landing and does not stop in the position where its floor is exactly level with the floor of the landing. If the error exceeds a preselected range of allowable errors, the variable LEV is caused to assume the false value. After entering subroutine LEVCHK in instruction 1900 an instruction 1902 is executed and a determination is made as to whether the door is fully open and the brake is fully applied (DFO(T) AND BRKON(T)=TRUE). If not, then there is no reason to check if a leveling error has occurred since the elevator has not arrived and stopped with its door fully open at a landing and program control is returned, in an instruction 1904, to the subroutine from which it was called, in this case LEVEL. If it is determined in instruction 1902 that the elevator car door is fully open with the brake on, an instruction 1906 is then executed in which the status of the variable LEV is checked; if it is true, i.e. no leveling error has occurred, program control is once again returned to the calling subroutine via instruction 1904. If, however, the variable LEV is found to be false, i.e. a leveling error has occurred, the leveling error counter is incremented in instruction 1908 from which program control is then returned to the calling subroutine via instruction 1904.

In FIG. 20, a flowchart illustrating the subroutine BRAKE is shown. The subroutine is entered at an instruction 2000 from the main program DATAIO from which an instruction 2002 which calls subroutine ALARM is next executed. Subroutine ALARM is called in subroutine BRAKE because either the one second or three minute ALARM timer may be running and a change in the variable BRKON from true to false would logically require that all ALARM timers be stopped (see instruction 1108 of FIG. 11). After executing subroutine ALARM the subroutine next executes an instruction 2004 which calls subroutine INOP in order to determine whether to stop any INOP timers which may be running. This is accomplished according to the flowcharts shown in FIG. 10 and 10*a* which have been described fully hereinbefore. If it is determined that any running INOP timers should be stopped then no UNOCCUPIED ALARM message will be sent. This is entirely appropriate since the brake should be on before such an alarm message is sent. After executing instruction 2004, an instruction 2006 is next executed in which subroutine LEVCHK is called. The purpose of calling subroutine LEVCHK, which has been described in connection with FIG. 19 is to determine if the leveling error counter should be incremented or not. Once this is determined, an instruction 2008 is executed in which subroutine POWER, which has been fully described in connection with FIGS. 12 and 13, is called. The reason for calling subroutine POWER is to determine whether the three minute POWER timer is running and if so, to stop it. Once instruction 2008 is fully executed, a decision instruction 2010 which determines whether the variable BRKON is true or not is made. If it is determined in instruction 2010 that the variable BRKON is not true, then an instruction 2012 is executed in which the one second timer alarm flag for the alarm button is cleared, the three minute occupied alarm timer is stopped, and a three second timer for enabling a ONE FLOOR RUN timing routine is started. After execution of instruction 2012, the subroutine next executes an instruction 2014 in which the ONE FLOOR RUN counter is incremented. Next, an instruction 2016 in which the subroutine STPCHK is called, is executed. If it was determined in instruction 2010 that variable BRKON was true, an instruction 2018 is executed in which a decision is made as to whether an OFRT discrete has changed state. If it has not, an instruction 2020 reads the ONE FLOOR RUN time and compares that time with selected limits. An exceedence counter is incremented is any of those limits are exceeded. After executing instruction 2016, 2018 or 2020 program control is returned to the main program DATAIO via instruction 2020. When the three second timer expires at the conclusion of the three second timing period, the main program interrupts whatever it is then executing and returns to the BRAKE subroutine at an instruction 2024 in order to execute instruction 2026 wherein the ONE FLOOR RUN timer is enabled. Once the OFR timer is enabled program control is returned via an instruction 2028 to the main program DATAIO.

In FIG. 21, the subroutine OPEN is illustrated. The subroutine is entered at an instruction 2100 from the main program DATAIO. Since a change in the variable DFO has the potential of affecting timers which may be running in subroutines ALARM, INOP, STPALM, and POWER, and also may affect the leveling error counter in subroutine LEVCHK, each of these subroutines is called individually in instructions 2102, 2104, 2108, and 2110. Each of the subroutines has been described fully hereinbefore and will not be described further here. After executing instruction 2110, subroutine OPEN next executes a decision instruction 2112 in which a determination as to whether the variable DFO is true or not is made. If it is not true then the change detected in DFO in instructions 926 of FIG. 9 must have been a change from the door being fully open to the door beginning to close. Therefore, the door close timer is initialized and enabled in an instruction 2114. If it is determined in instruction 2112 that the door is fully open, a decision instruction 2116 is executed and a determination is made as to whether the door open timer has been enabled or not. If it has, an instruction 2118 is executed and the time for the door to open is read from the door open timer, the time is compared with ranges of acceptable limits, and a door open exceedance counter is incremented if a limit is exceeded. After executing instruction 2114, 2116 or 2118, program control is returned to the main program DATAIO via an instruction 2120.

In FIG. 22, the subroutine CLOSE is illustrated in a flowchart. The subroutine is entered from the main program DATAIO in an instruction 2200. After entering in instruction 2200, the subroutine next executes an instruction 2202 in which subroutine STPALM is called. STPALM is called because that subroutine has a five second timer which may have been started based on the elevator door being not fully closed. If the elevator door is now fully closed and the five second timer is still running, it is necessary to stop the timer before a RETURN TO NORMAL message is sent. After executing subroutine STPALM a subroutine POWER is called in an instruction 2204. The POWER subroutine is called because a POWER timer may be running based on a previous indication of the elevator door fully closed variable being false (DFC(F)). If the change detected in instruction 930 of the flowchart of FIG. 9 is a change to the fully closed position, then the Boolean expression tested for in instruction 1302 of the flowchart of FIG. 13 is no longer true and the three minute POWER timer should be stopped (if running) via instruction 1210 of the flow chart of FIG. 12. After executing subroutine POWER, subroutine CLOSE next executes a decision instruction 2206 in which a decision is reached as to whether the variable DFC is true or not. If the door is not fully closed, an instruction 2208 is executed in which a door closed timer is initialized and enabled and a door operations counter is incremented. If the door is found to be fully closed in instruction 2206, a decision instruction 2210 is executed in which a decision is made as to whether the door close timer is enabled or not. If it is, an instruction 2212 is executed in which the door close timer is read and the value compared with a range of acceptable limits, and an exceedance counter is incremented if any limit is exceeded. After instruction 2208, 2210, or 2212 is executed subroutine CLOSE then returns program control to the main program DATAIO via a return instruction 2214.

It should be understood that the apparatus of the present invention is not restricted to elevator car systems. It is usable in any operating system which may be monitored for performance data or alarm conditions. The invention may be used for monitoring a single operating system either at the site of the system or remotely. The invention may also be used to monitor a plurality of operating systems. In that case, if the operating systems are all at the same location, and it is desired to monitor all of the systems at that location, and there is no requirement to monitor the operating systems at either a local or a central office then the communications equipment, including the modems 24, 26, 32 of FIG. 1 are unnecessary. Similarly, where it is desirable to monitor a plurality of operating systems each physically located in a different location but where is is not necessary to include a central monitoring office, a scheme similar to one of the local offices 14 is pictured in FIG. 1 having a plurality of remote systems 12 communicating with it may also be implemented. In that case the central office 16 is eliminated.

The method of transmitting elevator inputs from the sensors to the signal processor 302 of FIG. 4 as shown in FIGS. 2, 3, 4, 5, 6, and 7 is essentially a parallel-to-serial-to-parallel operation which is not absolutely necessary for the practice of the invention. For example, each of the elevator inputs could have been hard wired from each sensor to the processor and multiplexed at that point into the data bus by means well known in the art. Such a method may be feasible in operating systems where the wiring from the sensors to the processor location is already in place, e.g. where spare contacts of already existing relays may be connected up to in a central location. Similarly, it should be understood that the protocol, the organization of the input and output lines, the address configure and control structure, etc, dictated by the use of the industrial control unit 104 of FIG. 2 are constraints that would be very different if a different piece of hardware were chosen to accomplish its function.

It should also be understood that the use of opto isolators and signal conditioning for the elevator input signals is not absolutely necessary for the practice of the invention. Such isolation is desirable in noisy environments but should not be thought of as an essential part of the invention.

It should also be understood that the signal processor, the RAM, the ROM, and the supporting circuitry disclosed in FIGS. 6 and 7 are all very specific pieces of hardware which should not be thought of as individually necessary for the practice of the invention. The signal processor structure used here could as easily have been accomplished using different pieces of hardware while accomplishing the same or a similar function.

It should also be understood that the flowcharts of FIGS. 8–22 are very specific algorithms intended for use in a very narrow art, i.e. elevator systems. The use of these very specific algorithms should not be construed as the only algorithms which may be used to practice the invention. The invention may be successfully practiced using any combination of parameters to make an evaluation that any alarm condition either exists or not. Therefore, the invention should not be restricted to use in elevator systems nor should its use in elevator systems be restricted to the use of only these algorithms.

Similarly, although the invention has been shown and described with respect to preferred embodiments thereof, it should be understood by those skilled in the art that the foregoing and various other changes, omissions and additions may be made therein without departing from the spirit and scope of the invention.

I claim:

1. Apparatus for use with an associated centrally located service office for automatically detecting various elevator system malfunctions whenever they occur in a plurality of operating elevator systems located in a corresponding plurality of remote buildings by continually monitoring discrete elevator system parameter signals indicative of the states of selected parameters in the operating elevator systems, each apparatus installed in each remote building comprising:

elevator system monitor means, responsive, both before and after the occurrence of any malfunctions, to the discrete parameter signals associated with its building's elevator system, each having signal processor means including memory means for storing signals including resident signals grouped in equations which predefine combinations of selected discrete parameter signals in specified states and which equations, when satisfied, are each indicative of the occurrence of one of the various elevator system malfunctions which may occur in an operating elevator system, said signal processor means sampling and storing in said memory means successive sampled values of the discrete parameter signals for comparing each present sampled value with a preceding sampled value for detecting a state change therebetween, said signal processor means identifying, in the presence of each such state change, the one or more of said equations that have become satisfied as a result of said state change, said signal processor means providing a message signal for each occurrence of said satisfied equations; and communication element means, responsive to its system's message signals for initiating transmission of said system's message signals to the associated centrally located service office.

2. The apparatus of claim 1, wherein each monitor means includes:

one or more slave means, each responsive to one or more discrete parameter signals, for providing each discrete signal at a selected position in an associated data frame of a repeating sequence of timed data frames, each selected position in each frame being associated with a particular discrete parameter signal;

transmission line means, operatively connected to each of said one or more slave means, responsive to discrete parameter signals in said repeating sequence for transmitting discrete parameter signals in said repeating sequence; and master means, responsive to transmitted discrete parameter signals in said repeating sequence, said master means having signal processor means, including memory means for storing signals, including resident signals grouped in equations which predefine combinations of selected discrete parameter signals in specified states and which equations, when satisfied, are each indicative of one of the various elevator system malfunctions which may occur in a operating elevator system, said signal processor means sampling and storing in said memory means successive values of the discrete parameter signals for comparing each present sampled value with a preceding sampled value for detecting a state change therebetween, said signal processor means identifying, in the presence of each such state change, the one or more of said equations that have become satisified as a result of said state change, said signal processor means providing a message signal for each occurrence of said satisified equations.

3. The apparatus of claim 1, wherein at least one of said equations defines a combination of discrete parameter signals the first occurrence of which causes said communication element means to immediately initiate an alarm condition message signal transmission indicating that immediate corrective action is required.

4. The apparatus of claim 1, wherein at least one of said equations defines a combination of discrete parameter signals each occurrence of which causes an associated exceedance count signal value to be incremented in value, wherein the magnitude of said count signal value indicates a performance aspect of the system, and wherein a performance message signal indicative of the magnitude of said count signal value is transmitted periodically by said communication element means.

5. A monitoring system for automatically detecting various elevator system malfunctions whenever they occur in a plurality of operating elevator systems located in a corresponding plurality of remote buildings by continually monitoring discrete elevator system parameter signals indicative of the states of selected parameters in the operator elevator systems, comprising:

elevator system monitoring means, at least one installed in each remote building, responsive, both before and after the occurrence of any malfunctions, to the discrete parameter signals associated with its building's elevator system, each having signal processor means including memory means for storing signals including resident signals grouped in equations which predefine combinations of selected discrete parameter signals in specified states and which equations, when satisfied, are each indicative of the occurrence of one of the various elevator system malfunctions which may occur in an operating elevator system, said signal processor means sampling and storing in said memory means successive sampled values of the discrete parameter signals for comparing each present sampled value with a preceding sampled value for detecting a state change therebetween, said signal processor means identifying, in the presence of each such state change, the one or more of said equations that may have become satisified as a result of said state change, said signal processor means providing a message signal for each occurrence of said satisifed equations;

communication element means, at least one installed in each remote building, responsive to its building's system message signals for initiating transmission and providing said system message signals;

local service office communication element means, at least one for each of a plurality of local service offices, each responsive to message signals transmitted from at least one of said remote communication element means for providing each message signal received; and display means, at least one for each local service office, responsive to said message signals from said local service office communication element means, for displaying messages identified according to each remote system condition detected.

6. The apparatus of claim 5, further comprising:

central office communication element means, responsive to said message signals from any one of the plurality of local office communication element means, for providing local office message signals; and central office display means, responsive to local office message signals from said central office communication element means, for displaying messages corresponding to each system condition detected.

7. The apparatus of claim 6, further comprising, central office bulk storage means responsive to said message signals from said central office communication element means for storing said message signals.

8. The apparatus of claim 1, wherein said monitor means further comprises signal processor means including memory means for storing signals including count signals, each count signal being uniquely associated with one of said parameter signals, each of said count signals being indicative of the total number of occurrences of a selected elevator operation or misoperation as indicated by selected state changes in its associated parameter signal, said signal processor means sampling and storing in said memory means successive sampled values of the discrete parameter signals for comparing each present sampled value with a preceding sampled value for detecting a state change therebetween, said signal processor means identifying and incrementing, in the presence of each such state change, the associated count signal which must be incremented as a result of said state change, said signal processor means periodically providing a message signal indicative of the present count of each of said count signals.

9. The apparatus of claim 2, wherein each master means includes signal processor means, including memory means for storing signals including count signals, each count signal being uniquely associated with one of said parameter signals, each of said count signals being indicative of the total number of occurrences of a selected elevator operation or misoperation as indicated by selected state changes in its associated parameter signal, said signal processor means sampling and storing in said memory means successive sampled values of the discrete parameter signals for comparing each present sampled value with a preceeding sampled value for detecting a state change therebetween, said signal processor means identifying and incrementing, in the presence of each such state change, the associated count signal which must be incremented as a result of said state change, said signal processor means periodically providing a message signal indicative of the present count of each of said count signals.

* * * * *

UNITED STATES PATENT AND TRADEMARK OFFICE

CERTIFICATE OF CORRECTION

PATENT NO. : 4,568,909

DATED : February 4, 1986

INVENTOR(S) : Charles Whynacht

It is certified that error appears in the above-identified patent and that said Letters Patent is hereby corrected as shown below:

Sheets 1-19 of the Drawings should be deleted to appear as per attached sheets.

Signed and Sealed this

*Nineteenth* Day of *August 1986*

[SEAL]

*Attest:*

DONALD J. QUIGG

*Attesting Officer*

*Commissioner of Patents and Trademarks*

| FIG. 5A | FIG. 5B |
|---|---|

Txd
DTR
RTS
Rcd
CTS
DCD
RI
-12V
+12V
DVR
RCVR
RS232V24
Va
Z8601
SINGLE CHIP MASTER/SLAVE COMMUNICATION INTERFACE AND UART
Vcc
LS04
8-BIT LATCH (LS374)
BUS ACK
BUS REQ
MEM REQ
CLOCK
VECTOR
Vdd
2N2907A
339
IN4371
TERM NETWORK
COMMUNICATION LINES

MASTER CLOCK
CRYSTAL AND CKTRY
MXD-55-4
EXT
PROCESSOR
Z80
60 HZ INTERRUPT
FULL WAVE RECTIFIER
XFMR
POWER SUPPLY
120 VAC 60 HZ

306
ROM
TMM2764D
304
702
RAM
TMM2016P-2
MEMORY DECODER SELECTER MULTIPLEXER
700
704
Vcc
316
D0
D1
D2
D3
D4
D5
D6
D7
BUS REQ
BUS ACK
WR
MEM REQ
CLOCK
604
602
606
608
610
612
VECTOR
10K
1N4001
Vcc
1N4001
750
Ma

DATA/O

INOP

INOLOG

ALARM

POWER

POWLOG

STPALM

STPCHK

NORMAL

DZONE

LEVEL

LEVCHK

BRAKE

OPEN

CLOSE

BINARY ADDRESS LINES CORRESPONDING TO EACH HEXADECIMAL BIT $A_{15}\ A_{14}\ A_{13}\ A_{12}$ $A_{11}\ A_{10}\ A_9\ A_8$ $A_7\ A_6\ A_5\ A_4$ $A_3\ A_2\ A_1\ A_0$

| DECIMAL ADDRESS | HEX BIT 3 ($16^3$) | HEX BIT 2 ($16^2$) | HEX BIT 1 ($16^1$) | HEX BIT 0 ($16^0$) | |
|---|---|---|---|---|---|
| 0 0 0 0 | 0 | 0 | 0 | 0 | 8K |
| | 0 | F | F | F | |
| | 1 | 0 | 0 | 0 | |
| 8 1 9 1 | 1 | F | F | F | |
| 8 1 9 2 | 2 | 0 | 0 | 0 | 8K |
| | 2 | F | F | F | |
| | 3 | 0 | 0 | 0 | |
| 16,3 8 3 | 3 | F | F | F | |
| 16,3 8 4 | 4 | 0 | 0 | 0 | 8K |
| | 4 | F | F | F | |
| | 5 | 0 | 0 | 0 | |
| 24,5 7 5 | 5 | F | F | F | |
| 24,5 7 6 | 6 | 0 | 0 | 0 | 8K |
| | 6 | F | F | F | |
| | 7 | 0 | 0 | 0 | |
| 32,7 6 7 | 7 | F | F | F | |
| 32,7 6 8 | 8 | 0 | 0 | 0 | 8K |
| | 8 | F | F | F | |
| | 9 | 0 | 0 | 0 | |
| 40,9 5 9 | 9 | F | F | F | |
| 40,9 6 0 | A | 0 | 0 | 0 | 8K |
| | A | F | F | F | |
| | B | 0 | 0 | 0 | |
| 49,1 5 1 | B | F | F | F | |
| 49,1 5 2 | C | 0 | 0 | 0 | 8K |
| | C | F | F | F | |
| | D | 0 | 0 | 0 | |
| 57,3 4 3 | D | F | F | F | |
| 57,3 4 4 | E | 0 | 0 | 0 | 8K |
| | E | F | F | F | |
| | F | 0 | 0 | 0 | |
| 65,5 3 5 | F | F | F | F | |

BINARY REPRESENTATION OF MOST SIGNIFICANT BITS (HEX BIT 3)

| HEX BIT 3 | $A_{15}$ $2^3$ | $A_{14}$ $2^2$ | $A_{13}$ $2^1$ | $A_{12}$ $2^0$ |
|---|---|---|---|---|
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 1 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| A | 1 | 0 | 1 | 0 |
| B | 1 | 0 | 1 | 1 |
| C | 1 | 1 | 0 | 0 |
| D | 1 | 1 | 0 | 1 |
| E | 1 | 1 | 1 | 0 |
| F | 1 | 1 | 1 | 1 |

TABLE II